US007208264B2

(12) United States Patent
Suzuki et al.

(10) Patent No.: US 7,208,264 B2
(45) Date of Patent: Apr. 24, 2007

(54) PHOTOTHERMOGRAPHIC MATERIAL AND METHOD OF FORMING IMAGES

(75) Inventors: Keiichi Suzuki, Kanagawa (JP); Kouta Fukui, Kanagawa (JP); Minoru Sakai, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 53 days.

(21) Appl. No.: 11/071,248

(22) Filed: Mar. 4, 2005

(65) Prior Publication Data

US 2005/0202353 A1 Sep. 15, 2005

(30) Foreign Application Priority Data

Mar. 5, 2004 (JP) ..... 2004-062557
Feb. 28, 2005 (JP) ..... 2005-055209

(51) Int. Cl.
*G03C 1/76* (2006.01)
*G03C 1/498* (2006.01)

(52) U.S. Cl. ..... 430/617; 430/618; 430/619; 430/620; 430/348; 430/350

(58) Field of Classification Search ..... 430/617, 430/618, 619, 620, 348, 350
See application file for complete search history.

(56) References Cited

FOREIGN PATENT DOCUMENTS

JP A 10-186571 7/1998

*Primary Examiner*—Hoa Van Le
(74) *Attorney, Agent, or Firm*—Margaret A. Burke; Sheldon J. Moss

(57) ABSTRACT

A photothermographic material wherein at least an image-forming layer on at least one surface of a support, the image-forming layer containing a photosensitive silver halide, a non-photosensitive organic silver salt, a reducing agent, and a binder, wherein, an outermost layer is provided as a layer most remote from the support on the side of the support where the image-forming layer is provided, a non-photosensitive intermediate layer A containing a binder and provided in adjacent with the image-forming layer and between the image-forming layer and the outermost layer, wherein the binder of the non-photosensitive intermediate layer A contains 80% by mass or more of a polymer formed by copolymerizing a monomer represented by Formula (M), a non-photosensitive intermediate layer B containing a binder and provided between the non-photosensitive intermediate layer A and the outermost layer, and the binder of the non-photosensitive intermediate layer B contains 50% by mass or more of a hydrophilic polymer derived from animal protein:

$$CH_2{=}CR^{01}{-}CR^{02}{=}CH_2, \qquad \text{Formula (M)}$$

as well as image forming method thereof.

22 Claims, 2 Drawing Sheets

PHOTOTHERMOGRAPHIC MATERIAL AND METHOD OF FORMING IMAGES

CROSS-REFERENCE TO RELATED APPLICATION

This application claims priority under 35 USC 119 from Japanese Patent Application Nos. 2004-062557 and 2005-055209, the disclosures of which are in orated by reference herein.

BACKGROUND OF THE INVENTION

1. Field of the Invention

The present invention relates to a photothermographic material and a method of forming images of the photothermographic material.

2. Description of the Related Art

In recent years, it has been strongly desired in the field of films for medical imaging to reduce the amount of used processing liquid waste in consideration of environmental protection and space saving. For this reason, technology regarding photothermographic materials as films for medical imaging and for photographic applications, which are capable of efficient exposure with a laser image setter or a laser imager and capable of forming a clear black-toned image with high resolution and high sharpness is desired. Such photothermographic materials can eliminate use of liquid processing chemicals and can provide users with a thermal development system which is simpler and does not contaminate the environment.

Although similar requirements also exist in the field of general image forming materials, an image for medical imaging requires a particularly high image quality excellent in sharpness and granularity because a delicate image representation is necessitated. Also an image of blue-black tone is preferred in consideration of easy diagnosis. Currently various hard copy systems utilizing pigments or dyes, such as ink jet printers and electrophotographic systems, are available as general image forming systems, but they are not satisfactory as output systems for medical images.

Thermal image forming systems utilizing an organic silver salt are described widely. Particularly, a photothermographic material generally has an image-forming layer that includes a catalytically active amount of a photocatalyst (for example, a silver halide), a reducing agent, a reducible silver salt (for example, an organic silver salt), and, optionally, a color toning agent for controlling the tone of silver dispersed in a binder matrix. After imagewise exposure, the photothermographic material is heated to a high temperature (for example, 80° C. or higher) and black silver images are formed by an oxidation/reduction reaction between the silver halide or the reducible silver salt (functioning as an oxidizer) and a reducing agent. The oxidation/reduction reaction is promoted by the catalytic effect of latent images in the silver halide formed by exposure. As a result, black silver images are formed in an exposed area. The Fuji Medical Dry Imager FM-DPL has been commercially available as a medical image forming system using photothermographic materials.

Since the ingredient componetns described above are contained in a photothermograhpic material and all of the components remain even after development, there are many issues concerning storage stability. Often studied methodologies for solving the problems have so far included change of the composition contained in the image-forming layer and addition of new compounds. Various methods have been studied and successful results have been achieved such as, for example, improvement of the print out property by changing silver halides to those of high silver iodide content as described in JP-A No. 8-297345 and JP No. 2785129, suppression of the occurrence of fogging by the addition of polyhalogen compounds as described in JP-A No. 2001-312027, or increase of the silver behenate content in a non-photosensitive organic silver salt as described in JP-A No. 2000-7683.

Since the image-forming layer is a portion directly forming images, it is extremely important to study the compositions contained in the image-forming layer as a method of improving the storage stability. However, since such compositions are present in admixture in the image-forming layer, sensitivity tends to be lowered when an attempt is made to improve the storage stability, and image density tends to be lowered when an attempt is made to suppress occurrence of fogging. It is extremely difficult to simultaneously attain both the reciprocal properties of storage stability and higher sensitivity, and those of suppression of fogging and image density.

As described above, a photothermographic material is prepared in a well-balanced manner so as to benefit from the advantages of the respective compositions to the utmost degree, improvement of storage stability being difficult with a mere change or addition of one composition. There is always a keen desire for a method of improving storage stability without offsetting the features of individual compositions.

SUMMARY OF THE INVENTION

The present invention intends to provide a photothermographic material excellent in the store stability of an unexposed photosensitive material (unprocessed storebility) and the image storability after exposure, as well as provide a method of forming images thereof.

A first aspect of the invention is to provide a photothermographic material wherein an image-forming layer containing a photosensitive silver halide, a non-photosensitive organic silver salt, a reducing agent, and a binder on at least one surface of a support is provided, further comprising;

an outermost layer is provided as a layer most remote from the support on the side of the support where the image-forming layer is provided, a non-photosensitive intermediate layer A containing a binder and provided adjacent to the image-forming layer and between the image-forming, layer and the outermost layer, wherein the binder of the non-photosensitive intermediate layer A contains 80% by mass or more of a polymer formed by copolymerizing a monomer represented by Formula (M), a non-photosensitive intermediate layer B containing a binder and provided between the non-photosensitive intermediate layer A and the outermost layer, and at least one binder of the binder of the outermost layer and the binder of the non-photosensitive intermediate layer B contains 50% by mass or more of a hydrophilic polymer derived from animal protein.

$$CH_2{=}CR^{01}{-}CR^{02}{=}CH_2 \qquad \text{Formula (M)}$$

wherein $R^{01}$ and $R^{02}$ represent each independently a hydrogen atom, an alkyl group of from 1 to 6 carbon atoms, a halogen atom or a cyano group.

A second aspect of the invention is to provide a method of forming an image of A photothermographic material comprising image-exposing and heat developing, wherein the photothermographic material according to the invention is heated for 7 sec or more and 16 sec or less in the developing.

A third aspect of the invention is to provide a method of forming images of A photothermographic material comprising image-exposing and heat developing, wherein the photothermographic material according to the invention is transported at a rate of 23 mm/sec or more in the heat developing.

DETAILED DESCRIPTION OF THE INVENTION

Figure 1:
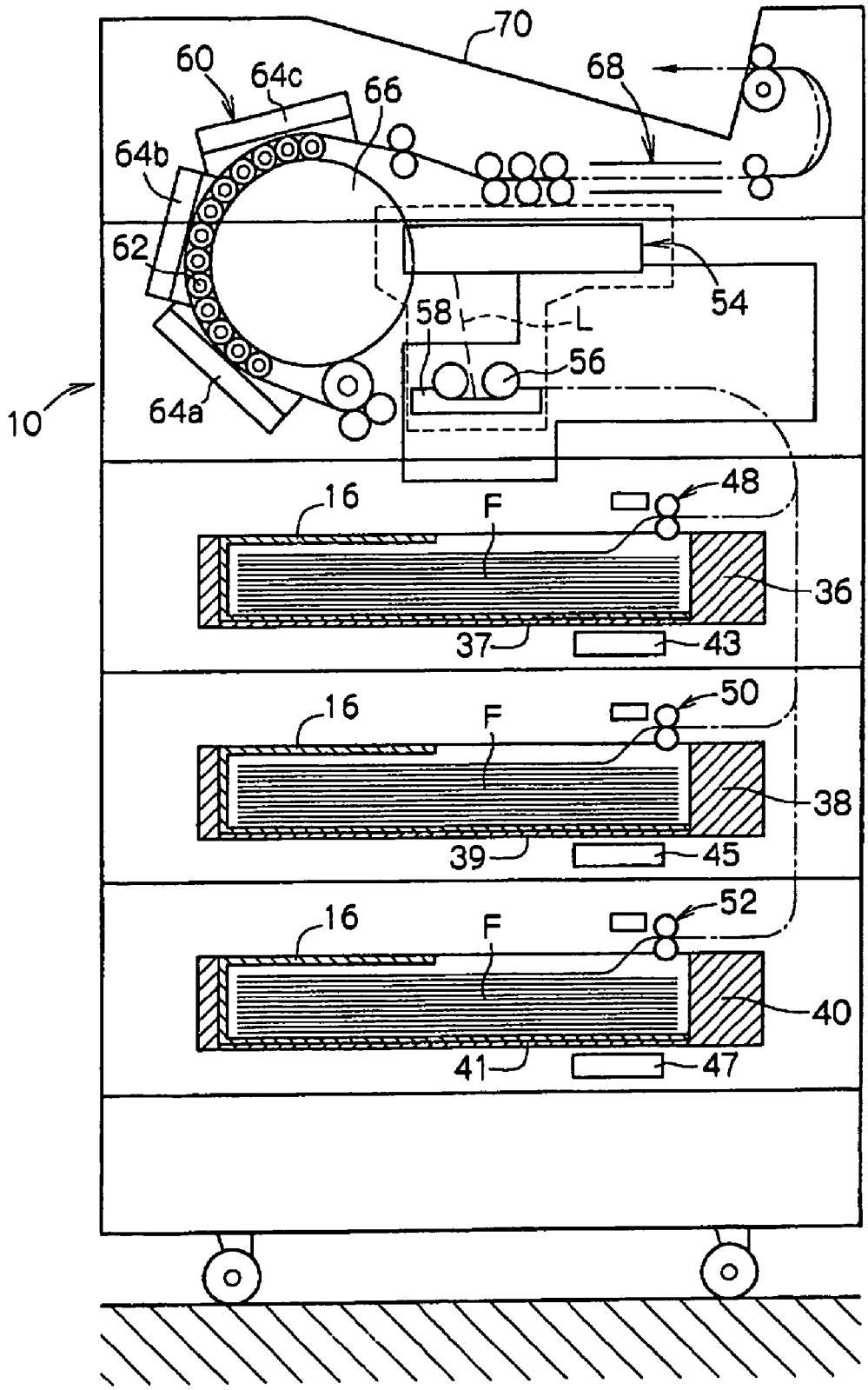
FIG. 1 is a schematic constitutional view of a heat developing apparatus in which a laser recording device according to the invention is mounted.

The photothermographic material according to the present invention is a photothermographic material in which at least an image-forming layer containing a photosensitive silver halide, a non-photosensitive organic silver salt, a reducing agent, and a binder on at least one surface of a support, wherein, an outermost layer containing a binder and provided as a layer most remote from the support on the side of the support where the image-forming layer is provided, a non-photosensitive intermediate layer A containing a binder and provided adjacent with the image-forming layer and between the image-forming layer and the outermost layer, the binder of the non-photosensitive intermediate layer A contains 80% by mass or more of a polymer formed by copolymerizing a monomer represented by the following Formula (M), a non-photosensitive intermediate layer B containing a binder and provided between the non-photosensitive intermediate layer A and the outermost layer, and at least one layer of the outermost layer and the non-photosensitive intermediate layer B contains 50% by mass or more of a hydrophilic polymer derived from animal protein.

Usually, for improving the storability, the composition of the image-forming layer is changed. However, when the composition of the image-forming layer is changed, adjustment with other compositions is difficult and, whenever a newly developed composition is applied to the image-forming layer, it has to be studied again for all the compositions. Further, since the outermost layer is a portion in direct contact with an external portion during development, transportation and storage, etc., study has to be made on the problems other than the picture quality. For example, in order to improve the scratch resistance, the transportability (slipping property), etc., a matting agent or a lubricant is added to the outermost layer (or layer adjacent with the outermost layer). Accordingly, when the composition of the outermost layer is changed, the physical properties may possibly be changed, so that significant change of the composition is difficult.

In view of the above, the present inventors, et al. have focused attention on a non-photosensitive intermediate layer between the image-forming layer and the outermost layer, and have found it important to make the layer adjacent with the image-forming layer as a highly hydrophobic layer in order to efficiently prevent intrusion of water content, etc. from the external portion to the image-forming layer. In the invention, in order to improve the storability, a binder of an extremely high hydrophobic property is applied to a non-photosensitive intermediate layer adjacent with the image-forming layer. When the study was made on the highly hydrophobic binder, a binder containing 80% by mass or more of a polymer (latex thereof) formed by copolymerizing a monomer represented by the Formula (M) gave extremely excellent result for the image storability.

However, the hydrophobic binder had no setting property and involved a problem in view of the coatability. The setting property means that a coating solution is gelled by the lowering of the temperature to lose fluidity. By the utilization of the property, the fluidity can be retained by coating a heated coating solution on a support and then cooling the same. Accordingly, in a case of using a coating solution having a setting property, unevenness is less likely to be caused by air blowing during drying making the coating surface uniform. In the invention, in order to improve the coating surface property and the coating operation efficiency, a water soluble polymer (gelatin, etc.) containing a layer derived from an animal protein is provided in any of the layers on the side remote from the support than the non-photosensitive intermediate layer A containing a highly hydrophobic binder. With such a layer constitution, the fluidity on the surface of the image-forming layer is eliminated and the coating surface property is also made uniform. In the photothermographic material, because of the absence of swelling due to a liquid developer treatment, even slight non-uniformity of the coating surface during manufacture develops as uneven density or haze to possibly hinder image diagnosis. In the photothermographic material, uniformness of the coating film is an extremely important feature.

Further, the photothermogrphic material of a composition adapted such that heat development can be processed rapidly, is more liable to undergo the effect of external circumstances. The composition of the photosensitive material for rapid processing has features, for example, that (1) a reducing agent is rendered highly active, (2) a development accelerator is added, (3) a specific anti-foggant is used, (4) a specific color toning agent is added, etc. Also for the photothermographic material for rapid processing, the photothermographic material having the layer constitution described above shows excellent storage stability.

The invention can provide a photothermographic material excellent in storage stability of an unexposed photosensitive material (unprocessed storability) and the image storability after exposure, as well as a method of forming images thereof.

The layer constitution of the photothermographic material according to the invention is to be described at first and then constituent ingredients for each of the layers are to be described.

1. Layer Constitution

The photothermographic material of the invention, has at least one image-forming layer, and has a non-photosensitive intermediate layer between the outermost layer and the image-forming layer. The non-photosensitive intermediate layer is provided at least by two layers which are, respectively, referred to as a non-photosensitive intermediate layer A and a non-photosensitive intermediate layer B. The non-photosensitive intermediate layer A is provided adjacent with the image-forming layer and the non-photosensitive intermediate layer B is provided between the non-photosensitive intermediate layer A and the outermost layer. The binder of the non-photosensitive intermediate layer A contains 80% by mass or more of a latex of a polymer formed by polymerizing monomer represented by the Formula (M). In at least one of the outermost layer and the non-photosensitive intermediate layer B, the binder contains 50% by mass or more of a hydrophilic polymer derived from an animal protein.

by copolymerizing the monomer represented by the Formula (M) is referred to as "hydrophobic polymer", a hydrophilic polymer derived from the animal protein (for example, gelatin) is referred to as "hydrophilic polymer-1", and those containing 50% by mass or more of the hydrophilic polymer not derived from the animal protein (for example, polyvinyl alcohol (PVA)) are referred to as "hydrophilic polymer-2".

| | Binder species | | | | | |
|---|---|---|---|---|---|---|
| | Layer Constitution Example 1 | Layer Constitution Example 2 | Layer Constitution Example 3 | Layer Constitution Example 4 | Layer Constitution Example 5 | Layer Constitution Example 6 |
| Outermost layer | Containing 50% by mass or more of hydrophilic polymer-1 | Hydrophobic polymer | Containing 50% by mass or more of hydrophilic polymer-1 | Containing 50% by mass or more of hydrophilic polymer-1 | Hydrophobic polymer | Hydrophobic polymer/ hydrophilic polymer-1 |
| Non-photosensitive intermediate layer B | Containing 50% by mass or more of hydrophilic polymer-2 | Containing 50% by mass or more of hydrophilic polymer-1 | Containing 50% by mass or more of hydrophilic polymer-1 | Containing 50% by mass or more of hydrophilic polymer-1 Containing 50% by mass or more of hydrophilic polymer-2 | Containing 50% by mass or more of hydrophilic polymer-1 Containing 50% by mass or more of hydrophilic polymer-2 | Containing 50% by mass or more of hydrophilic polymer-1 Containing 50% by mass or more of hydrophilic polymer-2 |
| Non-photosensitive intermediate layer A Image-forming layer | 80% by mass or more of polymer of Formula (M) | 80% by mass or more of polymer of Formula (M) | 80% by mass or more of polymer of Formula (M) | 80% by mass or more of polymer of Formula (M) | 80% by mass or more of polymer of Formula (M) | 80% by mass or more of polymer of Formula (M) |

That is, essential layers for the layer constitution are (1) an image-forming layer, (2) a non-photosensitive intermediate layer A, (3) a non-photosensitive intermediate layer B, and (4) an outermost layer on the side of the support. In a case where the image-forming layer and the non-photosensitive intermediate layer A are provided in adjacent to each other, each of the layers may be a single layer or two or more layers and, further, other layers may also be provided.

Usually, the role of the outermost layer is to provide transportability or scratch resistance and prevent deposition of the image-forming layer. Accordingly, in the outermost layer, the binder, as well as additives such as a matting agent, lubricant, or surfactant are often added. In addition to the outermost layer, a surface protective layer may be provided as a single layer or plural layers. The surface protective layer is described in JP-A No. 11-65021, column Nos. 0119 to 0120, and JP-A No. 2000-171936.

Further, the intermediate layer is often provided as a boundary layer between the image-forming layer and the outermost layer and most of the portion of the layer is usually occupied with a binder. In addition, various kinds of additives can also be added to the intermediate layer.

Preferred layer constitution (preferred binder species) are shown below for the non-photosensitive intermediate layer B and the outermost layer with no particular restriction to them.

Hereinafter, the polymer formed by copolymerizing the monomer represented by the Formula (M) is referred to as "polymer of Formula (M)", the monomer represented by the hydrophilic polymer (not restricted to the polymer formed In the invention, a binder containing 50% by mass or more of the hydrophilic polymer-1 is provided on the side remote from the support than the non-photosensitive intermediate layer A.

Considering the coating performance for the outermost layer, the binder preferably contains 50% by mass or more of the hydrophilic polymer-1 such as gelatin and preferably contains a hydrophobic polymer considering the image storability in view of stickiness or fingerprints.

In the constitution for any of the layer constitutions 3, 4, and 6, the hydrophilic polymer-2 can also be used instead of the hydrophilic polymer-1 in the outermost layer.

In the non-photosensitive intermediate layer B, the binder preferably contains 50% by mass or more of the hydrophilic polymer considering the coating performance and it is preferably formed as a dual layer with a layer containing 50% by mass or more of a hydrophilic polymer-2 such as PVA in view of the suppression of cohesion due to contact between the gelatin containing layer and the hydrophobic polymer containing layer.

(i) In a case where the binder of the outermost layer does not contain 50% by mass or more of the hydrophilic polymer-1

In a case where the outermost layer does not contain 50% by mass or more of the hydrophilic polymer, the binder of the non-photosensitive intermediate layer B has to contain 50% by mass or more of the hydrophilic polymer-1 in order to obtain the effect of the invention. In this case, the binder of the outermost layer B may be a hydrophilic polymer or a hydrophobic polymer. In a case where the binder of the outermost layer contains the hydrophilic polymer, the hydrophilic polymer may be either the hydrophilic polymer-1 or the hydrophilic polymer-2. Considering the setting property, the binder of the outermost layer also preferably contains 50% by mass or more of the hydrophilic polymer-1 or a gelling agent is preferably added to the hydrophilic polymer-2. In a case of using the hydrophobic polymer for the outermost layer, since deposition of fingerprints or stickiness can be suppressed, such a layer constitution is also preferred. The polymers can be used in combination whether they are a hydrophilic polymer or hydrophobic polymer.

(ii) In a case where the binder of the outermost layer contains 50% by mass or more of the hydrophilic polymer-1

In a case where the binder of the outermost layer contains 50% by mass or more of the hydrophilic polymer-1, the binder of the non-photosensitive intermediate layer B is not particularly restricted but it is preferably a binder containing 50% by mass or more of the hydrophilic polymer-1 or a binder containing 50% by mass or more of the hydrophilic polymer-2. In the outermost layer, additives such as a matting agent or a surfactant are often added while considering the transportability and the scratch resistance, and the content of the binder is often restricted. Accordingly, in a case of using a binder containing 50% by mass or more of the hydrophilic polymer-1 for the outermost layer, it is also a preferred embodiment for improving the coating performance by further using a binder containing 50% by mass or more of the hydrophilic polymer-1 to the non-photosensitive intermediate layer B. More preferably, the non-photosensitive intermediate layer B is provided by two or more layers, the binder of the non-photosensitive intermediate layer B on the side near the non-photosensitive intermediate layer A contains 50% by mass or more of the hydrophilic polymer-2, and the binder of the non-photosensitive intermediate layer B near the outermost layer contains 50% by mass or more of the hydrophilic polymer-1. Cohesion due to contact between the gelatin layer and the hydrophobic layer can be suppressed by providing a non-photosensitive intermediate layer B containing 50% by mass or more of the hydrophilic polymer-2.

Usually, the photothermographic material is further provided with, as other non-photosensitive layers, an undercoat layer provided between the image-forming layer and the support, a back layer provided on the side opposite to the image-forming layer and a back surface protective layer on the side remote from the back layer than the support. Each of such layers may be, independently, a single layer or plural layers.

Further, layers that act as an optical filter may also be provided. The layers are usually provided as the outermost layer or the intermediate layer. An anti-halation layer is provided as an undercoat layer or a back layer to the photosensitive material.

The photothermographic material according to the invention may be a single face type having an image-forming layer only on one surface of a support, or a double face type having image-forming layers on both surfaces of a support. In a case of the double face type, so long as at least one of the surfaces has the layer constitution as described above, there is no particular restriction on the other surface.

As the constitution for a multi-color photosensitive photothermographic material, a combination of such two layers may be contained for each color, or all ingredients may also be contained in a single layer as described in U.S. Pat. No. 4,708,928. In a case of the multi-dye multi-color photosensitive photothermographic material, the emulsion layers are kept being distinguished from each other by the use of a functional or non-functional barrier layer between each of the photosensitive layers as described in U.S. Pat. No. 4,460,681.

2. Constituent Ingredient for Each Layer

The non-photosensitive intermediate layer A containing the polymer of the Formula (M) is to be described in detail. Then, description is to be made of a layer containing 50% by mass or more of the hydrophilic polymer-1 that can be used for the non-photosensitive intermediate layer B and the outermost layer (hereinafter referred to as "hydrophilic polymer-1 containing layer"), a layer containing the hydrophilic polymer-2 (hereinafter referred to as "hydrophilic polymer-2 containing layer") and a layer containing a hydrophilic polymer (hereinafter referred to as "hydrophobic polymer-containing layer"). The layers may be used as any of the outermost layer and the non-photosensitive intermediate layer B.

(1) Non-photosensitive Intermediate Layer A

In the invention, the binder of the non-photosensitive intermediate layer A contains 80% by mass or more of a polymer formed by copolymerizing a monomer represented by the Formula (M).

In the binder of the non-photosensitive intermediate layer A, the content of the polymer formed by copolymerizing the monomer represented by Formula (M) is 80% by mass or more, preferably, 85% by mass or more and 100% by mass or less and, more preferably, 90% by mass or more and 100% by mass or less. In a case where the copolymerization ratio of the monomer represented by Formula (M) is less than 80% by mass, the effect of improving the image storability is small.

$$CH_2{=}CR^{01}{-}CR^{02}{=}CH_2 \qquad \text{Formula (M)}$$

wherein $R^{01}$ and $R^{02}$ each represents a group selected from a hydrogen atom, alkyl group of from 1 to 6 carbon atoms, a halogen atom or a cyano group.

Preferred alkyl group for $R^{01}$ and $R^{02}$ is an alkyl group of from 1 to 4 carbon atoms and, more preferably, an alkyl group of from 1 to 2 carbon atoms. The halogen atom is preferably a fluorine atom, chlorine atom or bromine atom, with a chlorine atom being further preferred.

For $R^{01}$ and $R^{02}$, particularly preferably, both of them are hydrogen atoms, or one of them is a hydrogen atom and the other of them is a methyl group or a chlorine atom.

Specific examples of the monomer represented by Formula (M) in the invention include 1,3-butadiene, 2-ethyl-1,3-butadiene, 2-n-propyl-1,3-butadiene, 2,3-dimethyl-1,3-butadiene, 2-methyl-1,3-butadiene, 2-chlor-1,3-butadiene, 1-brom-1,3-butadiene, 2-fluor-1,3-butadiene, 2,3-dichlor-1,3-butadiene and 2-cyano-1,3-butadiene.

In the invention, other monomers that are copolymerizable with the monomer represented by Formula (M) are not limited particularly and those polymerizable by a usual radial polymerization or ion polymerization method can be used suitably.

Monomers that can be used preferably can be selected from the following monomer groups (a) to (j) independently and combined optionally.

Monomer Group (a) to (j)—

(a) conjugated dienes:

1,3-butadiene, 1,3-pentadiene, 1-phenyl-1,3-butadiene, 1-α-naphthyl-1,3-butadiene, 1-β-naphthyl-1,3-butadiene, 1-brom-1,3-butadiene, 1-chlor-1,3-butadiene, 1,1,2-trichlor-1,3-butadiene, cyclopentadiene, etc.

(b) Olefins:

ethylene, propylene, vinyl chloride, vinylidene chloride, 6-hydroxy-1-hexene, 4-pentenic acid, 8-nonenate methyl, vinyl sulfonic acid, trimethylvinyl silane, trimethoxyvinyl silane, 1,4-divinylcyclohexane, 1,2,5-trivinylcyclohexane, etc.

(c) α,β-unsaturated carbonic acids and salts thereof:

acrylic acid, methacrylic acid, itaconic acid, maleic acid, sodium acrylate, ammonium methacrylate, potassium itaconate, etc.

(d) α,β-unsaturated carboxylate esters:

alkyl acrylate (for example, methyl acrylate, ethyl acrylate, butyl acrylate, cyclohexyl acrylate, 2-ethylhexyl acrylate, dodecyl acrylate, etc), substituted alkyl acrylate (for example, 2-chloroethyl acrylate, benzyl acrylate, 2-cyanoethyl acrylate, etc.), alkylmethacrylate (for example, methyl methacrylate, butyl methacrylate, 2-ethylhexyl methacrylate, dodecyl methacrylate, etc.), substituted alkyl methacrylate (for example, 2-hydroxyethyl methacrylate, glycidyl methacrylate, glycerine monomethacrylate, 2-acetoxyethyl methacrylate, tetrahydro fulfuril methacrylate, 2-methoxyethyl methacrylate, polypropylene glycol monomethacrylate (polyoxypropylene addition mol number=2-100), 3-N-N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, aryl methacrylate, 2-isocyanateethyl methacrylate, etc.), derivative of unsaturated dicarbonic acids (for example, monobutyl malate, dimethyl malate, monomethyl itaconate, dibutyl itaconate, etc.), poly-function esters (for example, ethylene glycole diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, 1,2,4-cyclohexane tetramethacrylate, etc.

(e) amides of β-unsaturated carboxylic acids:

for example, acrylamide, methacrylamide, N-methylacrylamide, N,N-diemthylacrylamide, N-methyl-N-hydroxyethyl methacylamide, N-tert-butyl acrylamide, N-tert-octyl methacrylamide, N-cyclohexyl acrylamide, N-phenyl acrylamide, N-(2-acetoacetoxyethyl)acrylamide, N-acryloyl morpholine, diacetone acrylamide, diamide itaconate, N-methyl maleimide, 2-acrylamide-methylpropane sulfonic acid, methylenebis acrylamide, dimethacryloyl piperazine, etc.

(f) unsaturated nitriles:

acrylonitrile, methacrylonitrile, etc.

(g) styrene and derivatives thereof;

styrene, vinyl toluene, p-tert-butylstyrene, vinyl benzoate, methyl vinyl benzoate, α-methylstyrene, p-chloromethylstyrene, vinyl naphthalene, p-hyroxyemthylstyrene, sodium p-styrene sulfonate, potassium p-styrene sulfinate, p-aminomethylstyrene, 1,4-divinylbenzene, etc.

(h) vinyl ethers:

methyl vinyl ether, butyl vinyl ether, methoxyethyl vinyl ether, etc.

(i) vinyl esters:

vinyl acetate, vinyl propionate, vinyl benzoate, vinyl salycilate, vinyl chlorosuccinate, etc.

(j) other polymerizable monomer;

N-vinylimidazole, 4-vinylpyridine, N-vinylpyrrolidone, 2-vinyloxazoline, 2-isopropenyloxazoline, divinylsulfone, etc.

Copolymers with styrene, acrylic acid and/or acrylic acid ester are preferred. Further, it is preferably a copolymer having styrene and acrylic acid as monomer units since the thus formed hydrophobic polymer can be used as an aqueous dispersion of good dispersion stability. The copolymerization ratio between the monomer represented by Formula (M) and other monomer is not particularly limited and the monomer represented by Formula (M) is copolymerized, preferably, by 10% by mass or more and 70% by mass or less, more preferably, 15% by mass or more and 65% by mass or less and, further preferably, 20% by mass or more and 60% by mass or less.

Tg of the polymer formed by polymerizing the monomer represented by Formula (M) is within a range preferably from −30° C. or higher and 70° C. or lower. It is, more preferably, from −10° C. or higher and 35° C. or lower and, most preferably, 0° C. or higher and 35° C. or lower. In a case where Tg is lower than −30° C. while the film forming property is excellent, the film is sometimes poor in the heat resistance. In a case where it is higher than 70° C., while the heat resistance of the polymer is excellent, the film is sometimes insufficient for the film forming property. However, two or more kinds of polymers can be used and prepared to obtain such Tg. That is, even the polymer having the Tg out of the range described above, it is preferred that the weight average Tg thereof is within the range described above.

The polymer formed by copolymerizing the monomer represented by Formula (M) has an I/O value of, preferably, 0.025 or more and 0.3 or less. More preferably, it is 0.05 or more and 0.15 or less. The I/O value is a value obtained by dividing the inorganic group by the organic group based on the organic conceptional diagram. In a case where the I/O value is less than 0.025, affinity with an aqueous solvent is poor making it sometimes difficult to coat with an aqueous coating solution. In a case where it is higher than 0.3, the resultant film forms a hydrophilic film which has an effect on the photographic property relative to the humidity to sometimes worsen the photographic performance remarkably. The I/O value can be determined according to the method as described in "Organic Conceptional Diagram-Foundation and Application—" (written by Yoshio Koda, published from Sankyo Shuppan, 1984).

In the organic conceptional diagram, the properties of compounds are divided into organic groups representing the covalent bond and inorganic groups representing the ionic bond, and all the organic compounds are shown being positioned on every one point on an orthogonal coordinate referred to as an organic axis and an inorganic axis. The inorganic value based thereon is determined by the inorganic property, that is, the magnitude of the effect of various substituents on the boiling point based on the hydroxyl group, and determining the effect of a hydroxyl group as a numerical value of 100 since the distance between the boiling point curve of a linear alcohol and a linear paraffin is about 100° C. when taken at the vicinity of the number of carbon atoms or 5. On the other hand, the organic value is determined assuming that the magnitude of the numerical values for the organic property can be determined using the methylene group in the molecule as a unit and can be measured according to the number of carbon atoms representing the methylene group, the numerical values for one carbon atom as the base is a value by taking the average value 20° C. for the increase of the boiling point by the addition of the one carbon atom near the number of carbon atoms of 5 to 10 of a linear compound and determined as 20 based thereon. The inorganic property values and the organic property values are determined so as to form 1:1 correspondence on the graph. The I/O values are calculated from the values described above.

In the invention, the polymer formed by copolymerizing the monomer represented by Formula (M) is preferably contained as an aqueous dispersion in a coating solution. While the aqueous dispersion may be either latexes in which fine particles of a water insoluble hydrophobic polymer are dispersed in an aqueous solvent or those in which polymer molecule is dispersed in a molecular state or forming micell, latex-dispersed particles are more preferred.

The average grain size of the dispersed particles is within a range from 1 nm or more and 50000 nm or less, and, preferably, from 5 nm or more and 1000 nm or less and, more preferably, in a range from 10 nm or more and 500 nm or less and, further preferably, within a range from 50 nm or more and 200 nm or less. There is no particular restriction on the grain size distribution of the dispersed particles and may be either those having a wide grain size dispersion or those having a single dispersion grain size distribution. Use of two or more kinds of particles each having a mono dispersion grain size distribution in admixture is also a preferred method of use in view of control for the physical property of the coating solution.

1) Preferred Latex

As the polymer latex used in the invention, a latex of a styrene-butadiene copolymer or a styren-isoprene copolymer is particularly preferred. The weight ratio between the styrene monomer unit and the butadiene or isoprene monomer unit in the styrene-butadiene copolymer or the styren-isoprene copolymer is, preferably, 40:60 to 95:5.

Further, the polymer latex in the invention contains acrylic acid or methacrylic acid, preferably, by 1% by mass or more and 6% by mass or less and, more preferably, 2% by mass or more and 5% by mass or less based on the sum of styrene and butadiene. The polymer latex in the invention preferably contains acrylic acid. A preferred range for the molecular weight is identical with that described above.

2) Specific Example of Latex

Specific examples of the preferred polymer latex are shown below. It is to be expressed by using starting monomers and numerical values in parentheses mean % by mass and the molecular weight is a number average molecular weight. In a case of using the polyfunctional monomer, since it forms a crosslinking structure and the concept of the molecular weight can not be applied, it is described as "crosslinking" with description for the molecular weight being omitted. Tg represents a glass transition temperature P-1: -St(62)-Bu(35)-MAA(3) latex (crosslinking, Tg 5° C.)

P-2: -St(68)-Bu(29)-AA(3) latex (crosslinking, Tg 17° C.)

P-3: -St(71)-Bu(26)-AA(3) latex (crosslinking, Tg 24° C.)

P-4: -St(70)-Bu(27)-IA(3) latex (crosslinking, Tg 23° C.),

P-5: -St(75)-Bu(24)-AA(1) latex (crosslinking, Tg 29° C.).

P-6: -St(60)-Bu(35)-DVB(3)-MAA(2) latex (crosslinking, Tg 6° C.),

P-7: -St(70)-Bu(25)-DVB(2)-AA (3) latex (crosslinking, Tg 26° C.),

P-8: -St(70.5)-Bu(26.5)-AA (3) latex (crosslinking, Tg 23° C.),

P-9: -St(69.5)-Bu(27.5)-AA (3) latex (crosslinking, Tg 20.5° C.),

P-10: -St(61.3)-isoprene(35.5)-AA (3) latex (crosslinking, Tg 17° C.),

P-11: -St(67)isoprene(28)-Bu(2)-AA (3) latex (crosslinking, Tg 27° C.)

The abbreviations for the structure represent the following monomers. MAA: methacrylic acid, St; styrene, Bu; butadiene, AA; acrylic acid, DVB; divinyl benzene, IA; itaconic acid.

The latex of the styrene-butadiene copolymer preferably used in the invention can include, for example, P-1 to P-9 described above, and LACSTAR-3307B, 7132C (manufactured by Dai Nippon Ink Chemical Industry Co.) and Nipol Lx416 (manufactured by Nippon Zeon Co.) as commercial products.

The latex of the styrene-butadiene copolymer includes the P-10, P-11, etc. described above.

The polymer latexes described above may be used alone or two or more of them may be blended as required. Polymers other than these can be used together.

The polymer that can be used together may be a hydrophobic polymer or a hydrophilic polymer.

The hydrophilic polymer that can be used together includes, for example, gelatin, polyvinyl alcohol, methyl cellulose, hydroxypropyl cellulose, carboxymethyl cellulose and sodium polyacrylate. The addition amount of the hydrophilic polymer is, preferably, 30% by mass or less and, more preferably, 10% by mass or less for the entire binder of the non-photosensitive intermediate layer.

The hydrophobic polymer that can be used together, can include, for example, polyacrylate, polyurethane, polymethacrylate, or the same copolymer containing the same (latex) that can be used for the hydrophobic polymer layer to be described later. The addition amount of the hydrophobic polymer is, preferably, 30% by mass or less and, more preferably, 10% by mass or less based on the entire binder of the non-photosensitive intermediate layer.

3) Film Forming Aid

For controlling the lowest film forming temperature of aqueous dispersion of hydrophobic polymer, a film forming aid may also be added. The film forming aid is also referred to as a temporary plasticizer which is an organic compound for lowering the lowest film forming temperature of the polymer latex (usually organic solvent) and described, for example, in "Chemistry of Synthetic Latex (written by Soichi Muroi, Published from High Molecule Publishing Society (1970))". Preferred film forming aids include the following compounds but the compounds usable in the invention are not restricted to the following specific examples.

Z-1: benzyl alcohol,

Z-2: 2,2,2,4-trimethylpantanediol-1,3-monoisobutyrate.

Z-3: 2-dimethylamono ethanol,

Z-4: diethylene glycol

4) Addition Amount

The content of the polymer formed by copolymerizing the monomer represented by Formula (M) is, preferably, 5% by mass or more and 50% by mass or less and, more preferably, 10% by mass or more and 40% by mass or less based on the entire non-photosensitive intermediate layer A coating solution.

5) Coating Amount

The coating amount of the polymer formed by polymerizing the monomer represented by Formula (M) of the non-photosensitive intermediate layer A is, preferably, from 0.1 $g/m^2$ or more and 10 $g/m^2$ or less, more preferably, from 0.3 $g/m^2$ or more and 7 $g/m^2$ or less and, most preferably, 0.5 $g/m^2$ or more and 5 $g/m^2$ or less.

6) Crosslinking Agent

In the present invention, the crosslinking agent is preferably contained in any of the layers of the image-forming layer surface. In a more preferred case, it is added to the hydrophilic polymer-1 containing layer or the hydrophilic polymer-2 containing layer such as a non-photosensitive intermediate layer B. By the addition of the crosslinking agent, the hydrophobic property and the water proofness of the non-photosensitive intermediate layer are improved to provide an excellent photothermographic material.

The crosslinking agent may suffice to contain plural groups capable of reacting amino group or carboxyl group in the molecule and the kind of the crosslinking agent is not particularly limited. Examples of the crosslinking agent are described in "THE THEORY OF THE PHOTOGRAPHIC PROCESS FOURTH EDITION" written by T. H. James (published from Macmillan Publishing Co., Inc. in 1977), pages 77 to 87. While both crosslinking agents of inorganic compounds (for example, chromium alum) and crosslinking agents organic compounds are preferred, crosslinking agents of organic compounds are more preferred.

The crosslinking agent for the hydrophobic polymer containing layer such as the non-photosensitive intermediate layer A of the invention may suffice to contain plural groups capable of reacting with the carboxyl group in the molecule and the kind of the crosslinking agent is not particularly limited.

Preferred compounds as the crosslinking agent of the organic compounds can include carboxylic acid derivatives, carbamic acid derivatives, sulfonic acid ester compound, sulfonyl compounds, epoxy compounds, azilidine compound, isocyanate compound, carbodiimide compounds, and oxazoline compounds. More preferred are epoxy compounds, isocyanate compounds, carbodiimide compounds and oxazoline compounds. The crosslinking agents may be used alone or two or more kinds of them may be used together.

Specific examples of the crosslinking agents described above can also include the following compounds but the invention is not restricted to the following examples.

(Carbodiimide Compound)

Water soluble or water dispersible carbodiimide compounds are preferred. They include, for example, polycarbodiimide derived from isopholone diisocyanate described in JP-A No. 59-187029 and JP-B No. 5-27450, carbodiimide compounds derived from tetramethyl xylylene diisocyanate described in JP-A No. 7-330849, multi-branched carbodiimide compounds described in JP-A No. 10-30024, and carbodiimide compounds derived from dicyclohexyl methane diisocyante described in JP-A No. 2000-7642.

(Oxazoline Compound)

Water soluble or water dispersible oxazoline compounds are preferred. They can include, for example, oxazoline compounds described in JP-A No. 2001-215653.

(Isocyanate Compound)

Since this is a compound capable of reacting with water, water dispersible isocyanate compounds are preferred in view of the pot life and, particularly, those having self emulsifying property are preferred. They can include, for example, water dispersible isocyanate compounds described in JP-A Nos. 7-304841, 8-277315, 10-45866, 9-71720, 9-328654, 9-104814, 2000-194045, 2000-194237 and 2003-64149.

(Epoxy Compound)

Water soluble or water dispersible epoxy compounds are preferred. They can include, for example, water dispersible epoxy compound described in JP-A Nos. 6-329877 and 7-309954.

More specific examples of the crosslinking agent that can be used in the present invention are shown below but the invention is not restricted to the following examples.

(Epoxy Compound)

Trade name: DICKFINE EM-60 (Dai-Nippon Ink Chemical Industry Co.)

(Isocyanatea Compound}

Trade name: DURANATE WB 40-100 (Asahi Kasei Co.)
DURANATE WB 40-80D (Asahi Kasei Co.)
DURANATE WT 20-100 (Asahi Kasei Co.)
DURANATE WT 30-100 (Asahi Kasei Co.)
CR-60N (Dai-Nippon Ink Chemical Industry Co.)

(Carbodiimide Compound)

Trade name: CARBODILITE V-02 (Nissinbo Co.)
CARBODILITE V-02-L21 (Nissinbo Co.)
CARBODILITE V-04 (Nissinbo Co.)
CARBODILITE V-06 (Nissinbo Co.)
CARBODILITE E-01 (Nissinbo Co.)
CARBODIRIGHT E-02 (Nissinbo Co.)

(Oxazoline Compound)

Trade name: EPOCROS K-1010E (Nippon Shokubai Co.)
EPOCROS K-1020E (Nippon Shokubai Co.)
EPOCROS K-1030E (Nippon Shokubai Co.)
EPOCROS K-2010E (Nippon Shokubai Co.)
EPOCROS K-2020E (Nippon Shokubai Co.)
EPOCROS K-2030E (Nippon Shokubai Co.)
EPOCROS WS-500 (Nippon Shokubai Co.)
EPOCROS WS-700 (Nippon Shokubai Co.)

The crosslinking agent used in the invention may be added in a state previously mixed with the binder solution, or may be added at the end of the preparation step of the coating solution, or may be added just before coating.

The amount of the crosslinking agent used in the invention is, preferably, from 0.5 to 200 mass parts, more preferably, from 2 to 100 mass parts and, further preferably, from 3 to 50 mass parts based on 100 mass parts of the binder in the constitution layer contained.

7) Viscosity Enhancer

To the coating solution for forming the non-photosensitive intermediate layer A, a viscosity enhancer is preferably added. Addition of the viscosity enhancer is preferred since a hydrophobic layer of uniform thickness can be formed. As the viscosity enhancer, for example, an alkali metal salt of polyvinyl alcohol, hydroxyethyl cellulose and carboxymethyl cellulose are used, and those having the thixotropic property are preferred in view of easy handling and, for this purpose, hydroxyethyl celulose, sodium hydroxymethyl carboxylate and hydroxymethyl hydroxyethyl cellulose are used.

Further, the viscosity of the non-photosensitive intermediate layer A coating solution with addition of the viscosity enhancer at 40° C. is, preferably, from 1 mPa·s or more and 200 mPa·s or less, more preferably, 10 mPa·s or more and 100 mPa·s or less and, further preferably, 15 mPa·s or more and 60 mPa·s or less.

For the non-photosensitive intermediate layer A, various additives can be added in addition to the binder. The additives can include, for example, a surfactant, pH controller, corrosion inhibitor or anti-mole agent.

(2) Hydrophilic Polymer-1 Containing Layer

The hydrophilic polymer-1 containing layer in the invention is a layer containing 50% by mass or more of the hydrophilic polymer-1 (hydrophilic polymer derived from animal protein). In both of the cases where the hydrophilic polymer-1 containing layer is in the outermost layer or in the non-photosensitive intermediate layer B, the content of the polymer-1 is, preferably, 50% by mass or more and 100% by mass or less and, more preferably, 60% by mass or more and 100% by mass or less. In a case where the content of the hydrophilic polymer derived from the animal protein (polymer-1) is less than 50% by mass, setting property during coating and drying is deteriorated tending to cause unevenness on the finished surface, which is not preferred.

In the invention, the hydrophilic polymer-1 (hydrophilic polymer derived from animal protein) means natural or chemically modified water soluble polymer such as of glue, casein, gelatin or albumen.

It is, preferably, gelatin. Depending on the synthesis method, acid-treated gelatin or alkali-treated gelatin (lime treatment, etc.) are mentioned, both of which can be used preferably. As the molecular weight, gelatin having molecular weight from 10,000 to 1,000,000 is preferably used. Further, modified gelatin applied with modifying treatment by utilizing the amino group or carboxy group of the gelatin can also be used (for example, phthalized gelatin). As the gelatin, inert gelatin (for example, Nitta Gelatin 750), phthalized gelatin (for example, Nitta Gelatin 801), etc. can be used.

The aqueous gelatin solution is soled when heated to a temperature of 30° C. or higher and when it is lowered to less than that described above, it is gelled to loss fluidity. Since such sol-gel change occurs reversibly depending on the temperature, the aqueous gelatin solution as the coating solution has a setting property of loosing the fluidity when cooled to a temperature lower than 30° C.

Further, the hydrophilic polymer-1 can be used together with the following hydrophilic polymer-2 (hydrophilic polymer not derived from animal protein) and/or hydrophobic polymer. In a case where the hydrophilic polymer-1 containing layer is at the outermost layer, a hydrophobic polymer is preferably used together as the binder. A preferred mixing ratio of hydrophilic polymer-1:hydrophobic polymer to be used together in this case is, preferably, from 50:50 to 99:1 and, more preferably, 50:50 to 80:20.

The content of the hydrophilic polymer-1 in the coating solution is from 1% by mass or more and 20% by mass or less and, preferably, from 2% by mass or more and 12% by mass or less based on the entire coating solution, both for the outermost layer and the non-photosensitive intermediate layer B.

In the hydrophilic polymer-1 containing layer, the crosslinking agent is added preferably. Preferred crosslinking agent is identical with those described for the explanation of the non-photosensitive intermediate layer A.

Further, to the hydrophilic polymer-1 containing layer, a surfactant, pH controller, corrosion inhibitor, anti-molding agent, dye, pigment and color toning agent, etc, can be added.

(3) Hydrophilic Polymer-2 Containing Layer

The hydrophilic polymer-2 containing layer in the invention is a layer containing 50% by mass or more of the hydrophilic polymer-2 (hydrophilic polymer not derived from animal protein). The content of the hydrophilic polymer-2 is, preferably, from 50% by mass or more and 100% by mass or less, more preferably, 60% by mass or more and 100% by mass or less based on the entire binder of the hydrophilic polymer-2 containing layer both in a case where the hydrophilic polymer-2 containing layer is the outermost layer and in a case where it is the non-photosensitive intermediate layer B. In the case where the hydrophilic polymer-2 containing layer is provided between the gelatin containing layer and the non-photosensitive intermediate layer A, when the content of the hydrophilic polymer not derived from the animal protein is less than 50% by mass, the effect of preventing cohesion is decreased.

The hydrophilic polymer not derived from the animal protein in the invention includes natural polymers other than those of animal protein (polysaccharides, mircoorganism type, animal type) such as gelatin, semi-sensitized polymer (cellulose type, starch type, alginic acid type) and synthesized polymer (vinyl type or the like) which correspond to synthesis polymers including polyvinyl alcohols or natural or semi-synthetic polymers starting from vegetable-derived cellulose to be describe later. They are preferably polyvinyl alcohol, acrylic acid-vinyl alcohol copolymers.

While the hydrophilic polymer not derived from animal protein has no setting property, it has setting property when used together with a gelling agent to make the coating performance favorable.

1) Polyvinyl Alcohols

As the hydrophilic polymer not derived from animal protein in the invention, polyvinyl alcohols are preferred.

Polyvinyl alcohols (PVA) used preferably in the invention can include those of various saponification degree, polymerization degree, neutralization degree and modification products, as well as copolymers with various monomers as set forth below.

As fully saponified compound, it can be selected among PVA-105 [polyvinyl alcohol (PVA) content: 94.0% by mass or more, degree of saponification: 98.5±0.5% by mole, content of sodium acetate: 1.5% by mass or less, volatile constituent: 5.0% by mass or less, viscosity (4% by mass at 20° C.): 5.6±0.4 CPS], PVA-110 [PVA content: 94.0% by mass, degree of saponification: 98.5±0.5% by mole, content of sodium acetate: 1.5% by mass, volatile constituent: 5.0% by mass, viscosity (4% by mass at 20° C.): 11.0±0.8 CPS], PVA-117 [PVA content: 94.0% by mass, degree of saponification: 98.5±0.5% by mole, content of sodium acetate: 1.0% by mass, volatile constituent: 5.0% by mass, viscosity (4% by mass at 20° C.): 28.0±3.0 CPS], PVA-117H [PVA content: 93.5% by mass, degree of saponification: 99.6±0.3% by mole, content of sodium acetate: 1.85% by mass, volatile constituent: 5.0% by mass, viscosity (4% by mass at 20° C.): 29.0±0.3 CPS], PVA-120 [PVA content: 94.0% by mass, degree of saponification: 98.5±0.5% by mole, content of sodium acetate: 1.0% by mass, volatile constituent: 5.0% by mass, viscosity (4% by mass at 20° C.): 39.5±4.5 CPS], PVA-124 [PVA content: 94.0% by mass, degree of saponification: 98.5±0.5% by mole, content of sodium acetate: 1.0% by mass, volatile constituent: 5.0% by mass, viscosity (4% by mass at 20° C.): 60.0±6.0 CPS], PVA-124H [PVA content: 93.5% by mass, degree of saponification: 99.6±0.3% by mole, content of sodium acetate: 1.85% by mass, volatile constituent: 5.0% by mass, viscosity (4% by mass at 20° C.): 61.0±6.0 CPS], PVA-CS [PVA content: 94.0% by mass, degree of saponification: 97.5±0.5% by mole, content of sodium acetate: 1.0% by mass, volatile constituent: 5.0% by mass, viscosity (4% by mass at 20° C.): 27.5±3.0 CPS], PVA-CST [PVA content: 94.0% by mass, degree of saponification: 96.0±0.5% by mole, content of sodium acetate: 1.0% by mass, volatile constituent: 5.0% by mass, viscosity (4% by mass at 20° C.): 27.0±3.0 CPS], PVA-HC [PVA content: 90.0% by mass, degree of saponification: 99.85% by mole or more, content of sodium acetate: 2.5% by mass, volatile constituent: 8.5% by mass, viscosity (4% by mass at 20° C.): 25.0±3.5 CPS] (above all trade names, produced by Kuraray Co., Ltd.), and the like.

As partial saponified compound, it can be selected among PVA-203 [PVA content: 94.0% by mass, degree of saponification: 88.0±1.5% by mole, content of sodium acetate: 1.0% by mass, volatile constituent: 5.0% by mass, viscosity (4% by mass at 20° C.): 3.4±0.2 CPS], PVA-204[PVA content: 94.0% by mass, degree of saponification: 88.0±1.5% by mole, content of sodium acetate: 1.0% by mass, volatile constituent: 5.0% by mass, viscosity (4% by mass at 20° C.): 3.9±0.3 CPS], PVA-205 [PVA content: 94.0% by mass, degree of saponification: 88.0±1.5% by mole, content of sodium acetate: 1.0% by mass, volatile substance: 5.0% by mass, viscosity (4% by mass at 20° C.): 5.0±0.4 CPS], PVA-210 [PVA content: 94.0% by mass, degree of saponification: 88.0±1.0% by mole, content of sodium acetate: 1.0% by mass, volatile constituent: 5.0% by mass, viscosity (4% by mass at 20° C.): 9.0±1.0 CPS], PVA-217 [PVA content: 94.0% by mass, degree of saponification: 88.0±1.0% by mole, content of sodium acetate: 1.0% by mass, volatile constituent: 5.0% by mass, viscosity (4% by mass at 20° C.): 22.5±2.0 CPS], PVA-220 [PVA content: 94.0% by mass, degree of saponification: 88.0±1.0% by mole, content of sodium acetate: 1.0% by mass, volatile constituent: 5.0% by mass, viscosity (4% by mass at 20° C.): 30.0±3.0 CPS], PVA-224 [PVA content: 94.0% by mass, degree of saponification: 88.0±1.5% by mole, content of sodium acetate: 1.0% by mass, volatile constituent: 5.0% by mass, viscosity (4% by mass at 20° C.): 44.0±4.0 CPS], PVA-228 [PVA content: 94.0% by mass, degree of saponification: 88.0±1.5% by mole, content of sodium acetate: 1.0% by mass, volatile constituent: 5.0% by mass, viscosity (4% by mass at 20° C.): 65.0±5.0 CPS], PVA-235 [PVA content: 94.0% by mass, degree of saponification: 88.0±1.5% by mole, content of sodium acetate: 1.0% by mass, volatile constituent: 5.0% by mass, viscosity (4% by mass at 20° C.): 95.0±15.0 CPS], PVA-217EE [PVA content: 94.0% by mass, degree of saponification: 88.0±1.0% by mole, content of sodium acetate: 1.0% by mass, volatile constituent: 5.0% by mass, viscosity (4% by mass at 20° C.): 23.0±3.0 CPS], PVA-217E [PVA content: 94.0% by mass, degree of saponification: 88.0±1.0% by mole, content of sodium acetate: 1.0% by mass, volatile constituent: 5.0% by mass, viscosity (4% by mass at 20° C.): 23.0±3.0 CPS], PVA-220E [PVA content: 94.0% by mass, degree of saponification: 88.0±1.0% by mole, content of sodium acetate: 1.0% by mass, volatile constituent: 5.0% by mass, viscosity (4% by mass at 20° C.): 31.0±4.0 CPS], PVA-224E [PVA content: 94.0% by mass, degree of saponification: 88.0±1.0% by mole, content of sodium acetate: 1.0% by mass, volatile constituent: 5.0% by mass, viscosity (4% by mass at 20° C.): 45.0±5.0 CPS], PVA-403 [PVA content: 94.0% by mass, degree of saponification: 80.0±1.5% by mole, content of sodium acetate: 1.0% by mass, volatile constituent: 5.0% by mass, viscosity (4% by mass at 20° C.): 3.1±0.3 CPS], PVA-405 [PVA content: 94.0% by mass, degree of saponification: 81.5±1.5% by mole, content of sodium acetate: 1.0% by mass, volatile constituent: 5.0% by mass, viscosity (4% by mass at 20° C.): 4.8±0.4 CPS], PVA-420 [PVA content: 94.0% by mass, degree of saponification: 79.5±1.5% by mole, content of sodium acetate: 1.0% by mass, volatile constituent: 5.0% by mass], PVA-613 [PVA content: 94.0% by mass, degree of saponification: 93.5±1.0% by mole, content of sodium acetate: 1.0% by mass, volatile constituent: 5.0% by mass, viscosity (4% by mass at 20° C.): 16.5±2.0 CPS], L-8 [PVA content: 96.0% by mass, degree of saponification: 71.0±1.5% by mole, content of sodium acetate: 1.0% by mass (ash), volatile constituent: 3.0% by mass, viscosity (4% by mass at 20° C.): 5.4±0.4 CPS] (above all are trade names, produced by Kuraray Co., Ltd.), and the like.

The above values were measured in the manner described in JISK-6726-1977.

As modified polyvinyl alcohol, it can be selected among cationic modified compound, anionic modified compound, modified compound by —SH compound, modified compound by alkylthio compound and modified compound by silanol. Further the modified polyvinyl alcohol described in "POVAL" (Koichi Nagano et. al., edited by Koubunshi Kankoukai) can be used.

As this modified polyvinyl alcohol (modified PVA), there are C-118, C-318, C-318-2A, C-506 (above all are trade names, produced by Kuraray Co., Ltd.) as C-polymer, HL-12E, HL-1203 (above all are trade name, produced by Kuraray Co., Ltd.) as HL-polymer, HM-03, HM-N-03 (above all are trade marks, produced by Kuraray Co., Ltd.) as HM-polymer, M-115 (trade mark, produced by Kuraray Co., Ltd.) as M-polymer, MP-102, MP-202, MP-203 (above all are trade mark, produced by Kuraray Co., Ltd.) as MP-polymer, MPK-1, MPK-2, MPK-3, MPK-4, MPK-5, MPK-6 (above all are trade marks, produced by Kuraray Co., Ltd.) as MPK-polymer, R-1130, R-2105, R-2130 (above all are trade marks, produced by Kuraray Co., Ltd.) as R-polymer, V-2250 (trade mark, produced by Kuraray Co., Ltd.) as V-polymer and the like.

Viscosity of aqueous solution of polyvinyl alcohol can be controlled or stabilized by addition of small amount of solvent or inorganic salts, which are described in detail in above literature "POVAL" (Koichi Nagano et. al., edited by Koubunshi Kankoukai, pages 144 to 154). The typical example preferably is to incorporate boric acid to improve the surface quality of coating. The addition amount of boric acid preferably is from 0.01% by mass to 40% by mass with respect to polyvinyl alcohol.

It is also described in above-mentioned "POVAL" that the crystallization degree of polyvinyl alcohol is improved and waterproof property is improved by heat treatment. The binder can be heated at coating-drying process or can be additionally subjected to heat treatment after drying, and therefore, polyvinyl alcohol, which can be improved in waterproof property during those processes, is particularly preferable among water-soluble polymers.

Furthermore, it is preferred that a waterproof improving agent such as those described in above "POVAL" (pages 256 to 261) is added. As examples, there can be mentioned aldehydes, methylol compounds (e.g., N-methylolurea, N-methylolmelamine and the like), active vinyl compounds (divinylsulfones and their derivatives and the like), bis(β-hydroxyethylsulfones), epoxy compounds (epichlorohydrins and their derivatives and the like), polyvalent carboxylic acids (dicarboxylic acids, polyacrylic acid as polycarboxylic acids, methyl vinyl ether/maleic acid copolymers, isobutylene/maleic anhydride copolymers and the like), diisocyanates, and inorganic crosslinking agents (Cu, B, Al, Ti, Zr, Sn, V, Cr and the like).

In the present invention, inorganic crosslinking agents are preferable as a waterproof improving agent. Among these inorganic crosslinking agents, boric acids and their derivative are preferred and boric acid is particularly preferable. Specific examples of boric acid derivatives are shown below.

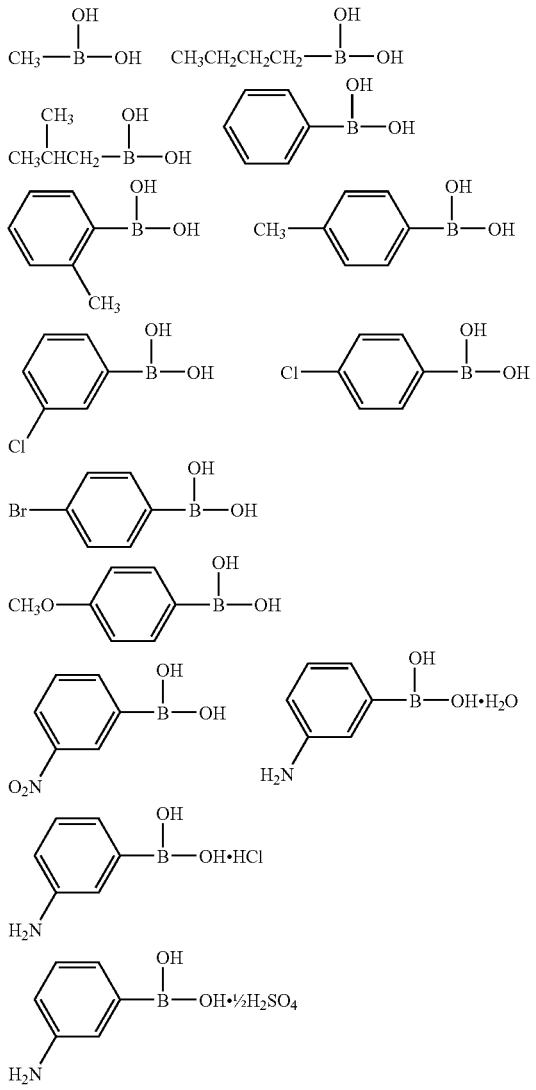

The addition amounts of these waterproof improving agents are preferably in the range from 0.01% by mass to 40% by mass with respect to polyvinyl alcohol.

2) Hydrophilic Polymer-2 Other Than PVAs

The hydrophilic polymer-2 in the invention can include, the followings in addition to the polyvinyl alcohols.

As typical examples, plant polysaccharides, such as gum arabic, κ-carrageenan, τ-carrageenan, λ-carrageenan, guar gum (Supercol produced by SQUALON Co. and the like), locust bean gum, pectin, tragacanth gum, corn starch (Purity-21 produced by National Starch & Chemical Co. and the like), starch phosphate (National 78-1898 produced by National Starch & Chemical Co. and the like) are included.

Also as polysaccharides derived from microorganism, xanthan gum (Keltrol T produced by KELCO Co. and the like), dextrin (Nadex 360 produced by National Starch & Chemical Co. and the like) and as animal polysaccharides, sodium chondroitin sulfate (Cromoist CS produced by CRODA Co. and the like) and the like are included.

And as cellulose polymer, ethyl cellulose (Cellofas WLD produced by I.C.I. Co. and the like), carboxymethyl cellulose (CMC produced by Daicel Chemical Industries, Ltd. and the like), hydroxyethyl cellulose (HEC produced by Daicel Chemical Industries, Ltd. and the like), hydroxypropyl cellulose (Klucel produced by AQUQLON Co. and the like), methyl cellulose (Viscontran produced by HENKEL Co. and the like), nitrocellulose (Isopropyl Wet produced by HELCLES Co. and the like) and cationized cellulose (Crodacel QM produced by CRODA Co. and the like) are included. As alginic acid series, sodium alginate, (Keltone produced by KELCO Co. and the like), propylene glycol alginate and the like and as other classification, cationized guar gum (Hi-care 1000 produced by ALCOLAC Co. and the like) and sodium hyaluronate (Hyalure produced by Lifecare Biomedial Co. and the like) are included.

As others, agar, furcelleran, guar gum, karaya gum, larch gum, guar seed gum, psylium seed gum, kino's seed gum, tamarind gum, tara gum and the like are included. Among them, highly water-soluble compound is preferable and the compound in which can solution sol-gel conversion can occur within 24 hours at a temperature change in the range of 5° C. to 95° C. is preferably used.

As for synthetic polymers, sodium polyacrylate, polyacrylic acid copolymers, polyacrylamide, polyacrylamide copolymers and the like as acryl series, polyvinyl pyrrolidone, polyvinyl pyrrolidone copolymers and the like as vinyl series and polyethylene glycols, polypropylene glycols, polyvinyl ethers, polyethylene imines, polystyrene sulfonic acid and its copolymers, polyacrylic acid and its copolymer, polyvinyl sulfanic acid and its copolymers, maleic acid copolymers, maleic acid monoester copolymers, acryloylmethylpropane sulfonic acid and its copolymers, and the like are included.

Highly water absorbable polymers described in U.S. Pat. No. 4,960,681, JP-A No. 62-245260 and the like, namely such as homopolymers of vinyl monomer having —COOM or —$SO_3M$ (M represents a hydrogen atom or an alkali metal) or copolymers of their vinyl monomers or other vinyl monomers (e.g., sodium methacrylate, ammonium methacrylate and Sumikagel L-5H produced by SUMITOMO KAGAKU Co.) can be also used.

Among these, Sumikagel L-5H produced by SUMITOMO KAGAKU Co.) is preferably used as the water-soluble polymer.

3) Coating Amount of Hydrophilic Polymer-2

The hydrophilic polymer-2 is preferably from 0.1 g/$m^2$ or more and 10 g/$m^2$ or less and, more preferably, 0.3 g/$m^2$ or more and 3 g/$m^2$ or less as the coating amount (per 1 $m^2$ of support).

The concentration in the coating solution is preferably controlled such that the viscosity at the time of addition become a value suitable to the simultaneous stack coating but is not particularly limited. Generally, the concentration in the solution is 5% by mass or more and 20% by mass or less, more preferably, 7% by mass or more and 15% by mass or less, particularly preferably, 8% by mass or more and 13% by mass or less.

4) Polymer That Can be Used Together

A polymer dispersible in an aqueous solvent may also be used together with the hydrophilic polymer-2 in the invention.

A preferred polymer dispersible in the aqueous solution can include synthetic resins, polymers, copolymers and other film forming media, for example, cellulose acetates, cellulose acetate butylates, poly(methylmethacrylates), poly (vinyl chlorides), poly(methacrylic acids), styrene-maleic acid anhydride copolymers, styrene-acrylonitrile copolymers, styrene-butadiene copolymers, poly(vinyl acetals), (for example, poly(vinyl formal), and poly(vinyl butyral)), poly(esters), poly(urethanes), phenoxy resins, poly(vinylidene chlorides), poly(epoxides), poly(carbonates), poly (vinyl acetates), poly(olefins), cellulose esters and poly (amides).

Preferred latex that can be used together are, for example, latexes usable for the non-photosensitive intermediate layer A of the invention, latexes of polyacrylates, polyurethanes, polymethacrylates or latexes of copolymer containing them.

Specific examples of preferred latexes that can be used together with the hydrophilic polymer-2 are mentioned.

LP-1: -MAA(70)-EA(27)-MAA(3)-latex (molecular weight 37000, Tg 61° C.)

LP-2: Latex of -MAA(70)-2EHA(20)-St(5)-AA(5)-(molecular weight 40000, Tg 59° C.)

LP-3: Latex of -VC(50)-MMA(20)-EA(20)-AN(5)-AA(5)-(molecular weight 80000)

LP-4: Latex of -VDC(85)-MAA(5)-EA(5)-MAA(5)-(molecular weight 67000)

LP-5: Latex of -Et(90)-MAA(10)-(molecular weight 12000)

LP-6: Latex of -MMA(42)-BA(56)-AA(2)-(molecular weight 540000, Tg—4° C.)

LP-7: Latex of -MMA(63)-EA(35)-AA(2)-(molecular weight 33000, Tg 47° C.)

LP-8: Latex of -St(70.5)-Bu(26.5)-AA(3)-(crosslinking, Tg 23° C.)

LP-9: Latex of -St(69.5)-Bu(27.5)-AA(3)-(crosslinking, Tg 20.5° C.)

LP-10: Latex of -St(70)-2EHA(27)-AA(3)-(molecular weight 130000, Tg 43° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

In addition, as examples of preferred water soluble polymers or polymer latexes that can be used in the invention, aqueous resins of various commercial products can be used. The aqueous resins of commercial products includes specifically, for example, water dispersible or water soluble resins such as "ACRYSET" (trade name of products manufactured by Kabushiki Kaisha Nippon Shokubai), "AORON" (trade name of products manufactured by Kabushiki Kaisha Nippon Shokubai), aqueous polyurethanes such as "HYDRAN" (trade name of products manufactured by Dai-Nippon Ink Chemical Industry Co.), "BONDIC" (trade name of products manufactured by Dai-Nippon Ink Chemical Industry Co.), "POISE" (trade name of products manufactured by Kao Corp.), "SUPERFLEX" (trade name of products manufactured by Daiichi Kogyo Seiyaku Co.) and "NEOREZ" (trade name of products manufactured by Zeneka Co.); aqueous polyesters such as "BIRONAL" (trade name of products manufactured by Toyobo Co.) and "FINETEX" (trade name of products manufactured by Dai-Nippon Ink Chemical Industry Co.), water dispersible, water diluted or water soluble alkyd resins such as "HOLSE" (trade name of products manufactured by Kansai Paint Co.), water dispersible, water diluted or water soluble polyolefinic resins such as "ISOBAN" (trade name of products manufactured by Kuraray Isoprene Chemical Co.), "PREMACOLE" (trade name of products manufactured by Dow Chemical Co.), and "HIGHTEC" (trade name of products manufactured by Toho Chemical Industry Co.), water dispersible epoxy resins such as "EPICRON" (trade name of products manufactured by Dai Nippon Ink Chemical Industry Co.); vinyl chloride emulsions, water dispersible or water soluble acrylic resins such as "JURYMER", "JUNLON", "RHEOGIC", "ARONVIS" (trade name of products manufactured by Nippon Junyaku Co.), with no particular restriction to them.

Specific examples can include water dispersible or water soluble acrylic resins such as ACRYSET 19E, ACRYSET 210E, ACRYSET 260E, ACRYSET 288E and AORON 453 (all manufactured by Nippon Shokubai Co.), CEBIAN A-4635, 4718, 4601 (all manufactured by Dicel Chemical Industry Co. Ltd.), Nipol Lx 811, 814, 821, 820, and 857 (all manufactured by Nippon Zeon Co.), water dispersible polyurethane resins such as SOFLANATE AE-10, and SOFLANATE AE-40 (all manufactured by Nippon Soflan Fabrication Co.), HYDRAN AP-10, 20, 30, 40, HW-110, HYDRAN HW-131, HYDRAN HW-135, HYDRAN HW-320, ECOS-3000, BONDIC 2250, 72070 (all manufactured by Dai-Nippon Ink Chemical Industry Co.), POISE 710, POISE 720 (all manufactured by Kao Corp.), MERCY 585, MERCY 585, MERCY 414, MERCY 455 (all manufactured by Toyo Polymer Co.), water dispersible polyester resins such as BIRONAL MD-1200, BIRONAL MD-1400, BIRONAL MD-1930 (all manufactured by Toyobo Co.), WD-size, WMS, WD3652, WJL6342 (all manufactured by Eastman Chemical Co.), FINETEX ES650, 611, 675, 850 (all manufactured by Dai-Nippon Ink Chemical Co.), water soluble, water diluted or water dispersible polyolefinic resins such as ISOBAN-10, ISOBAN-06, ISOBAN-04 (all manufactured by Kuraray Isoprene Chemical Co.), PREMACOL 5981, PREMACOL 5983, PREMACOL 5990, PREMACOL 5991 (all manufactured by Dow Chemical Co.), and CHEMIPAL S120, SA100 (all manufactured by Mitsui Petrochemical Co.), water dispersible or water soluble acrylic resins such as JURYMER AC-103, 10S, AT-510, ET-410, SEK-301, FC-60, SP-50TF, SPO-602, AC-70N (all manufactured by Nippon Junyaku Co.), water dispersible rubbers such as LACSTAR 7310K, 3307B, 4700H, 7132C (all manufactured by Dai-Nippon Ink Chemical Co.), Nipol Lx416, 410, 438C, 2507 (all manufactured by Nippon Zeon Co.), water dispersible poly(vinyl chlorides) such as G351, G576 (all manufactured by Nippon Zeon Co.), poly(vinylidene chlorides) such as L502, L513 (all manufactured by Asahi Kasei Industry Co.), etc.

(5) Others

In view of the coating property, it is preferred that the hydrophilic polymer-2 containing layer is gelled by the lowering of temperature.

Since the fluidity of the layer formed by coating is lost by gelling, the surface of a the image-forming layer less undergoes the effect of a drying blow in the drying step after the coating step, and a photothermographic material having a uniform coating surface shape can be obtained. For preparing a coating solution that is gelled by the lowering of the temperature, it is preferred to add a gelling agent to the coating solution for the hydrophilic polymer-2 coating layer.

It is important that the coating solution is not gelled upon coating. In view of easy operation, the coating solution has the fluidity during coating and gels to lose the fluidity at the instance of entering the drying step after coating. The viscosity of the coating solution for the hydrophilic polymer-2 containing layer during coating is, preferably, 5 mPa·s or more and 200 mPa·s or less and, more preferably, 10 mPa·s or more and 100 mPa·s or less.

In the invention, an aqueous solvent is used for the solvent of the coating solution. The aqueous solvent is water or a mixture of water with 70% by mass or less of a water miscible organic solvent. The water miscible organic solvent can include, for example, alcohols such as methyl alcohol, ethyl alcohol, and propyl alcohol, cellosolves such as methyl cellosolve, ethyl cellosolve, and butyl cellosolve, ethyl acetate, and dimethyl formamide.

While it is difficult to measure the viscosity of the formation layer at the instance before entering the drying step after coating (gelled at this instance) but it is estimated to be about 200 mPa·s or more and 5000 mPa·s or less and, preferably, 500 mPa·s or more and 5000 mPa·s or less.

While there is no particular restriction on the gelling temperature, the gelling temperature is preferably near the room temperature in view of the efficiency of the coating operation. Because this is a temperature at which the fluidity of the coating solution can be increased easily for easy coating, a temperature capable of maintaining the fluidity (that is, a temperature capable of easily keeping the elevated temperature), and a temperature capable of easy cooling after coating for eliminating the fluidity of the formed layer. Specifically, a preferred gelling temperature is 0° C. or higher and 40° C. or lower and, more preferably, 0° C. or higher and 35° C. or lower.

There is no particular restriction on the temperature of the coating solution during coating so long as it is set to higher than the gelling temperature and there is no particular restriction on the cooling temperature before drying step after coating so long as it is set to lower than the gelling temperature. However, when the difference between the temperature for the coating solution and the cooling temperature is set small, gelation starts in the course of coating to bring about a problem such that uniform coating is impossible. Further, when the temperature of the coating solution is set excessively high in order to obtain a large temperature difference, the solvent of the coating solution evaporizes to bring about a problem, for example, change of viscosity. Accordingly, the temperature difference is set, preferably, to 5° C. or higher and 50° C. or lower and, more preferably, 10° C. or higher and 40° C. or lower.

(i) Gelling Agent

The gelling agent in the invention is a substance causing gelation to a solution when it is added to an aqueous solution of a hydrophilic polymer or an aqueous latex solution of a hydrophobic polymer not derived from animal proteins and then cooled, or a substance causing gelation when used in combination with a gelation promoting substance. By causing gelation, the fluidity is lowered remarkably.

The gelling agent can include, specifically, the following water soluble polysaccharides. That is, it is at least one of materials selected from agar, κ-carrageenan, τ-carrageenan, alginic acid, alginate, agarose, furcellaran, gellan gum, glucono delta lactone, azodobactor vinelandii gum, xanthan gum, pectin, guar gum, locust been gum, tara gum, cassia gum, glucomannan, tragacanth gum, karaya gum, pullulan, gum arabic, arabino galactan, sodium salt of dextran, carboxymethyl cellulose, methyl cellulose, psyllium seed gum, starch, chitin, chitosan, and curdlan.

The substance that gels by cooling after dissolution under heating can include substances such as agar, carrageenan and gellan gum.

Among the gelling agents, more preferred compounds can include, κ-carrageenan (for example, K-9F, manufactured by Taito Co, K-15, K-21 to 24, I-3, manufactured by Nitta Gelatin Co.), τ-carrageenan, and agar, κ-carrageenan being particularly preferred.

The gelling agent is preferably used in an amount of 0.01% by mass or more and 10.0% by mass or less, preferably, 0.02% by mass or more and 5.0% by mass or less and, more preferably, 0.05% by mass or more and 2.0% by mass or less based on the binder polymer.

(ii) Gelation Promoter

The gelling gent is preferably used together with a gelation promoter. The gelation promoter in the invention is a compound for promoting gelation in contact with the gelling agent and provides its function in a specific combination with the gelling agent. In the invention, the following combination can be used as a combination for the gelling agent and the gelation promoter.

(1) Combination of an alkali metal ion such as of potassium, an alkaline earth metal ion such as of calcium or magnesium as the gelation promoter and carrageenan, alginate, gellan gum, azotobacter vinelandii gum, pectin and sodium carboxymethyl cellulose as the gelation agent.
(2) A combination of boric acid or other boric compounds as the gelation promoter and guar gum, locust bean gum, tara gum, and cassia gum as the gelling agent.
(3) A combination of acid or alkali as the gelation promoter and alginate, glucomannan, pectin, chitin, chitosan, and curdlan as the gelling agent.
(4) Water soluble polysaccharides reacting with the gelling agent to form a gel are used as the gelation promoter. Specifically, combination of using xanthan gum for the gelling agent and cassia gum for the gelation promoter, a combination of using carrageenan for the gelling agent and using locust bean gum for the gelation promoter can be mentioned as examples.

Specific examples for the combination of the gelling agent and the gelation promoter can include the following (a)–(g).

(a) combination of κ-carrageenan and potassium,
(b) combination of τ-carrageenan and calcium,
(c) combination of -methoxyl pectin and calcium
(d) combination of sodium alginate and calcium,
(e) combination of gellan gum and calcium
(f) combination of gellan gum and acid, and
(g) combination of locust bean gum and xanthan gum For the combination described above, plural combinations may also be used at a same time.

The gelation promoter may be added to a layer identical with the layer to which the gelling agent is added but it is preferred to be add to a different layer and cause it to act therein. More preferably, it is added to a layer not in direct adjacent with the layer to which the gelling agent is added. That is, it is more preferred to have a layer containing neither the gelling agent nor the gelation promoter between the layer containing the gelling agent and the layer containing the gelation promoter.

The gelation promoter is preferably used by from 0.1% by mass or more and 200% by mass or less and, preferably, 1.0% by mass or more and 100% by mass or less based on the gelling agent.

In addition, additives can be added properly to the hydrophilic polymer-2 containing layer. The additive can include, for example, surfactants, pH controllers, corrosion inhibitors, anti-mold agents, dyes, pigments and color toning agents.

(4) Hydrophobic Polymer Containing Layer

In the invention, the hydrophobic polymer containing layer is a layer containing a hydrophobic polymer. Preferred content of the hydrophobic polymer is 50% by mass or more and 100% by mass or less and, more preferably, 50% by mass or more and 75% by mass or less.

The hydrophobic polymer containing layer can be provided as the non-photosensitive intermediate layer and the outermost layer. It is preferably provided as the outermost layer. In a case where the outermost layer is constituted with the hydrophobic polymer containing layer, it is possible to suppress stickiness and decrease the change of picture quality by finger prints.

The hydrophobic polymer is a polymer having an equilibrium content at 25° C. and 60% RH of 5% by mass or less. "Equilibrium water content (% by mass) at 25° C., 60% RH" can be expressed as follows by using the weight W1 for a polymer at a moisture controlled equilibrium in a 25° C., 60% RH atmosphere and the weight W0 for the polymer in an absolutely dried state:

Equilibrium Water Content $$\text{at } 25^\circ\text{ C., } 60\%\ RH=\{(W1-W0)/W0\}\times 100\ (\%\text{ by mass})$$

For the definition and the measuring method of the water content, Polymer Engineering Course 14, Polymer Material Test Method (edited by Polymer Society, published from Chijin Shokan) can be referred to for instance.

The equilibrium water content of the binder polymer usable in the invention at 25° C., 60% RH is, preferably, 2% by mass or less, more preferably, 0.01% by mass or more and 1.5% by mass or less and, further preferably, 0.02% by mass or more and 1% by mass or less.

In the invention, the glass transition temperature of the hydrophobic polymer is 0° C. or higher and 80° C. or lower, preferably, 10° C. or hither and 70° C. or lower and, more preferably, 15° C. or higher and 60° C. or lower.

Tg in the present specification is calculated according to the following equation.

$$1/Tg=\Sigma(Xi/Tgi)$$

It is assumed here monomer ingredients by the number of n (i=1 to n) are copolymerized in the polymer. Xi represents the weight ratio of the $i_{th}$ monomer (ΣXi=1) and Tgi represents a glass transition temperature (absolute temperature) of a homopolymer of the $i_{th}$ monomer. Σ is a sum for i=1 to n. For the value of the glass transition temperature for the homopolymer of each of the monomers (Tgi), values in Polymer Handbook (3rd Edition) (written by J. Brandrup, E. H. Immergut (Wiley-Interscience, 1989)) was adopted.

Specific example of the hydrophobic polymer that can be used for the hydrophobic polymer containing layer can include latexes that can be used for the non-photosensitive intermediate layer A in the invention, or latexes of polyacrylate, polyurethane, polymethacrylates or copolymers containing them.

Two or more kinds of binders may be used together as required. Further, a binder with a glass transition temperature of 20° C. or higher and a binder with a glass temperature of lower than 20° C. may be used in combination. In the case of blending two or more kinds of polymers of different Tg for use, it is preferred that weight average Tg thereof is within the range described above.

In the invention, it is preferred to form the hydrophobic polymer containing layer by using a coating solution in which 30% by mass or more of the solvent is water and coating and drying the same to form a hydrophobic polymer containing layer.

A preferred embodiment is prepared such that the ionic conductivity is controlled to 2.5 mS/cm or less and the preparation method therefor can include a method of conducting purification by using a separation functional film after the synthesis of the polymer.

As the coating solvent, water or a mixture of water and 70% by mass or less of a water miscible organic solvent is preferred. The water miscible organic solvent can include, for example, alcohols such as methyl alcohol, ethyl alcohol, and propyl alcohol, cellosolves such as methyl cellosolve, ethyl cellosolve, and butyl cellosolve, ethyl acetate, and dimethylformamide.

In the invention, a polymer dispersible in an aqueous solvent is particularly preferred. As an example of the dispersed state, either a latex in which fine particles of a water insoluble hydrophobic polymer are dispersed, or a dispersion in which polymer molecules are dispersed in the state of molecules or forming micelles may be used, with the particles dispersed as latex being more preferred. The average grain size of the dispersed particles is within a range of 1 nm or more and 50000 nm or less, preferably, within a range of 5 nm or more and 1000 nm or less, more preferably, within a range of 10 nm or more and 500 or less and, further preferably, within a range of 50 nm or more and 200 nm or less. There is no particular restriction on the grain size distribution of the dispersed particles which may have a wide grain size distribution or a grain size distribution of mono dispersion. Use of two or more kinds of particles each having the grain size distributions of mono dispersion in admixture is also a preferred method of use for controlling the physical property of the coating solution.

As a preferred embodiment of the hydrophobic polymer, hydrophobic polymers such as acrylic polymers, poly(esters), rubbers (for example SBR resin), poly(urethanes), poly(vinyl chlorides), poly(vinyl acetates), poly(vinylidene chlorides), or poly(olefins) can be used preferably. The polymers may be linear polymers, branched polymers, or crosslinked polymers. It may be so-called homopolymers in which single monomers are polymerized or copolymers in which two or more kinds of monomers are polymerized. In the case of the copolymer, it may be either random copolymers or block copolymers. The molecular weight of the polymer, based on the number average molecular weight, is 5000 or more and 1,000,000 or less and, preferably, 10,000 or more and 200,000 or less. Those with excessively small molecular weight provide insufficient dynamic strength for the image-forming layer, whereas those of excessively large molecular weight are not preferred since the film-deposition property is poor. Further, the crosslinking polymer latexes can be used particularly preferably.

1) Specific Example of Polymer Latex

Specific examples of the preferred polymer latex can include those shown below. They are expressed by using starting monomers and, in each of parentheses, numerical value means % by mass and the molecular weight is a number average molecular weight. In a case of using polyfunctional monomers, since they form crosslinking structures and the concept of the molecular weight can not be applied, it is indicated as crosslinking with description for the molecular weight being omitted. Tg represents a glass transition temperature NP-1: Latex of -MMA (70)-EA(27)-MAA(3)-(molecular weight 37000, Tg 61° C.)

NP-2: Latex of -MMA (70)-2EHA(20)-St(5)-AA(5)-(molecular weight 40000, Tg 59° C.)

NP-3: Latex of -St(50)-Bu(47)-MAA(3)-(crosslinking, Tg—17° C.)

NP-4: Latex of -St(68)-Bu(29)-AA(3)-(crosslinking, Tg 17° C.)

NP-5: Latex of -St(71)-Bu(26)-AA(3)-(crosslinking, Tg 24° C.)

NP-6: Latex of -St(70)-Bu(27)-MAA(3)-(crosslinking),

NP-7: Latex of -St(75)-Bu(24)-AA(1)-(crosslinking, Tg 29° C.).

NP-8: Latex of -St(60)-Bu(35)-DVB(3)-MAA(2)-(crosslinking),

NP-9: -St(70)-Bu(25)-DVB(2)-AA (3) latex (crosslinking),

NP-10: Latex of -VC(50)-MMA(20)-EA(20)-AN(5)-AA (5)-(molecular weight 80000),

NP-11: Latex of -VDC(85)-MMA(5)-EA(5)-MAA(5)-(molecular weight N67000),

NP-12: Latex of -ET(90)-MMA(10)-(molecular weight 12000),

NP-13: Latex of -St(70)-2EHA(27)-AA(3)-(molecular weight 130000, Tg 43° C.)

NP-14: Latex of MMA(63)-EA(35)-AA(2)-(molecular weight of 33000, Tg 47° C.),

NP-15: Latex of -St(70.5)-Bu(26.5)-AA(3)-(crosslinking, Tg 23° C.),

NP-16: Latex of -St(69.5)-Bu(27.5)-AA(3)-(crosslinking, Tg 20.5° C.)

NP-17: Latex of -St(61.3)-isoprene(35.5)-AA(3)-(crosslinking, Tg 17° C.)

NP-18: Latex of -St(67)-isoprene(28)-Bu(2)-AA(3)-(crosslinking, Tg 27° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

2) Preferred Latex

As the polymer latex used for the hydrophobic polymer layer of the invention, copolymers of acrylic polymers or polyesters and polyurethanes are particularly preferred for example. Further, the polymer latex used for the hydrophobic polymer layer of the invention preferably contains acrylic acid or methacrylic acid by preferably 1 to 6% by mass and, more preferably, 2 to 5% by mass. The polymer latex used for the hydrophobic polymer layer of the invention preferably contains acrylic acid.

3) Coating Amount

The coating amount (per 1 $m^2$ of support) of the hydrophobic polymer is, preferably, from 0.1 $g/m^2$ or more and 10 $g/m^2$ or less and, more preferably, 0.3 $g/m^2$ or more and 5 $g/m^2$ or less.

The concentration in the coating solution is preferably controlled such that the viscosity thereof has a value upon addition suitable to the simultaneous stacked layer coating with no particular restriction. The concentration in the liquid is generally 5% by mass or more and 50% by mass or less, more preferably, 10% by mass or more and 40% by mass or less and, particular preferably, 15% by mass or more and 30% by mass or less.

4) Polymer That Can be Used Together

For the hydrophobic polymer containing layer, the hydrophobic polymer may be used alone or two or more of them may be used together. Further, other binder than the hydrophobic polymer may also be used together. In a case where the polymer used together is a hydrophilic polymer, the hydrophilic polymer-1 or the hydrophobic polymer-2 in the invention can be used.

A hydrophilic polymer such as gelatin, polyvinyl alcohol, methyl cellulose, hydroxypropyl cellulose or carboxymethyl cellulose may be added optionally to the hydrophobic polymer containing layer of the photosensitive material in the invention. The addition amount of the hydrophilic polymer is, preferably, 30% by mass or less and, more preferably, 20% by mass or less based on the entire binder of the hydrophobic polymer containing layer.

5) Crosslinking Agent

In the invention, a crosslinking agent is preferably added to the hydrophobic polymer containing layer. The addition improves the hydrophobic property and water proofness of the non-photosensitive intermediate layer to provide an excellent photothermographic material. Preferred crosslinking agents are identical with those explained for the non-photosensitive intermediate layer.

6) Viscosity Enhancer

A viscosity enhancer is preferably added to the coating solution for forming the hydrophobic polymer containing layer. Addition of the viscosity enhancer is preferred since a hydrophobic layer of uniform thickness can be formed. Preferred viscosity enhancers are identical with those explained for the non-photosensitive intermediate layer A.

In addition, various additives can be added to the hydrophobic polymer containing layer. For example, the additives include surfactants, pH controllers, corrosion inhibitors, and anti-mold agents.

(5) Outermost Layer

For the outermost layer of the invention, any of the hydrophilic polymer-1 containing layer, the hydrophilic polymer-2 containing layer and the hydrophobic polymer containing layer may be used. Since the outermost layer is a portion directly suffering from the effects of external circumstances during transportation, storage or development, the followings are preferably added as the additives. The additives can be added to the layers other than the outermost layer, for example, a surface protective layer which is not the outermost layer, an intermediate layer, a back layer and a back surface protective layer.

1) Matting Agent

In the invention, a matting agent is preferably added for the improvement of the transportability and the matting agent is described in JP-A No. 11-65021, in column Nos.

0126 to 0127. The matting agent when expressed by coating the amount per 1 $m^2$ of the photosensitive material is, preferably, 1 $mg/m^2$ or more and 400 $mg/m^2$ or less and, more preferably, 5 $mg/m^2$ or more and 300 $mg/m^2$ or less.

The shape of the matting agent in the invention may be a definite or indefinite shape and a definite and spherical shape is used preferably.

The sphere-equivalent diameter in volume addition average of the matting agent used for the emulsion surface is, preferably, 0.3 μm or more and 10 μm or less and, more preferably, 0.5 μm or more and 7.0 μm or less. The fluctuation coefficient of the size distribution of the matting agent is, preferably, 5% or more and 80% or less and, more preferably, 20% or more and 80% or less. The fluctuation coefficient is a value represented by: (standard deviation of particle size)/(average value of particle size)×100. Further, two or more kinds of matting agents of different average grain sizes can also be used for the matting agent on the emulsion surface. In this case, the difference of the particle size between the matting agent having the largest average grain size and the matting agent of the smallest size is, preferably, 2 μm or more and 8 μm or less and, more preferably, 2 μm or more and 6 μm or less.

The sphere-equivalent diameter in volume addition average of the matting agent used for the back surface is, preferably, 1 μm or more and 15 μm or less and, more preferably, 3 μm or more and 10 μm or less. Further, the fluctuation coefficient for the size distribution of the matting agent is, preferably, 3% or more and 50% or less and, more preferably, 5% or more and 30% or less. Further, two or more kinds of matting agents of different average grain sizes can also be used for the matting agent on the back surface. In this case, the difference of the particle size between the matting agent having the largest average grain size and the matting agent of the smallest size is, preferably, 2 μm or more and 14 μm or less and, more preferably, 2 μm or more and 9 μm or less.

The matting degree on the emulsion surface may be at any level so long as it is free of star dust failure. It is preferred that the Beck smoothness is 30 sec or more and 2000 sec or less and, particularly preferably, 40 sec or more and 1500 sec or less. The beck smoothness can be determined easily according to Japanese Industry Standards (JIS) P8119 "Smoothness test method for paper and paper board by a Beck tester" and according to TAPPI standard method T479.

The matting degree of the back layer in the invention is such that the Beck smoothness is, preferably, 1200 sec or less and 10 sec or more and, more preferably, 800 sec or less and 20 sec or more and, further preferably, 500 sec or less and 40 sec or more.

In the invention, the matting agent is contained preferably in the outermost surface layer or a layer that functions as the surface protective layer, or a layer near the outermost surface layer of the photosensitive material.

2) Lubricant

For improving the handlability during production and scratch resistance upon heat development, lubricants such as liquid paraffins, long chained fatty acids, fatty acid amids, or fatty acid esters are used preferably. Particularly, liquid paraffins removed with low boiling ingredients or fatty acid esters of a molecular weight of 1000 or more having a branched structure are preferred.

As the lubricant, those compounds described, in JP-A No. 11-65021, in column No. 0117, JP-A No. 2000-5137, Japanese Patent Application Nos. 2003-8015, 2003-8071, and 2003-132815 are preferred.

The amount of the lubricant used is within a range of 1 $mg/m^2$ or more and 200 $mg/m^2$ or less and, within a range, preferably, of 10 $mg/m^2$ or more and 150 $mg/m^2$ or less and, more preferably, 20 $mg/m^2$ or more and 100 $mg/m^2$ or less.

The lubricant may be added to any of the layers of the image-forming layer and the non-photosensitive layer and it is preferably added to the outermost layer with an aim of improving the transportability and scratch resistance.

3) Surfactant

The surfactant applicable to the invention is described in JP-A No. 11-65021, in column No. 0132, and the solvent is described in column No. 0133, the support is described in column No. 0134, the anti-static or conductive layer is described in column No. 0135, and the method of obtaining the color image is described in column No. 0136 thereof, and the lubricant is described in JP-A Nos. 11-84573, in column Nos. 0061 to 0064 and JP-A No. 2001-83679, in column Nos. 0049 to 0062.

In the invention, a fluoro surfactant is used preferably. Specific examples of the fluoro surfactant can include compounds described, for example, in JP-A Nos. 10-197985, 2000-19680, and 2000-214554. Further, a polymeric fluoro surfactant described in JP-A No. 9-281636 can also be used preferably. In the photothermographic material of the invention, it is preferred to use fluoro surfactants described in JP-A Nos. 2002-82411, 2000-057780 and 2003-149766. Particularly, fluoro surfactants described in JP-A No. 2003-057780 and Japanese Patent Application No. 2001-264110 are preferred with a view point of charge controlling performance, stability in the coated surface state and slipping property in a case of coating and production with an aqueous coating solution, and the fluoro surfactant described in Japanese Patent Application 2001-264110 is most preferred in that the charge controlling performance is high and the amount of use may be decreased.

In the invention, the fluoro surfactant can be used to any of the emulsion surface and the back surface and is preferably used to both of the surfaces. Further, it is particularly preferred to use in combination with the conductor layer containing the metal oxide. In this case, a sufficient performance can be obtained even when the amount of the fluoro surfactant used at the surface having the conductor layer is decreased or eliminated.

The amount of use of the fluoro surfactant is, preferably, within a range from 0.1 $mg/m^2$ to 100 $mg/m^2$, more preferably, within a range from 0.3 $mg/m^2$ to 30 $mg/m^2$ and, further preferably, within a range from 1 $mg/m^2$ to 10 $mg/m^2$ to each of the emulsion surface and the back surface. Particularly, the fluoro surfactant described in Japanese Patent Application No. 2001-264110 has a large effect and the amount is, preferably, within a range from 0.01 to 10 $mg/m^2$ and, more preferably, within a range from 0.1 to 5 $mg/m^2$.

(6) Image-forming Layer (Description for Non-photosensitive Organic Silver Salt)

1) Composition

The organic silver salt usable in the invention is a silver salt which is relatively stable to light but functions as a silver ion supplying source to form silver images in a case when it is heated at 80° C. or higher in the presence of an exposed photosensitive silver halide and a reducing agent. The organic silver salt may be any organic substance capable of supplying silver ions that can be reduced by a reducing agent. The non-photosensitive organic silver salt is described, for example, in JP-A No. 10-62899, in column Nos. 0048 to 0049, EP-A No. 0803764 A1, from page 18, line 24 to page 19, line 37, EP-A No. 0962812 A1, and JP-A Nos. 11-349591, 2000-7683 and 2000-72711. Silver salts of organic acids, particularly, silver salts of long chained aliphatic carboxylic acids (number of carbon atoms of 10 to 30, preferably, 15 to 28) are preferred. Preferred examples of the fatty acid silver salts can include, for example, silver lignocerate, silver behenate, silver arachidate, silver stearate, silver oleate, silver laurate, silver caproate, silver myristate, silver palmitate, silver ercate and mixtures thereof. In the invention, it is preferred to use, among the fatty acid silver salts, fatty acid silver salts with the silver behenate content of, preferably, 50% by mole or more and 100% by mole or less, more preferably, 85% by mole or more and 100% by mole or less and, further preferably, 90% by mole or more and 100% by mole or less.

Further, it is preferred to use a fatty acid silver salt with the silver ercate content of 2% by mole or less, more preferably, 1% by mole or less and, further preferably, 0.1% by mole or less.

It is preferred that the content of the silver stearate is 1% by mole or less. When the content of the silver stearate is 1% by mole or less, a silver salt of organic acid having low Dmin, high sensitivity and excellent image stability can be obtained. The content of the silver stearate above-mentioned is preferably 0.5% by mole or less, more preferably, the silver stearate is not substantially contained.

Further, in the case the silver salt of organic acid includes silver arachidinic acid, it is preferred that the content of the silver arachidinic acid is 6% by mole or less in order to obtain a silver salt of organic acid having low Dmnin and excellent image stability. The content of the silver arachidinate is more preferably 3% by mole or less.

2) Shape

There is no particular restriction on the shape of the organic silver salt usable in the invention and it may needle-like, bar-like, tabular or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: $x(\text{average}) \geqq 1.5$ as an average value x is defined as a flaky shape. The relation is preferably: $30 \geqq x(\text{average}) \geqq 1.5$ and, more preferably, $15 \geqq x(\text{average}) \geqq 1.5$. By the way, needle-like is expressed as $1 \leqq x(\text{average}) < 1.5$.

In the flaky shaped particle, a can be regarded as a thickness of a tabular particle having a main plate with b and c being as the sides. a in average is preferably 0.01 μm to 0.3 μm and, more preferably, 0.1 μm to 0.23 μm. c/b in average preferably 1 to 9, more preferably, 1 to 6, further preferably, 1 to 4 and, most preferably, 1 to 3.

By controlling the sphere equivalent diameter to be 0.05 μm to 1 μm, it causes less agglomeration in the photothermographic material and image stability is improved. The sphere equivalent diameter is preferably 0.1 μm to 1 μm. In the invention, the sphere equivalent diameter can be measured by a method of photographing a sample directly by using an electron microscope and then image-processing negative images.

In the flaky shaped particle, the sphere equivalent diameter of the particle/a is defined as an aspect ratio. The aspect ratio of the flaky particle is, preferably, 1.1 to 30 and, more preferably, 1.1 to 15 with a viewpoint of causing less agglomeration in the photothermographic material and improving the image stability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the scattering of scattered light to the change of time.

3) Preparation

Methods known in the art may be applied to the method for producing the organic silver salt used in the invention, and to the dispersion method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be disposed in the aqueous dispersion, is preferably, 1% by mole or less, more preferably, 0.1% by mole or less per one mol of the organic acid silver salt in the solution and, further preferably, positive addition of the photosensitive silver salt is not conducted.

In the invention, the photothermographic material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in the range from 1% by mole to 30% by mole, more preferably, in the range from 2% by mole to 20% by mole and, particularly preferably, 3% by mole to 15% by mole. A method of mixing two or more kinds of aqueous dispersions of organic silver salts and two or more kinds of aqueous dispersions of photosensitive silver salts upon mixing are used preferably for controlling the photographic properties.

4) Addition Amount

While an organic silver salt in the invention can be used in a desired amount, an amount of an organic silver salt is preferably in the range from 0.1 $g/m^2$ to 5.0 $g/m^2$, more preferably 0.3 $g/m^2$ to 3.0 $g/m^2$, and further preferably 0.5 $g/m^2$ to 2.0 $g/m^2$, with respect to total coating amount of Ag including silver halide. Particularly, it is preferred that an amount of total silver preferably is 1.8 $g/m^2$ or less, and more preferably from 1.6 $g/m^2$ or less, to improve the image stability. Using the preferable reducing agent of the invention, it is possible to obtain a sufficient image density even with such a low amount of silver.

(Anti-Foggant)

The anti-foggant, the stabilizer and the stabilizer precursor usable in the invention can include those described in JP-A No. 10-62899, in column No. 0070, EP-A No. 0803764A1, in page 20, line 57-page 21, line 7, compounds described in JP-A Nos. 9-281637 and 9-329684, and compounds described in U.S. Pat. No. 6,083,681, and EP No. 1048975.

(1) Description of Polyhalogen Compound

Preferred organic polyhalogen compounds which is the anti-foggant usable in the invention are to be described specifically. Particularly, in the invention, the organic polyhalogen compound represented by Formula (H) is preferred in that the image storability of the not exposed photosensitive material (unprocessed stock storability), particularly, increase of fogging caused by storage under a high temperature condition in a dark place can be improved:

$$Q\text{-}(Y)_n\text{—}C(Z_1)(Z_2)X \qquad \text{Formula (H)}$$

In Formula (H), Q represents an alkyl group, aryl group or heterocyclic group, Y represents a bivalent linking group, n represents 0 to 1, $Z_1$ and $Z_2$ each represents a halogen atom and X represents a hydrogen atom or an electron attracting group.

In Formula (H), Q is preferably an alkyl group of 1 to 6 carbon atoms, an aryl group of 6 to 12 carbon atoms or a heterocyclic group containing at least one nitrogen atom (pyridine, quinoline, etc.).

In Formula (H), in a case where Q is the aryl group, Q preferably represents a phenyl group substituted with an electron attracting group in which Hammetts substituent constant σp has a positive value. The Hammett's substituent constant can be referred, for example, to Journal of Medicinal Chemistry, 1973, Vol. 16, No. 11, 1207 to 1216. The electron attracting group includes, for example, a halogen atom, alkyl group substituted by electron attracting group, aryl group substituted by electron attracting group, heterocyclic group, alkyl or arylsulfonyl group, acyl group, alkoxycarbonyl group, carbamoyl group, or sulfamoyl group. Particularly preferred electron attracting group is a halogen atom, carbamoyl group, or arylsulfonyl group, with the carbamoyl group being most preferred.

X is preferably an electron accepting group, and more preferred electron accepting group is a halogen atom, aliphatic.aryl or heterocyclic sulfonyl group, aliphatic.aryl or heterocyclic acyl group, aliphatic.aryl or heterocyclic oxycarbonyl group, carbamoyl group, or sulfamoyl group, more preferably, the halogen atom carbamoyl group and, particularly preferably bromine atom.

$Z_1$ and $Z_2$ each represents preferably a bromine atom or iodine atom and, more preferably, a bromine atom.

Y represents, preferably, —C(═O)—, —SO—, —$SO_2$—, —C(═O)N(R)—, or —$SO_2$N(R)—, more preferably, —C(═O)—, —$SO_2$—, and —C(═O)N(R)— and, particularly preferably, —$SO_2$—, —C(═O)N(R)—, wherein R represents a hydrogen atom, aryl group or alkyl group, more preferably, a hydrogen atom or an alkyl group and, particularly preferably, a hydrogen atom.

n represents 0 or 1 and, preferably, 1.

In Formula (H) in a case where Q represents the alkyl group, Y is preferably —C(═O)N(R)— and in a case where Q represents the aryl group or heterocyclic group, Y preferably represents —$SO_2$—.

In Formula (H), a form where the residues after removing the hydrogen atom from the compound are combined to each other (generally referred to as bis-form, tris-form and tetrakis-form) can also be used preferably.

In Formula (H), a form having a dissociating group (for example, COOH group or a salt thereof, $SO_3H$ group or a salt thereof, $PO_3H$ group or a salt thereof, etc.), a group containing a quaternary nitrogen cation (for example, ammonium salt, pyridinium salt, etc.), polyethyleneoxy group or hydroxyl group as a substituent is also preferred.

Specific examples of the compound of Formula (H) in the invention are shown below.

(H-1)

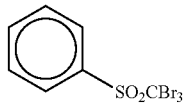

(H-2)

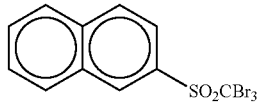

(H-3)

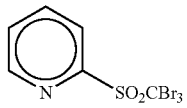

(H-4)

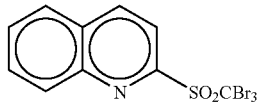

(H-5)

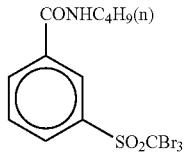

(H-6)

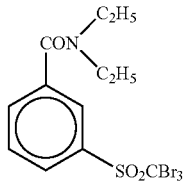

-continued (H-7)

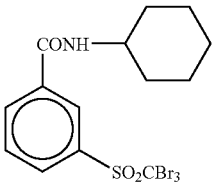

(H-8)

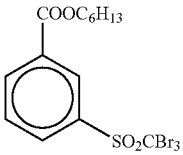

(H-9)

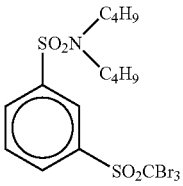

(H-10)

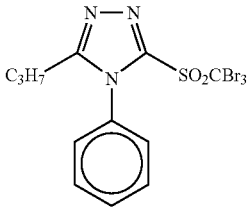

(H-11)

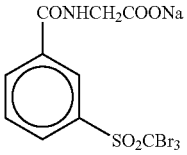

(H-12)

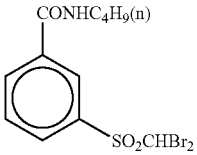

(H-13)

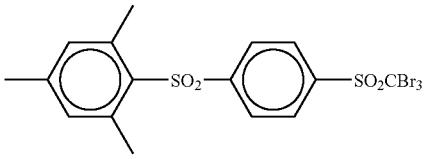

(H-14)

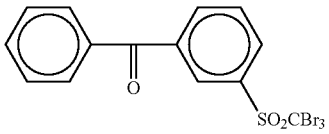

(H-15)

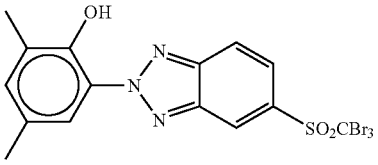

-continued (H-16)

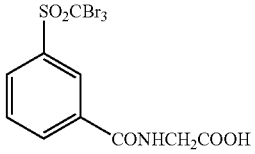

(H-17)

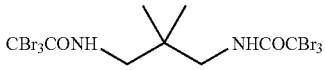

(H-18)

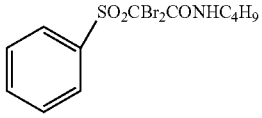

(H-19)

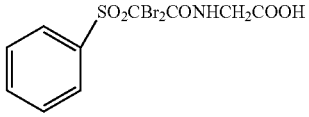

Further, the combined use of two or more of the compounds represented by Formula (H) is preferred since the unprocessed stock storability of the not exposed photosensitive material, image storability after exposure and heat development, particularly, increase of fogging after spontaneous aging due to unprocessed storage can be improved further. For the combination in a case of the combined use, it is preferred that the melting temperature of a mixture containing them at the ratio of the contents thereof is −10° C. or higher and 50° C. lower relative to the heat developing temperature. Specific preferred compositions of the compounds represented by Formula (H) at the heat developing temperature of 120° C. includes, for example, (H-5) and (H-1) (129° C., difference 9° C.), (H-2) and (H-5) (154° C., difference 34° C.), (H-1) and (H-4) (122° C., difference 2° C.), (H-2) and (H-4) (132° C., difference 12° C.), and (H-4) and (H-5) (129° C., difference 9° C.), with no restriction to them.

In a case of using two or more kinds of the compounds represented by Formula (H) together, the total for two or more kinds of the compounds as the coating amount per 1 $m^2$ of the heat developing image recording material is, preferably, from $1\times10^{-6}$ to $1\times10^{-2}$ mol/$m^2$, more preferably, from $1\times10^{-5}$ to $5\times10^{-3}$ mol/$m^2$ and, further preferably, from $2\times10^{-5}$ to $2\times10^{-1}$ mol/$m^2$. While the ratio (molar ratio) in the combination of the compounds represented by Formula (H) is not particularly limited and, for example, in a case of using two kinds of the compounds represented by Formula (H), they can be at an optional ratio, for example, within a range from 0.5:99.5 to 99.5:0.5. In a case of using three or more kinds of the compounds represented by Formula (H), total molar ratio of the remaining compounds represented by Formula (H) after excluding the compound at the highest molar ratio can be 0.5% or more.

As other polyhalogen compounds than those described above usable in the invention, those compounds described in the specifications of U.S. Pat. Nos. 3,874,946, 4,756,999, 5,340,712, 5,369,000, 5,464,737, 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-

284410, 2000-284412, 2001-33911, 2001-31644, 2001-312027, and 2003-50441 as the exemplified compounds for the inventions can be used preferably. Particularly those compounds exemplified specifically in JP-A Nos. 7-2781, 2001-33911, and 2001-312027 are preferred.

In the invention, the polyhalogen compound is used, preferably, within a range of $10^{-4}$ mol or more and 1 mol or less, more preferably, within a range of $10^{-3}$ mol or more and 0.5 mol or less and, further preferably, within a range of $1\times10^{-2}$ mol or more and 0.2 mol or less based on one mol of the non-photosensitive silver.

In the invention, usable methods for incorporating the anti-foggant into the photothermographic material are those described above in the method for incorporating the reducing agent, and similarly, for the organic polyhalogen compound, it is preferably added in the form of a solid fine particle dispersion.

(2) Other Anti-foggant

As other anti-foggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by Formula (S) in JP-A No. 2000-221634, a triazine compound related to claim 9 of JP-A No. 11-352624, a compound expressed by general Formula (III), 4-hydroxy-6-methyl-1,3,3a,7-tetrazaindene and the like, as described in JP-A No. 6-11791.

The photothermographic material of the invention may further contain an azolium salt in order to prevent fogging. As azolium salts, there can be mentioned a compound expressed by Formula (XI) as described in JP-A No. 59-193447, a compound described in JP-B No. 55-12581, and a compound expressed by Formula (II) in JP-A No. 60-153039. The azolium salt may be added to any part of the photothermographic material, but as the addition layer, preferred is to select a layer on the side having thereon the image-forming layer, and more preferred is to select a layer containing organic silver salt. The azolium salt may be added at any time of the process of preparing the coating solution; in the case where the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like. In the invention, the azolium salt may be added at any amount, but preferably, it is added in a range from $1\times10^{-6}$ mol to 2 mol, and more preferably, from $1\times10^{-3}$ mol to 0.5 mol per one mol of silver.

(Reducing Agent)

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A 0803764 A1 (page 7, line 34 to page 18, line 12).

In the invention, a so-called hindered phenolic reducing agent or a bisphenol agent having a substituent at the ortho-position to the phenolic hydroxyl group is preferred and the compound represented by the following Formula (R) is more preferred.

Formula (R)

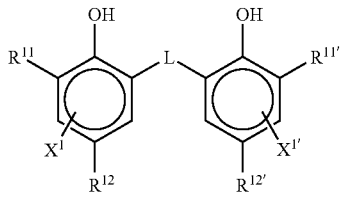

In Formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described specifically.

In a case where the alkyl group is to be referred to, it also includes a cycloalkyl group unless otherwise specified.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, and $X^1$ and $X^{1'}$ $R^{12}$ and $R^{12'}$ each independently represent a hydrogen atom or a group capable of substituting for a hydorgen atom on a benzene ring. $X^1$ and $X^{1'}$ each independently represent a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent. Specific examples of the non-substituted alkyl group for $R^{13}$ can include, for example, methyl group, ethyl group, propyl group, butyl group, heptyl group, undecyl group, isopropyl group, 1-ethylpentyl group, 2,4,4-trimethylpentyl group, cyclohexyl group, 2,4-dimethyl-3-cyclohexenyl group, and 3,5-dimethyl-3-cyclohexenyl group. Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituent $R^{11}$ and $R^{11'}$ are, preferably, a secondary or tertiary alkyl group having 1 to 15 carbon atoms and can include, specifically, methyl group, isopropyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 1 to 4 carbon atoms and, among them, methyl group, t-butyl group, t-amyl group, 1-methylcyclohexyl group are further preferred, methyl group and t-butyl group being most preferred.

$R^{12}$ and $R^{12'}$ are, preferably, an alkyl group having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group, and, particularly preferably, methyl group or ethyl group.

L is preferably —$CHR^{13}$— group.

$R^{13}$ is preferably a hydrogen atom or an alkyl group of 1 to 15 carbon atoms, and a linear alkyl group and, in addition, cyclic alkyl group are also used preferably as the alkyl group. Further, those containing C═C bond in the alkyl groups are also used preferably. As the alkyl group, for example, methyl group, ethyl group, propyl group, isopropyl group, 2,4,4-trimethylpentyl group, cyclohexyl group, 2,4-dimethyl-3-cyclohexenyl group, and 3,5-dimethyl-3-cyclohexenyl group are preferred. Particularly preferred $R^{13}$ are a hydrogen atom, methyl group, ethyl group, propyl group, isopropyl group, or 2,4-dimethyl-3-cyclohexenyl group.

In a case where $R^{11}$, $R^{11'}$ each represents a tertiary alkyl group and $R^{12}$ and $R^{12'}$ each represents a methyl group, $R^{13}$ is preferably a primary or secondary alkyl group of 1 to 8 carbon atoms (methyl group, ethyl group, propyl group, isopropyl group and 2,4-dimethyl-3-cyclohexenyl group).

In a case where $R^{11}$, $R^{11'}$ each represents a tertiary alkyl group and $R^{12}$, $R^{12'}$ each represents an alkyl group other than the methyl group, $R^{13}$ is preferably a hydrogen atom.

In a case where the $R^{11}$, $R^{11'}$ are not tertiary alkyl group, $R^{13}$ is preferably a hydrogen atom or a secondary alkyl group with the secondary alkyl group being particularly preferred. A preferred group as the secondary alkyl group for $R^{13}$ is isopropyl group, or 2,4-dimethyl-3-cyclohexenyl group.

For the reducing agent, the heat developing property, developed silver color tone, etc. are different depending on the combination of $R^{11}$, $R^{11'}$, $R^{12}$ and $R^{13}$. Since they can be controlled by the combination of two or more of the reducing agents, it is preferred to use in combination of two or more of them depending on the purpose.

In the invention, the reducing agent represented by Formula (R1) is preferred.

Formula (R1)

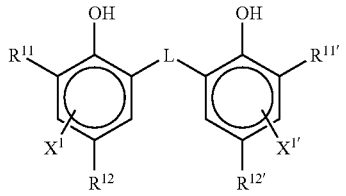

In Formula (R1), $R^{11}$ and $R^{11'}$ are different from Formula (R). $R^{11}$ and $R^{11'}$ each represents independently a secondary or tertiary alkyl group of 1 to 15 carbon atoms. $R^{12}$, $R^{12'}$, L, $X^1$, $X^{1'}$ are identical with those of Formula (R) respectively.

Specific examples of the reducing agents including the compounds represented by 1 Formula (R) in the invention are to be shown below but the invention is not restricted to them.

(R-1)

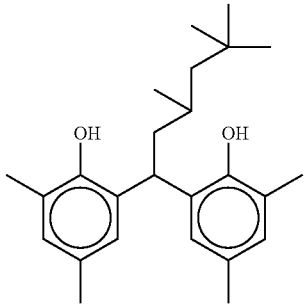

(R-2)

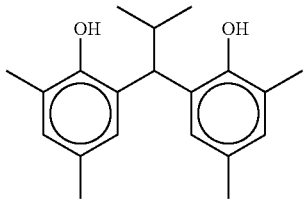

(R-3)

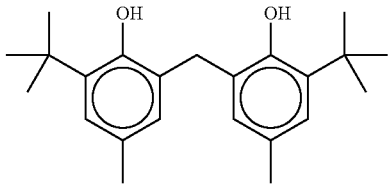

(R-4)

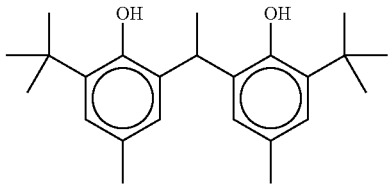

(R-5)

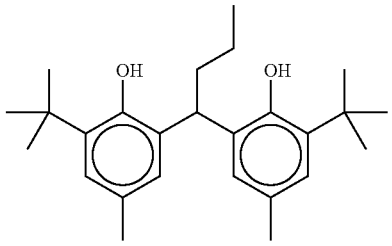

(R-6)

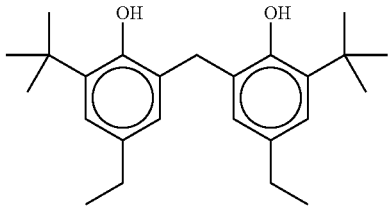

-continued (R-7)

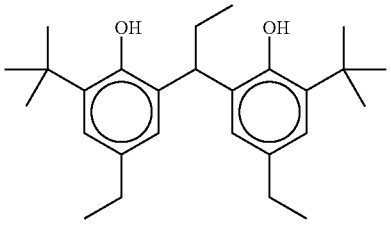

(R-8)

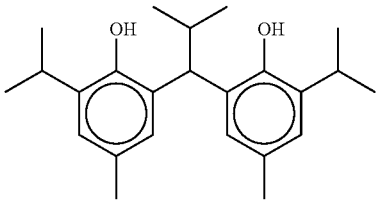

(R-9)

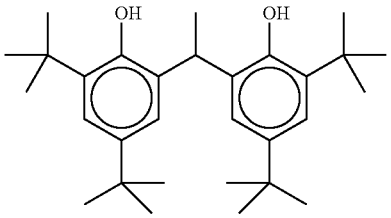

(R-10)

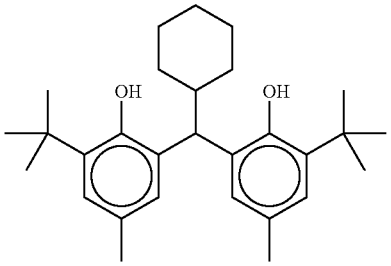

(R-11)

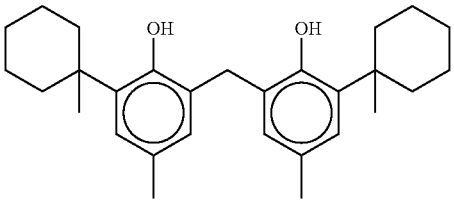

(R-12)

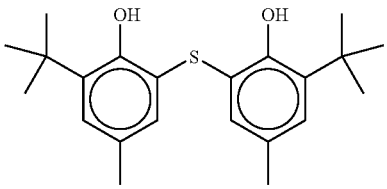

(R-13)

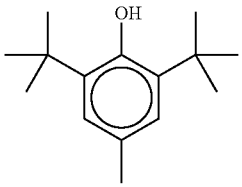

-continued (R-14)

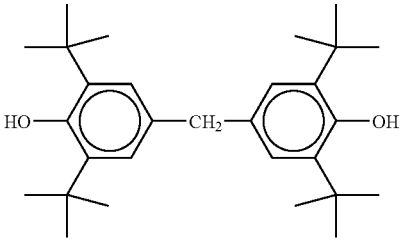

(R-15)

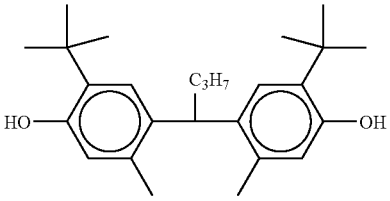

(R-16)

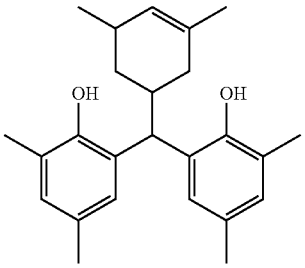

(R-17)

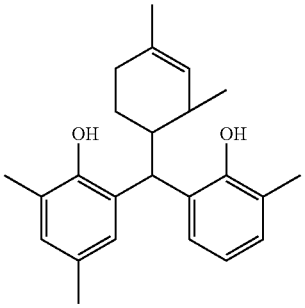

(R-18)

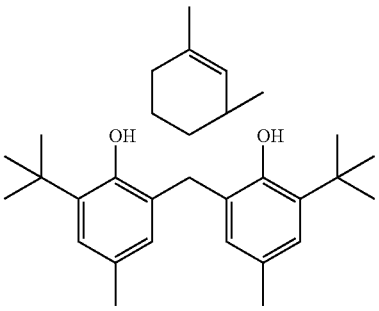

As preferred reducing agents of the invention other than those above, there can be mentioned compounds disclosed in JP-A Nos. 2001-188314, 2001-209145, 2001-350235, 2002-156727, and EP-A NO.1278101-A2.

In the invention, the addition amount of the reducing agent is, preferably, from 0.1 g/m$^2$ to 3.0 g/m$^2$, more preferably, 0.2 g/m$^2$ to 2.0 g/m$^2$ and, further preferably 0.3 g/m$^2$ to 1.0 g/m$^2$. It is, preferably, contained in a range of 5% by mole to 50% by mole, more preferably, 8% by mole to 30% by mole and, further preferably, 10% by mole to 20% by mole per one mol of silver in the image-forming layer.

The reducing agent may be incorporated in a coating solution and incorporated in a photosensitive material by any method, for example, in the form of solution, emulsified dispersion or fine solid particle dispersion.

Well-known emulsifying dispersion methods can include a method of dissolving by using oils such as dibutyl phthalate, tricresyl phosphate, dioctyl sebacate, or tri(2-ethylhexyl) phosphate, or an auxiliary solvent such as ethyl acetate or cyclohexanone, and adding a surfactant such as sodium dodecylbenzene sulfonate, sodium oleoyl-N-methyl taulinate or sodium di(2-ethylhexyl) succinate thereby preparing an emulsified dispersion mechanically. In this case, it is also preferred to add α-methyl styrene oligomer or a polymer such as poly(t-butyl acrylamide), etc. with an aim of controlling the viscosity or the refractive index of the oil droplet.

As solid fine particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, a preservative (for instance, sodium benzoisothiazolinone salt) is added in the water dispersion.

In the invention, furthermore, the reducing agent is preferably used as a solid particle dispersion, and the reducing agent is added in the form of fine particles having average particle size from 0.01 μm to 10 μm, and more preferably, from 0.05 μm to 5 μm, and further preferably, from 0.1 μm to 2 μm. In the invention, other solid dispersions are preferably used with this particle size range.

(Development Accelerator)

The development accelerator is used preferably in the invention.

In the photothermographic material of the invention, sulfoneamide phenolic compounds described in the specification of JP-A No. 2000-267222, and represented by Formula (A) described in the specification of JP-A No. 2000-330234; hindered phenolic compounds represented by Formula (II) described in JP-A No. 2001-92075; hydrazine compounds described in the specification of JP-A No. 10-62895, represented by Formula (I) described in the specification of JP-A No. 11-15116, represented by Formula (D) described in the specification of JP-A No. 2002-156727, and represented by Formula (1) described in the specification of JP-A No. 2002-278017; and phenolic or naphthalic compounds represented by Formula (2) described in the specification of JP-A No. 2001-264929 are used preferably as a development accelerator.

Further, phenolic compounds described in the specifications of JP-A Nos. 2002-311533 and 2002-341484 are also preferred. Particularly, naphtholic compounds described in the specification of JP-A No. 2002-66558 are preferred.

In the invention, the development accelerator is used within a range from 0.1% by mole or more and 20% by mole or less, preferably, within a range of 0.5% by mole or more and 10% by mole or less and, more preferably, within a range from 1% by mole or more and 5% by mole or less.

The introduction method to the sensitive material includes the same method as for the reducing agent and it is particularly preferred to add as a solid dispersion or emulsified dispersion. In a case of addition as the emulsified dispersion, it is preferred to add as an emulsified dispersion dispersed by using a high boiling solvent which is solid at a normal temperature and an auxiliary solvent of low boiling point, or as a so-called oil-less emulsified dispersion not using the high boiling solvent.

In the invention, among the development accelerators described above, hydrazinic compounds described in the specification of JP-A Nos. 2002-156727 and 2002-278017 and naphtholic compounds described in the specification of JP-A No. 2003-66558 are more preferred.

Particularly preferred development accelerators of the invention are compounds represented by the following Formulae (A-1) and (A-2).

$$Q_1\text{-NHNH-}Q_2 \qquad \text{Formula (A-1)}$$

(wherein, $Q_1$ represents an aromatic group or a heterocyclic group coupling at a carbon atom to —NHNH-$Q_2$ and $Q_2$ represents a carbamoyl group, an acyl group, an alkoxycarbonyl group, an aryloxycarbonyl group, a sulfonyl group or a sulfamoyl group).

In Formula (A-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-2,4-tert-pentylphenoxy)propyl} carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by Formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

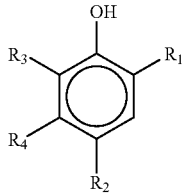

In Formula (A-2), $R_1$ represents an alkyl group, an acyl group, an acylamino group, a sulfoneamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$, $R_4$ each represents a group capable of substituting for a hydrpgen atom on a benzene ring which is mentioned as the example of the substituent for Formula (A-1). $R_3$ and $R_4$ may bond together to form a condensed ring.

$R_1$ is, preferably, an alkyl group having 1 to 20 carbon atoms (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), an acylamino group (including ureido group or urethane group) being more preferred. $R_2$ is, preferably, a halogen atom (more preferably, chlorine atom, bromine atom), an alkoxy group (for example, methoxy group, butoxy group, n-hexyloxy group, n-decyloxy group, cyclohexyloxy group or benzyloxy group), or an aryloxy group (phenoxy group or naphthoxy group).

$R_3$ preferably is a hydrogen atom, a halogen atom or an alkyl group having 1 to 20 carbon atoms, and most preferably a halogen atom. $R_4$ is preferably a hydrogen atom, alkyl group or an acylamino group, and more preferably an alkyl group or an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in Formula (A-2) bond together to form a condensed ring, a naphthalene ring is particularly preferred as the condensed ring. The same substituent as the example of the substituent referred to for Formula (A-1) may bond to the naphthalene ring. In a case where Formula (A-2) is a naphtholic compound, $R_1$, is, preferably, a carbamoyl group. Among them, benzoyl group is particularly preferred. $R_2$ is, preferably, an alkoxy group or an aryloxy group and, particularly, preferably an alkoxy group.

Preferred specific examples for the development accelerator of the invention are to be described below. The invention is not restricted to them.

(A-1)

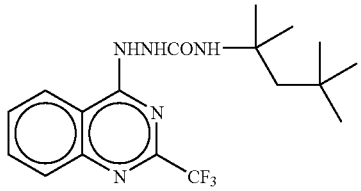

(A-2)

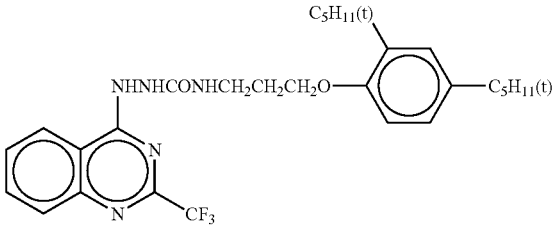

(A-3)

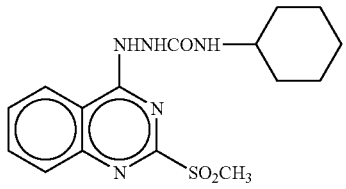

(A-4)

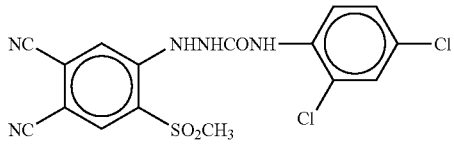

(A-5)

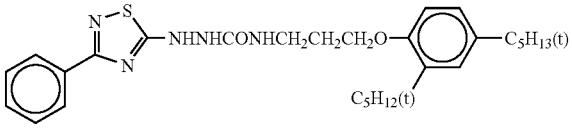

(A-6)

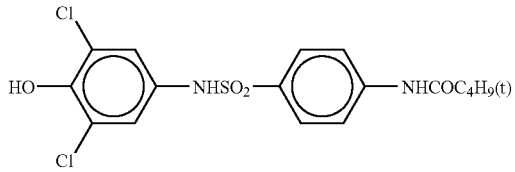

(A-7)

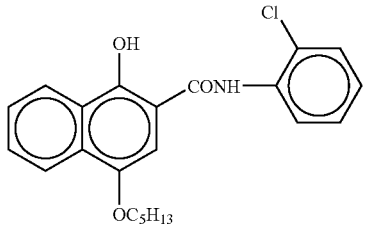

-continued (A-8)

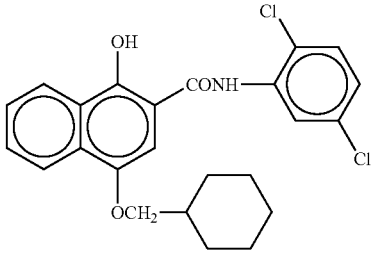

(A-9)

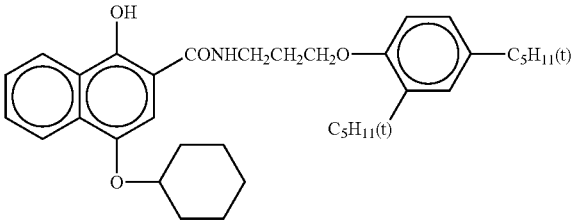

(A-10)

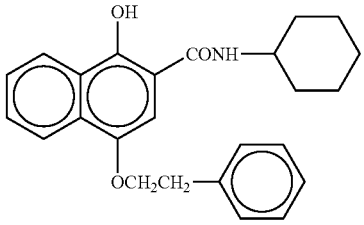

(A-11)

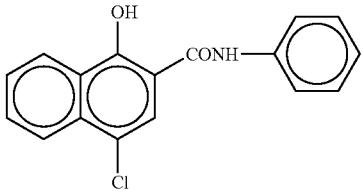

(A-12)

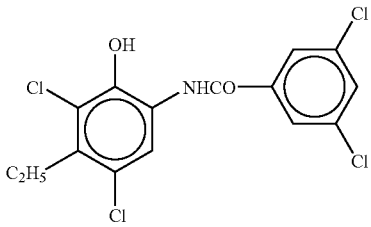

(Hydrogen Bonding Compound)

In the invention, in the case where the reducing agent has an aromatic hydroxyl group (—OH) or an amino group (—NHR, R represents each one of hydrogen atom and alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by Formula (D) shown below.

Formula (D)

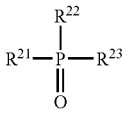

In Formula (D), $R^{21}$ to $R^{23}$ each independently represent an alkyl group, an aryl group, an alkoxy group, an aryloxy group, an amino group, or a heterocyclic group, which may be substituted or not substituted.

In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As aryloxy groups, there can be mentioned phenoxy group, cresyloxy group, isopropylphenoxy group, 4-t-butylphenoxy group, naphthoxy group, biphenyloxy group, and the like.

As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by Formula (D) of the invention and others are shown below, but it should be understood that the invention is not limited thereto.

(D-1)

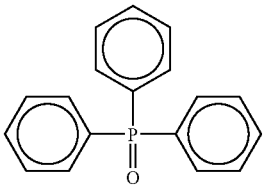

(D-2)

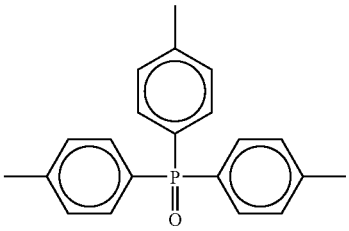

(D-3)

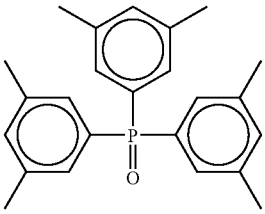

(D-4)

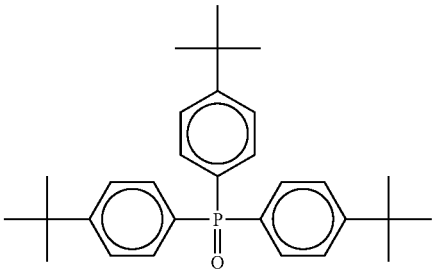

(D-5)

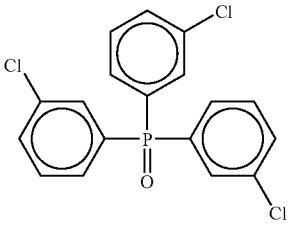

(D-6)

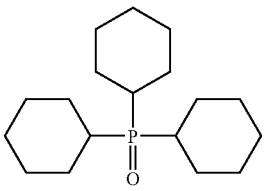

-continued (D-7)

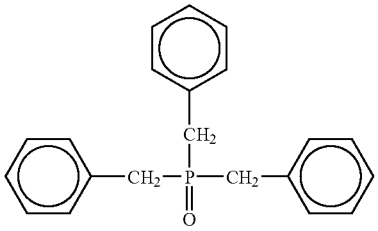

(D-8)

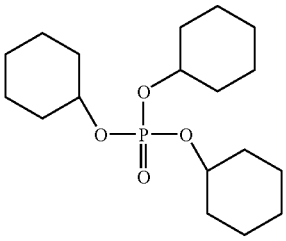

(D-9)

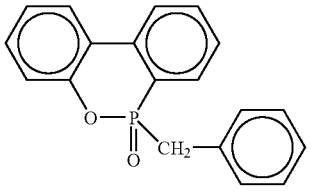

(D-10)

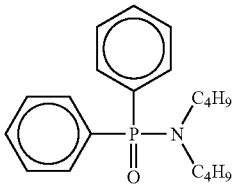

(D-11)

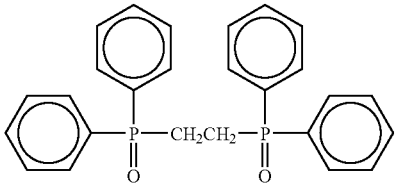

(D-12)

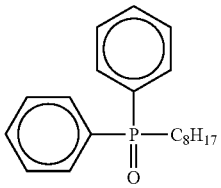

(D-13)

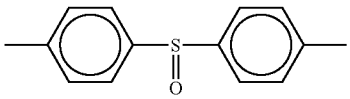

(D-14)

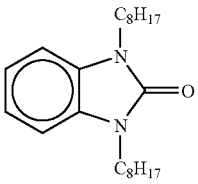

-continued (D-15)

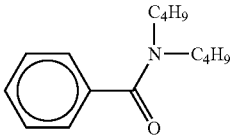

Specific examples of hydrogen bonding compounds other than those enumerated above can be found in those described in EP-A No. 1096310 and in JP-A Nos. 2002-156727 and 2002-318431.

The compound expressed by Formula (D) used in the invention can be used in the photothermographic material by being incorporated into the coating solution in the form of solution, emulsion dispersion, or solid fine particle dispersion similar to the case of reducing agent, however, it is preferred to be used in the form of solid dispersion. In the solution, the compound expressed by Formula (D) forms a hydrogen-bonded complex with a compound having a phenolic hydroxyl group or an amino group, and can be isolated as a complex in crystalline state depending on the combination of the reducing agent and the compound expressed by Formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by Formula (D) in the form of powders and dispersing them with a proper dispersion agent using sand grinder mill and the like.

The compound expressed by Formula (D) is preferably used in the range from 1% by mole to 200% by mole, more preferably from 10% by mole to 150% by mole, and further preferably, from 20% by mole to 100% by mole, with respect to the reducing agent.

(Description for Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Particle Forming Method

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Particle Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projection area of the silver halide grain (projection area of a main plane in a case of a tabular grain).

4) Particle Shape

The shape of the silver halide grain can include, for example, cubic, octahedral, tabular, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index [100] face can be determined by the method of utilizing the adsorption dependency of [111] face and [100] face upon adsorption of a sensitizing dye described by T. Tani; in J. Imaging Sci., vol. 29, page 165 (1985).

5) Heavy Metal

The photosensitive silver halide grain of the invention can contain metals or complexes of metals belonging to groups 6 to 10 of the periodic table (showing groups 1 to 18). The metal or the center metal of the metal complex from groups 6 to 10 of the periodic table is preferably iron, rhodium, ruthenium or iridium. The metal complex may be used alone, or two or more kinds of complexes comprising identical or different species of metals may be used together. A preferred content is in the range from $1\times10^{-9}$ mol to $1\times10^{-3}$ mol per one mol of silver. The heavy metals, metal complexes and the addition method thereof are described in JP-A No. 7-225449, in paragraph Nos. 0018 to 0024 of JP-A No.11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by mass of an entire amount of silver nitrate to be added for grain formation, more preferably started after addition of 98% by mass and, particularly preferably, started after addition of 99% by mass.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the addition method are disclosed, for example, JP-A No. 11-65021 (paragraph Nos. 0103 to 0109), as a compound represented by the Formula (II) in JP-A No. 10-186572, dyes represented by the Formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of photosensitivity and fogging, but it is preferably added from $10^{-6}$ mol to 1 mol, and more preferably, from $10^{-4}$ mol to $10^{-1}$ mol per one mol of silver in each case.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by Formulae (II), (III), and (IV) in JP-A No. 5-313284 are more preferred.

The photosensitive silver halide grain in the invention is preferably chemically sensitized by gold sensitization method alone or in combination with the chalcogen sensitization described above. As the gold sensitizer, those having an pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per one mol of the silver halide. There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound in Which One-electron Oxidant Formed by One-electron Oxidation can Release One Electron or More Electrons The photothermographic material of the invention preferably contains a compound that can be one-electron-oxidized to provide a one-electron oxidation product which releases one or more electrons. The said compound can be used in combination with various chemical sensitizers described above to increase the sensitivity of silver halide.

As the compound that can be one-electron-oxidized to provide a one-electron oxidation product which releases one or more electrons is a compound selected from the following types 1 to 2.

(Type 1) a compound that can be one-electron-oxidized to provide a one-electron oxidation product, which further releases at least one electron after being subjected to a subsequent bond formation;

(Type 2) a compound that can be one-electron-oxidized to provide a one-electron oxidation product which further releases at least one electron after a subsequent intramolecular ring cleavage reaction.

At first the type 1 compound is described.

The type 1 compound in which a one-electron oxidant formed by one-electron oxidation can further release one electron accompanying succeeding bond-cleavage reaction can includes those compounds which are referred to as "1-photon 2-electron sensitizing agent" or "deprotonating electron donating sensitizing agent" described in patent literatures such as JP-A No. 9-211769 (specific examples: compounds PMT-1 to S-37 described in Table E and Table F in pages 28–32), JP-A Nos. 9-211774, and 11-95355 (specific examples: compounds INV 1 to 36), JP-W No. 2001-500996 (specific examples; compounds 1 to 74, 80 to 87, and 92 to 122), U.S. Pat. Nos. 5,747,235 and 5,747,236, EP Nos. 786692 A1 (specific examples: compounds INV 1 to 35), 893732 A1, and U.S. Pat. Nos. 6,054,260 and 5,994,051. Further, preferred ranges for the compounds are identical with the preferred ranges described in the cited patent specifications.

The type 1 compound in which a one-electron oxidant formed by one-electron oxidation can further release one electron or more electrons accompanying succeeding bond cleavage reaction can include those compounds represented by Formula (1) (identical with Formula (1) described in JP-A No. 2003-114487), Formula (2) (identical with the general Formula (2) described in JP-A No. 2003-114487), the general Formula (3) (identical with the general Formula (1) described in JP-A No. 2003-114488), the general Formula (4) (identical with the general Formula (2) described in JP-A No. 2003-114488), the general Formula (5) (identical with the general Formula (3) described in JP-A No. 2003-114488), the general Formula (6) (identical with the general Formula (1) described in JP-A No. 2003-75950), the general Formula (7) (identical with the general Formula (2)

described in JP-A No. 2003-75950), the general Formula (8) (identical with the general Formula (1) described in Japanese Patent Application No. 2003-25886), and the general Formula (9) (identical with the general Formula (3) described in Japanese Patent Application No. 2003-33446) among the compounds capable of causing reaction represented by the chemical reaction Formula (1) (identical with chemical reaction Formula (1) described in Japanese Patent Application No. 2003-33446). Further, preferred ranges for the compounds are identical with the preferred ranges described in the cited patent specifications.

Formula (1)

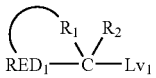

Formula (2)

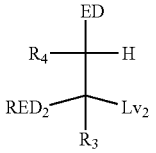

In the general Formulae (1) and (2), $RED_1$ and $RED_2$ each represents a reducing group. $R_1$ represents a group of non-metal atoms capable of forming, together with the carbon atom (C) and $RED_1$, a cyclic structure corresponding to a tetrahydro form or a hexahydro form of a 5-membered or 6-membered aromatic ring (including aromatic heterocyclic ring), $R_2$, $R_3$ and $R_4$ each represents a hydrogen atom or a substituent, $Lv_1$, $Lv_2$ each represents independently a splitting group, and ED represents an electron donating group.]

Formula (3)

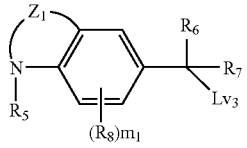

Formula (4)

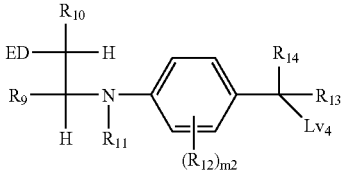

Formula (5)

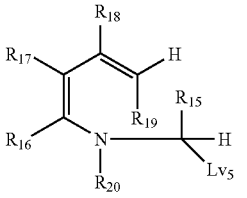

In the general Formulae (3), (4) and (5), $Z_1$ represents a group of atoms capable of forming a 6-membered ring together with a nitrogen atom and two carbon atoms of the benzene ring, $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ each represents independently a hydrogen atom or a substituent, $R_{20}$ represents a hydrogen atom or a substituent, in which $R_{16}$ and $R_{17}$ joined to each other to form an aromatic ring or aromatic heterocyclic ring in a case where $R_{20}$ represents a group other than the aryl group, $R_8$ and $R_{12}$ each represents a substituent capable of substitution on the benzene ring, m1 represents an integer of 0 to 3, m2 represents an integer of 0 to 4, and $Lv_3$, $Lv_4$ and $Lv_5$ each represents a splitting group.

Formula (6)

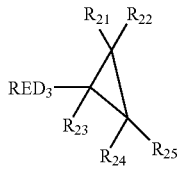

Formula (7)

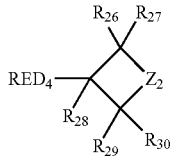

In the general Formulae (6) and (7), $RED_3$ and $RED_4$ each represents a reducing group, $R_{21}$ to $R_{30}$ each represents a hydrogen atom or a substituent, $Z_2$ represents —$CR_{111}$, $R_{112}$—, —$NR_{113}$—, or O—, $R_{111}$ and $R_{112}$ each represents a hydrogen atom or a substituent, and $R_{113}$ represents a hydrogen atom, alkyl group, aryl group or heterocyclic group.

Formula (8)

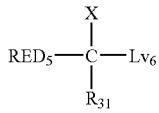

In the general Formula (8), $RED_5$ is a reducing group, which represents an aryl amino group or heterocyclic amino group, $R_{31}$ represents a hydrogen atom or a substituent, X represents an alkoxy group, aryloxy group, heterocyclicoxy group, alkylthio group, arylthio group, heterocyclicthio group, alkylamino group, arylamino group, or heterocyclic amino group, $Lv_6$ is a splitting group which represents a carboxyl group or a salt thereof, or a hydrogen atom.

Chemical reaction Formula (1)

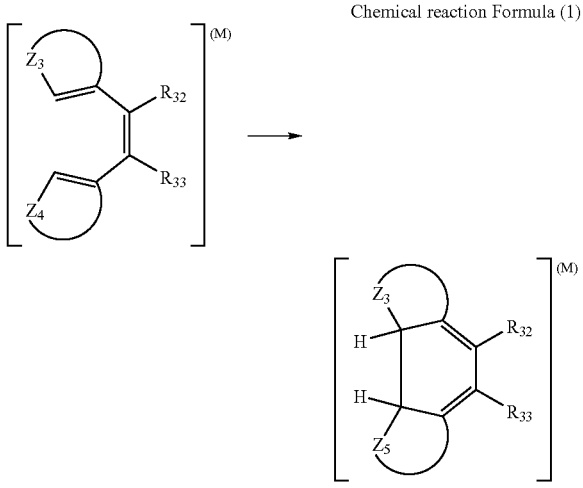

-continued

Formula (9)

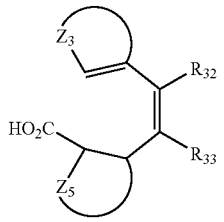

The compound represented by the general Formula (9) is a compound causing bond forming reaction represented by the chemical reaction Formula (1) by further oxidation after 2-electron oxidation accompanying decarbonation. In the chemical reaction Formula (1), $R_{32}$ and $R_{33}$ each represents a hydrogen atom or a substituent, $Z_3$ represents a group forming a 5-membered or 6-membered heterocyclic ring together with C═C, $Z_4$ represents a group forming a 5-membered or 6-membered aryl group or heterocyclic group together with C═C, M represents a radial, radical cation or cation. In the general Formula (9), $R_{32}$ and $R_{33}$, $Z_3$ have the same meanings as those for the chemical reaction Formula (1), $Z_5$ represents a group forming a 5-membered or 6-membered cycloaliphatic hydrocarbon group or heterocyclic group together with C—C.

Then the type 2 compound is to be described.

The type 2 compound in which one-electron oxidant formed by one-electron oxidation can further release one electron or more electrons accompanying succeeding bond forming reaction can include those compounds represented by the general Formula (10) (identical with general Formula (1) described in JP-A No. 2003-140287), and those compounds capable of causing reaction represented by the chemical reaction Formula (1) (identical with the chemical reaction Formula (1) described in Japanese Patent Application No. 2003-33446) represented by the general Formula (11) (identical with general Formula (2) described in Japanese patent Application No. 2003-33446). Preferred ranges for the compounds are identical with preferred ranges described in the cited patent specifications.

$RED_6$-Q-Y Formula (10)

In the general Formula (10), $RED_6$ represents a reducing group subjected to one-electron oxidation, Y represents a reaction group including a carbon-carbon double bond site, carbon-carbon triple bond site, aromatic group site, or a nonaromatic heterocyclic site formed by condensation of benzo ring capable of reacting with one-electron oxidant formed by one-electron oxidation of $RED_6$ to form a new bond, and Q represents a linking group connecting $RED_6$ and Y.

Chemical reaction Formula (1)

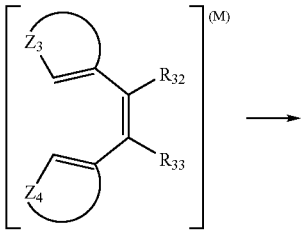

-continued

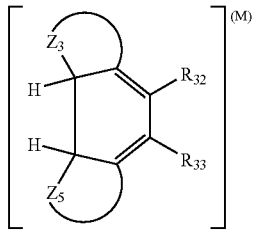

Formula (11)

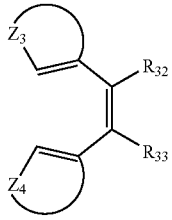

The compound represented by the general Formula (11) is a compound causing the bonding forming reaction represented by the chemical reaction Formula (1) upon oxidation. In the chemical reaction Formula (1), $R_{32}$ and $R_{33}$ each represents a hydrogen atom or a substituent, $Z_3$ represents a group forming a 5-membered or 6-membered heterocyclic group together with C═C, $Z_4$ represents a group forming a 5-membered or 6-membered aryl group or hetercyclic group together with C═C, $Z_5$ represents a group forming a 5-membered or 6-membered cycloaliphatic hydrocarbon group or heterocyclic group together with C—C, and M represents a radial, radical cation or cation. In the general Formula (11), $R_{32}$, $R_{33}$, $Z_3$, $Z_4$ have the same meanings as those for the chemical reaction (1).

Among the type 1 and type 2 compounds, preferred are "compound having an adsorptive group to silver halide in the molecule" or "compound having a partial structure of a spectral sensitizing dye in the molecule". A typical absorptive group to the silver halide is a group described in the specification of JP-A No. 2003-156823, page 16, right column, line 1 to page 17, right column, line 12. The partial structure for the spectral sensitizing dye is a structure described in the above-mentioned specification, page 17, right column, line 34 to page 18, left column, line 6.

Among the type 1 and type 2 compounds, more preferred are "compound having at least one adsorptive group to silver halide in the molecule" and, further preferably, "compound having two or more absorptive groups to silver halide in the identical group". In a case where two or more absorptive groups are present in a single molecule, the absorptive groups may be identical or different with each other.

Preferred adsorptive groups can include a mercapto-substituted nitrogen-containing heterocyclic group (for example, 2-mercaptothiadiazole group, 3-mercapto-1,2,4-triazole group, 5-mercaptotetrazole group, 2-mercapto-1,3,4-oxathiazole group, 2-mercaptobenzoxazole group, 2-mercaptobenzthiazole group, 1,5-dimethyl-1,2,4-triazolium-3-thiorate group, etc.), or a nitrogen-containing hetero-ring group having —NH— group capable of forming imino silver (>NAg) as a partial structure of the heterocyclic (for example, benzotriazole group, benzimadazole group, indazole group, etc.). Particularly preferred are 5-mercaptotetrazole group, 3-mercapto-1,2,4-triazole group, and benzotriazole group, and most preferred are 3-mercapto-1,2,4-triazole group and 5-mercaptotetrazole group.

Absorptive group having two or more mercapto groups in the molecule as the partial structure are also particularly preferred. The mercapto group (—SH), in a case where it is tautomerically isomerizable, may form a thion group. Preferred examples of adsorptive groups having two or more mercapto groups as the partial structure (for example, dimercapto substituted nitrogen-containing heterocyclic group) can include a 2,4-dimercaptopyrimidine group, 2,4-dimercaptotriazine group, or 3,5-dimercapto-1,2,4-triazole group.

A quaternary salt structure of nitrogen or phosphorus can also be used preferably as the absorptive group. The quaternary salt structure of nitrogen can include, specifically, an ammonio group (trialkyl ammonio group, dialkylaryl (or heteroaryl) ammonio group, alkyldiaryl (or heteroaryl) ammonio group), or a group containing a nitrogen-containing heterocyclic group containing a quatenarized nitrogen atom. The quaternary salt structure of phosphorus can include a phosphonio group (trialkyl phosphonio group, dialkylaryl or heteroaryl) phosphonio group, alkyldiaryl (or heteroaryl) phosphonio group, an triaryl (or heteroaryl) phosphonio group. More preferably, a quaternary salt structure of nitrogen is used and, further preferably, a 5-membered or 6-membered nitrogen containing aromatic heterocyclic group containing quaternarized nitrogen atom is used. Particularly preferably, a pyridinio group, quinolinio group or isoquinolinio group is used. The nitrogen-containing heterocyclic group containing the quaternarized nitrogen atom may have an optional substituent.

Examples for the counter anion of the quaternary salt can include, for example, halogen ion, carboxylate ion, sulfonate ion, sulfate ion, perchlorate ion, carbonate ion, nitrate ion, $BF_4^-$, $PF_6^-$, and $Ph_4B^-$. In a case where a group having negative charges such as on a carboxylate group exists in the molecule, it may form an intra-molecular salt therewith. As the counter anion not present in the molecule, chlorine ion, bromine ion or methane sulfonate ion is particularly preferred.

The preferred structure of the compound represented by the types 1 and 2 having the quaternary salt structure of nitrogen or phosphorus as the adsorptive group is represented by Formula (X).

$$(P\text{-}Q_1)_i\text{-}R(\text{-}Q_2\text{-}S)_j \qquad \text{Formula (X)}$$

In Formula (X), P and R each represents independently a quaternary salt structure of nitrogen or phosphorus which is not a partial structure of the sensitizing dye, $Q_1$ and $Q_2$ each represents independently a linking group, specifically, a single bond, alkylene group, arylene group, heterocyclic group, —O—, —S—, —$NR_N$—, —C(═O)—, —$SO_2$—, —SO—, —P(═O)— each alone or in combination of such groups. $R_N$ represents a hydrogen atom, alkyl group, aryl group, or heterocyclic group, S represents a residue formed by removing one atom from the compound represented by type (1) or (2), i and j each represents an integer of 1 or greater and are selected within a range of i+j of from 2 to 6. Preferably, i is 1 to 3 and j is 1 to 2 and, more preferably, i is 1 or 2 and j is 1 and, most preferably, i is 1 and j is 1. In the compound represented by Formula (X), the total number of carbon atoms thereof is, preferably, within a range from 10 to 100, more preferably, 10 to 70 and, further preferably, 11 to 60 and, particularly preferably, 12 to 50.

Specific examples for the compounds represented by type 1 and type 2 are set forth below but the invention is not restricted to them.

1

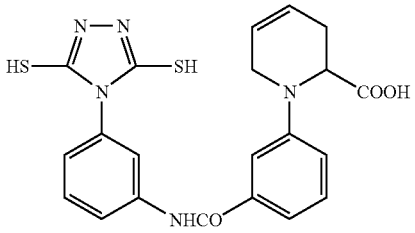

2

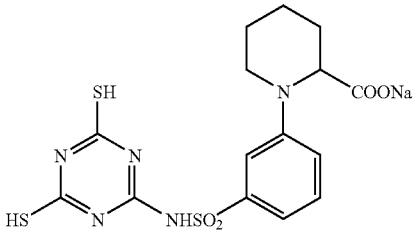

3

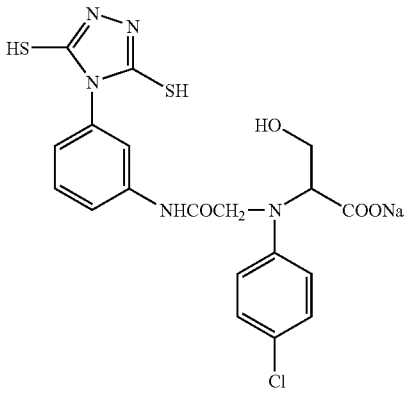

4

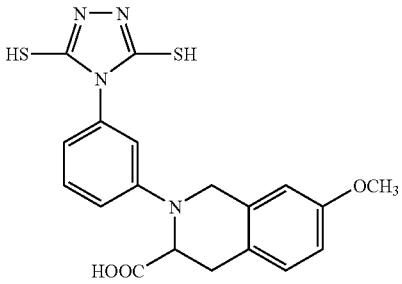

-continued
5
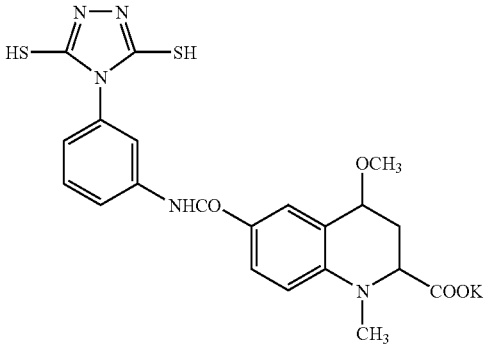
6
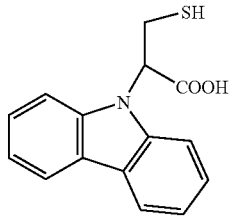
7
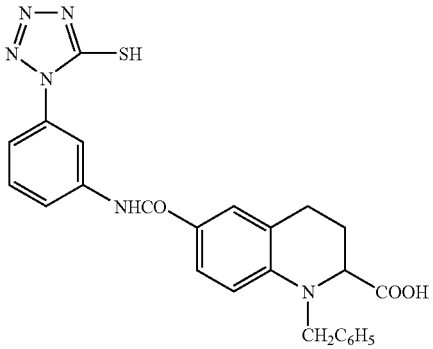
8
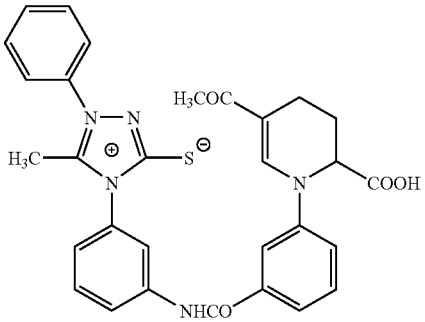
9
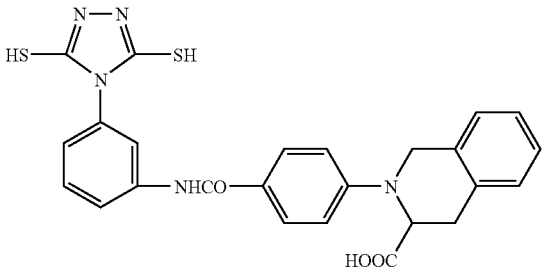
10
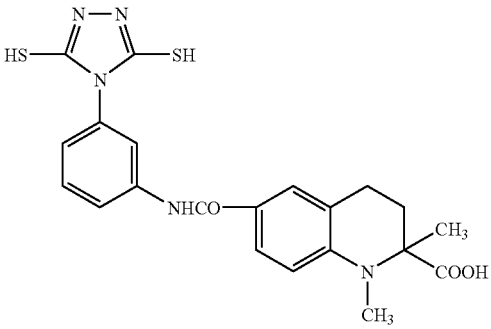
11
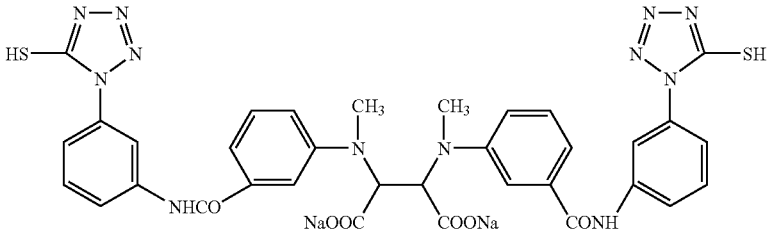
12
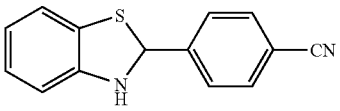
13
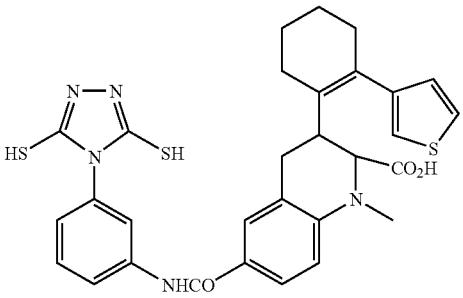

-continued
14
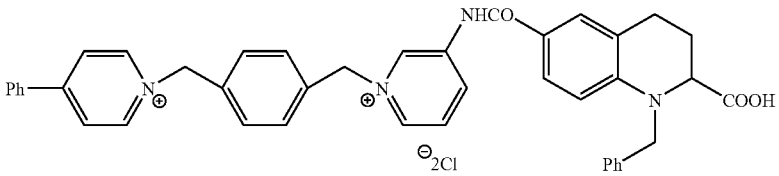
15
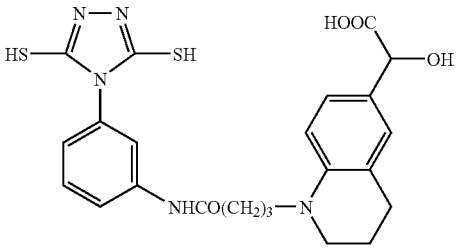
16
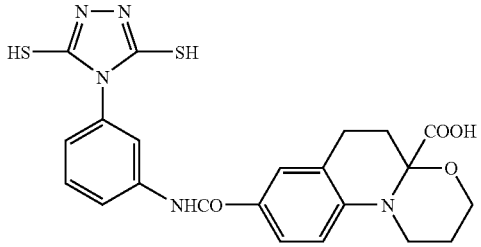
17
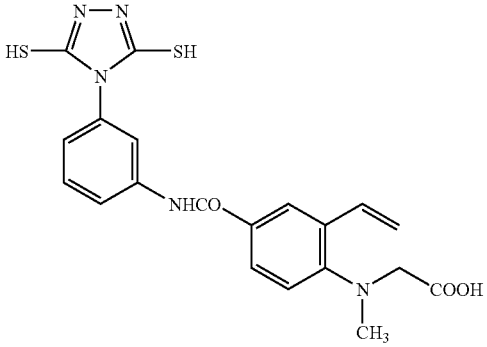
18
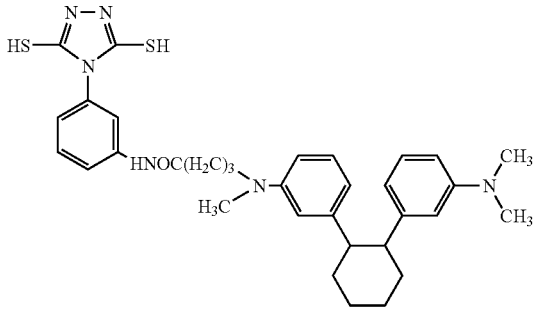
19
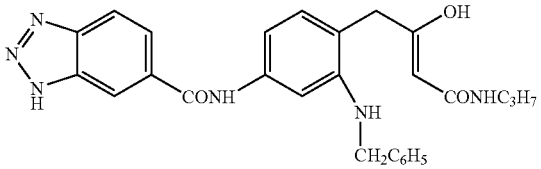
20
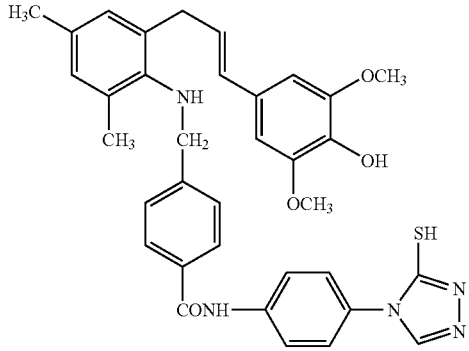
21
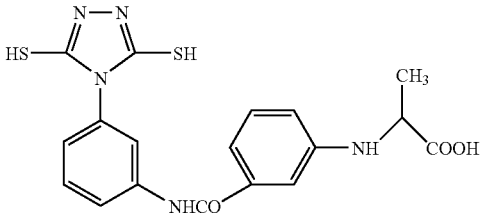
22
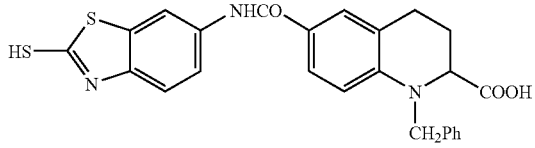

-continued
23
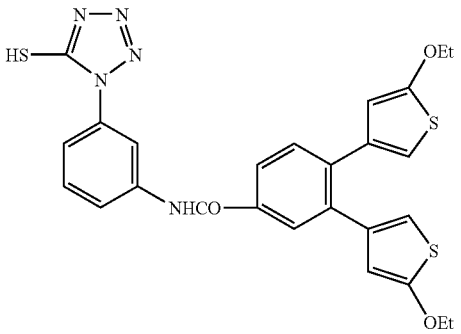
24
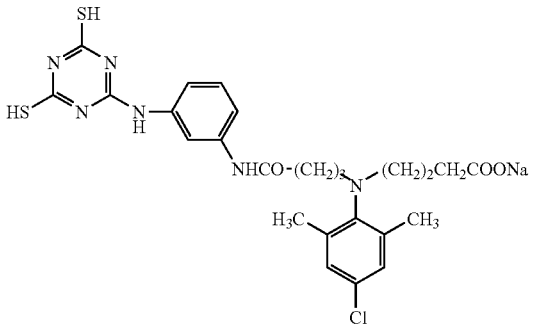
25
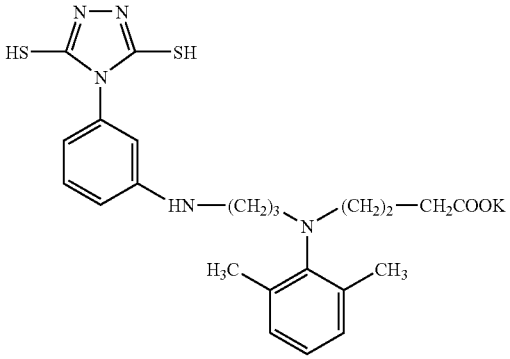
26
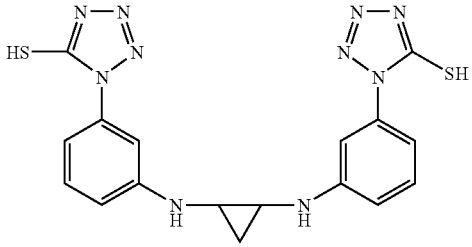
27
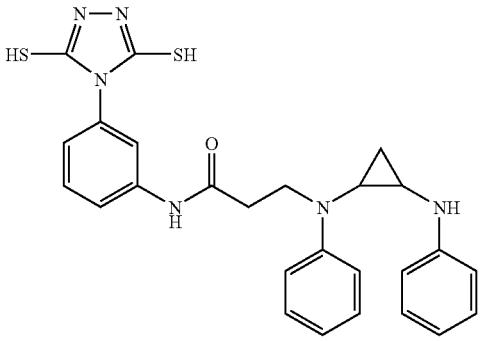
28
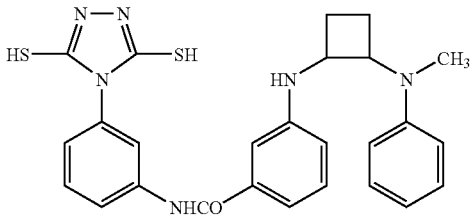
29
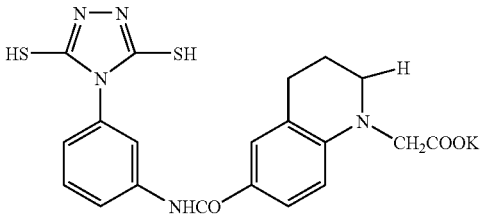
30
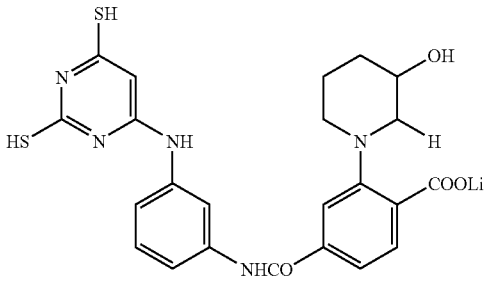

-continued
31
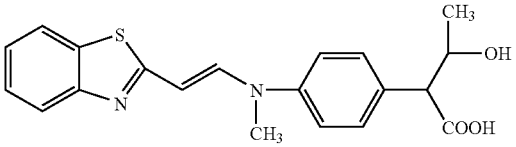
32
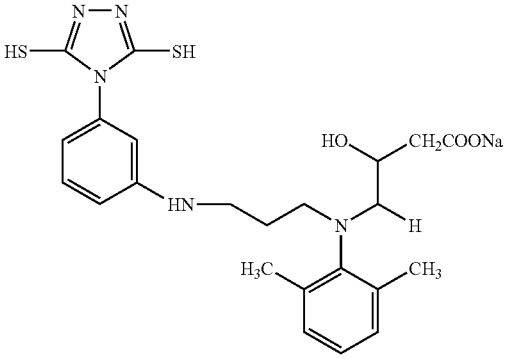
33
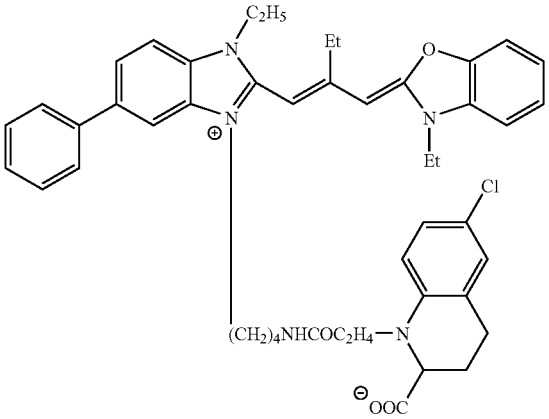
34
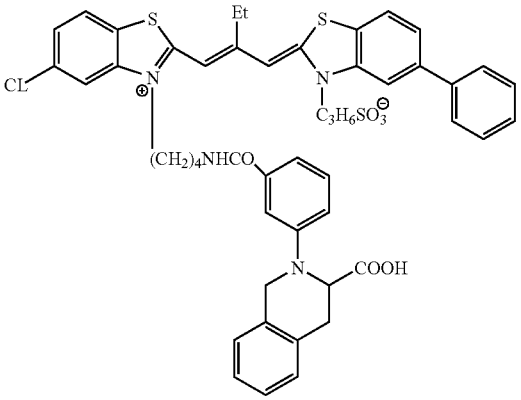
35
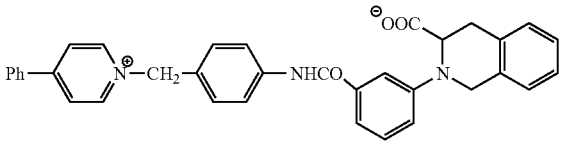
36
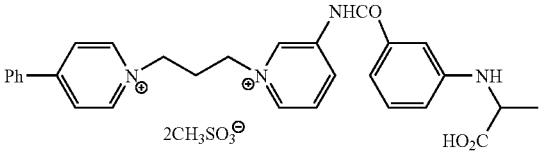
37
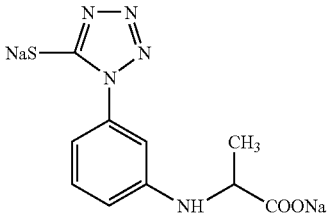
38
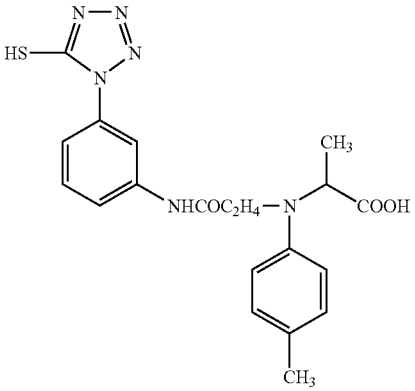

-continued
39
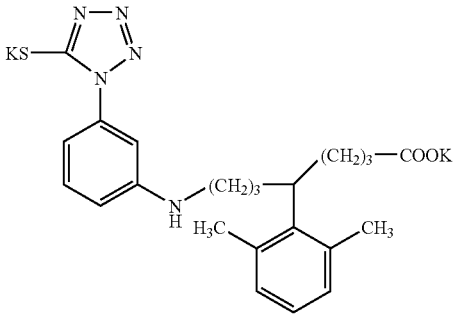
40
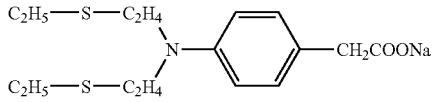
41
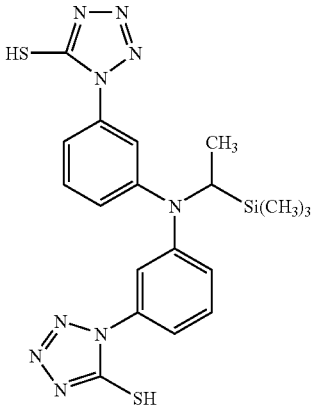
42
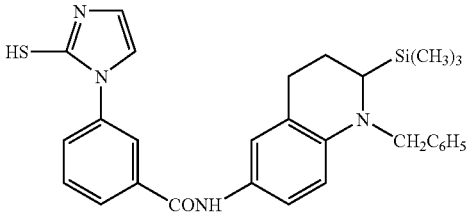
43
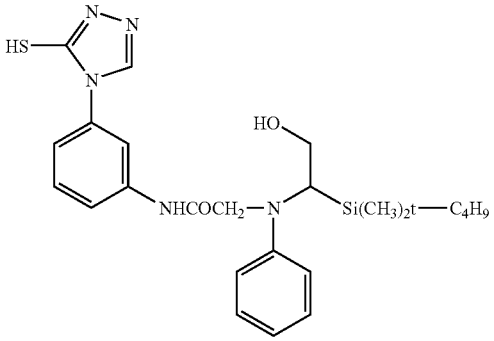
44
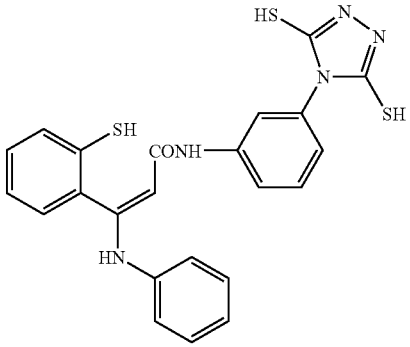
45
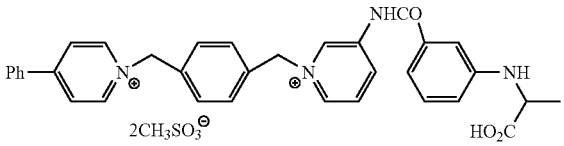
46
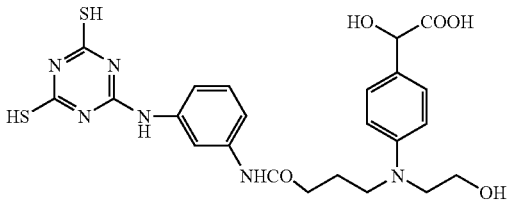
47
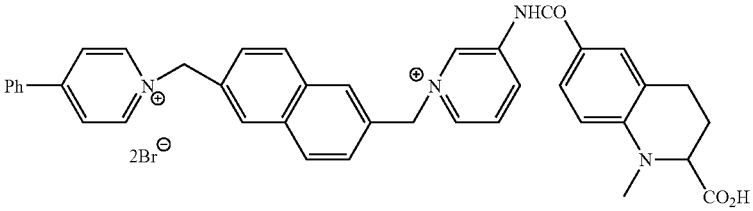
The compound of type 1 or type 2 in the invention may be used at any step during preparation of the emulsion or in the production steps for the photothermographic material. For example, the compound may be used upon formation of particles, during desalting step, during chemical sensitization and before coating. Further, the compound can be added divisionally for plural times during the steps and added, preferably, after the completion for the formation of the particles before the desalting step, during chemical sensitization (Oust before starting to just after completion of chemical sensitization), and before coating and, more preferably, during the chemical sensitization and before coating.

The compounds of type 1 and type 2 in the invention are preferably added being dissolved in water or a water soluble solvent such as methanol or ethanol or a mixed solvent of them. In a case of dissolving in water, a compound the solubility of which is increased by controlling the pH to higher or lower level may be added by dissolution while controlling the pH to a higher or lower level.

The compound of type 1 or type 2 in the invention is preferably used in an emulsion layer (image-forming layer) but it may be added to a protective layer or an intermediate layer as well as to the image-forming layer, and then diffused upon coating. The addition timing of the compound may be either before or after the application of the sensitizing dye and is incorporated in each case in a silver halide emulsion layer at a ratio of, preferably, $1\times10^{-9}$ mol or more and $5\times10^{-2}$ mol or less and, more preferably, $1\times10^{-8}$ mol or more and $2\times10^{-3}$ mol or less per one mol of the silver halide.

10) Adsorptive Redox Compound Having Adsorptive Group and Reducing Group

In the invention, an adsorptive redox compound having the adsorptive group to the silver halide and the reducing group in the molecule is preferably contained. The adsorptive redox compound is preferably a compound represented by the following Formula (I).

$$A\text{-}(W)_n\text{-}B \qquad \text{Formula (I)}$$

In the Formula (I), A represents a group that can be adsorbed to a silver halide (hereinafter referred to as an adsorptive group), W represents a bivalent linking group, n represents 0 or 1 and B represents a reducing group.

The adsorptive group represented by A in Formula (I) is a group directly adsorbing to the silver halide or a group promoting adsorption to the silver halide and it can include, specifically, a mercapto group (or a salt thereof), thion group (—C(═S)—), a heterocyclic group containing at least one atom selected from nitrogen atom, sulfur atom, selenium atom and tellurium atom, sulfide group, disulfide group, cationic group or ethynyl group.

The mercapto group (or a salt thereof) as the adsorptive group means the mercapto group (or a salt thereof) itself, as well as represents, more preferably, a heterocyclic group, aryl group or alkyl group substituted with at least one mercapto group (or the salt thereof). The heterocyclic group includes at least a 5-membered to 7-membered single or condensed aromatic or non-aromatic heterocyclic group, for example, imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group, and triazine ring group. Further, it may also be a heterocyclic group containing a quaternarized nitrogen atom, in which the substituting mercapto group may be dissociated to form a meso ion. When the mercapto group forms a salt, the counter ion can include, for example, a cation of an alkali metal, alkaline earth metal or heavy metal ($Li^+$, $Na^+$, $K^+$, $Mg^{2+}$, $Ag^+$, $Zn^{2+}$), ammonium ion, heterocyclic group containing quaternarized nitrogen atom, or phosphonium ion.

The mercapto group as the adsorptive group may also be tautomerically isomerized into a thion group.

The thion group as the adsorptive group also includes a linear or cyclic thioamide group, thioureido group, thiourethane group or dithiocarbamate ester group.

The heterocyclic group containing at least one atom selected from the nitrogen atom, sulfur atom, selenium atom and tellurium atom as the adsorptive group is a nitrogen-containing heterocyclic group having —NH— group capable of forming imino silver (>NAg) as a partial structure of the heterocyclic ring, or a heterocyclic group having an —S— group, —Se— group, —Te— group or ═N— group that can be coordinated to a silver ion by way of coordination bonding as a partial structure of the heterocyclic ring. Examples of the former can include, for example, benzotriazole group, triazole group, indazole group, pyrazole group, tetrazole group, benzoimidazole group, imidazole group, and purine group, and examples of the latter can include, for example, thiophene group, thiazole group, oxazole group, benzothiophene group, benzothiazole group, benzoxazole group, thiadiazole group, oxadiazole group, triazine group, selenoazole group, benzoselenoazole group, telluazole group, and benzotellurazole group.

The sulfide group or disulfide group as the adsorptive group include all of the groups having the —S— or —S—S— partial structure.

The cationic group as the adsorptive group means a group containing a quaternarized nitrogen atom, specifically, a group containing a nitrogen-containing heterocyclic group containing an ammonio group or quaternarized nitrogen atom. The nitrogen-containing heterocyclic group containing the quaternarized nitrogen atom includes, for example, pyridinio group, quinolinio group, isoquinolinio group, and imidazolio group.

The ethynyl group as the adsorptive group means —C≡CH group wherein the hydrogen atom may be substituted.

The adsorptive group may have an optional substituent.

Further, specific examples of the adsorptive group includes those described in the specification of JP-A No. 11-95355, in pages 4 to 7.

Preferred adsorptive group represented by A in Formula (I) includes mercapto-substituted heterocyclic group (for example, 2-mercaptothiadiazole group, 2-mercapto-5-aminothiadiazole group, 3-mercapto-1,2,4-triazole group, 5-mercaptotetrazole group, 2-mercapto-1,3,4-oxadiazole group, 2-mercaptobenzimidazole group, 1,5-dimethyl-1,2,4-triazolium-3-thiorate group, 2,4-dimercapto pyrimidine group, 2,4-dimercapto triazine group, 3,5-dimercapto-1,2,4-triazole group, and 2,5-dimercapto-1,3-thiazole), or a nitrogen-containing heterocyclic group having —NH— group capable of forming imino silver (>NAg) as a partial structure of the heterocyclic ring (for example, benzotriazole group, benzimidazole group, and indazole group). More preferred adsorptive groups are 2-mercaptobenzimidazole group and 3,5-dimercapto-1,2,4-triazole group.

In Formula (I), W represents a bivalent linking group. Any linking group may be used so long as it does not give undesired effects on photographic properties. For example, bivalent linking groups constituted with carbon atom, hydrogen atom, oxygen atom, nitrogen atom or sulfur atom can be utilized. They include, specifically, alkylene group of 1 to 20 carbon atoms (for example, methylene group, ethylene group, trimethylene group, tetramethylene group, and hexamethylene group), alkenylene group of 2 to 20 carbon atoms, alkynylene group of 2 to 20 carbon atoms, arylene group of 6 to 20 carbon atoms (for example, phenylene group and naphthylene group), —CO—, —$SO_2$—, —O—, —S—, and —$NR_1$— and combination of such linking groups, wherein $R_1$ represents a hydrogen atom, alkyl group, heterocyclic group, or aryl group.

The substituent represented by W may further has an optional substituent.

In Formula (I), the reducing group represented by B represents a group capable of reducing silver ion and includes, for example, residues derived by removing one hydrogen atom, from formyl group, amino group, triple bond group such as an acetylene group or propargyl group, mercapto group, hydroxylamines, hydroxamic acids, hydroxy ureas, hydroxy urethanes, hydroxy semicarbazides, reductones (including reductone derivatives), anilines, phenols (including chroman-6-ols, 2,3-dihydrobenzofuran-5-ols, aminophenols, sulfulamide phenols, and polyphenols such as hydroquinones, catechols, resorcinols, benzene triols and bisphenols), acyl hydrazines, carbamoyl hydrazides, and 3-pyrazolidone. They may have an optional substituent.

In Formula (I), the oxidation potential of the reducing agent represented by B can be measured by a measuring method described in "Electrochemical Measuring Method" written by Akira Fujishima (published from Gihodo, pp 150–208) or "Experimental Chemical Course" edited by Chemical Society of Japan, 4th edition (vol. 9, pp 282–344, published from Maruzen). For example, it can be measured by a method of rotational disk volutammetry, specifically, by dissolving a specimen into a solution of methanol: pH 6.5, Britton-Robinson buffer=10%:90% (vol %), passing a nitrogen gas for 10 min, and then measuring at 25° C. under 1000 rpm, and at a sweeping velocity of 20 mV/sec while using a rotational disk electrode (RDE) made of glassy carbon as an operational electrode, using a platinum wire as a counter electrode and using a saturation calomel electrode as a reference electrode. A half-wave potential (E½) can be determined based on the obtained voltamogram.

The oxidation potential of the reducing group represented by B in the invention, when measured by the measuring method described above, is preferably within a range from about −0.3 V to about 1.0 V. More preferably, it is within a range from about −0.1 V to about 0.8 V and, particularly preferably, is within a range from about 0 to about 0.7 V.

The reducing agent represented by B in Formula (1) is preferably a residue, derived by removing one hydrogen atom from, hydroxylamines, hydroxamic acids, hydroxy ureas, hydroxy semi-carbazides, reductones, phenols, acyl hydrazines, carbamoyl hydrazines and 3-pyrazolidones.

The compound of Formula (I) of the invention may also be incorporated with a ballast group or a polymer chain used customarily as additives for static photography such as couplers. Further, the polymer can includes those described, for example, in JP-A No. 1-100530.

The compound of Formula (I) in the invention may be a bis-form or tris-form. The molecular weight of the compound of Formula (I) according to the invention is, preferably, between 100 to 10,000, more preferably, between 120 to 1,000 and, particularly preferably, between 150 to 500.

Compounds of Formula (I) according to the invention are exemplified below but the invention is not restricted to them.

(1)

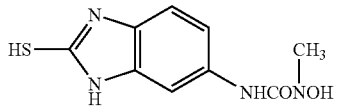

(2)

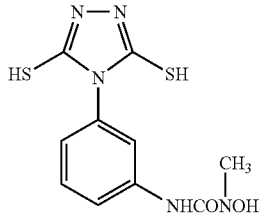

(3)

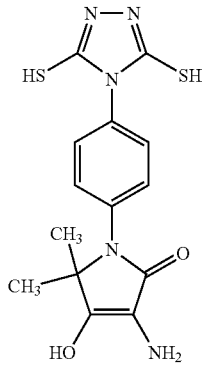

(4)

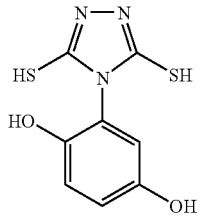

(5)

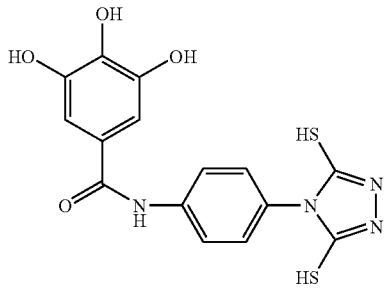

(6)

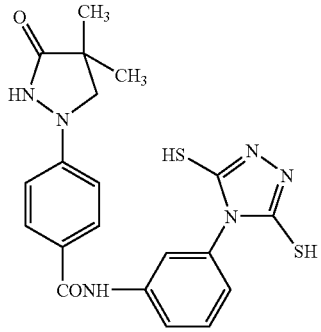

-continued (7)

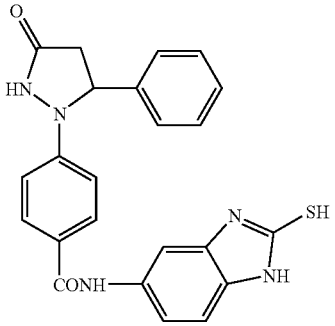

(8)

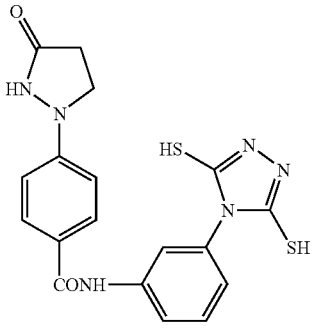

(9)

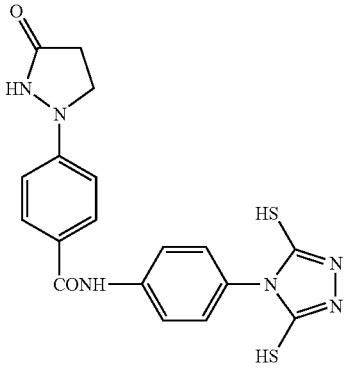

(10)

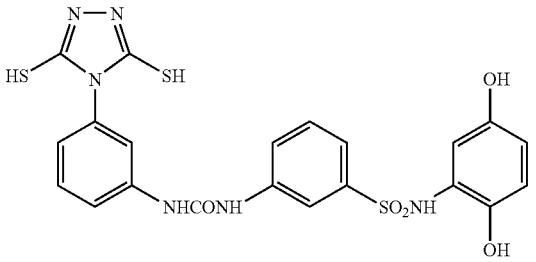

(11)

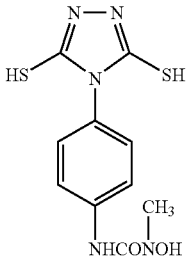

-continued (12)

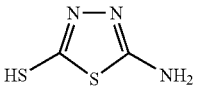

(13)

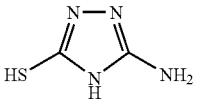

Further, also the specific compounds 1 to 30, 1"-1 to 1"-77 described in the specification of EP No. 13088776A2, pages 73 to 87 can also been mentioned as preferred examples of the compound having the adsorptive group and the reducing group in the invention.

The compounds of the invention can be synthesized easily according to the known method. The compound of Formula (I) in the invention may be used alone as a single kind of compound and it is also preferred to use two or more kinds of compounds together. In a case of using two or more kinds of compounds, they may be added to an identical layer or two separate layers, and the addition methods may be different, respectively.

The compound of Formula (I) according to the invention is preferably added to a silver halide emulsion layer and it is more preferably added upon preparation of the emulsion. In a case of addition upon preparation of the emulsion, it may be added at any step thereof. Examples of addition can include, for example, during the particle forming step of silver halide, before the starting of the desalting step, during desalting step, before the starting of chemical aging, during the chemical aging step and step before preparation of complete emulsion. Further, the compound may be added divisionally for several times during the steps. Further, while it is preferably used for the image-forming layer, it may be added also to the adjacent protective layer or the intermediate layer as well as the image-forming layer, and may be diffused during coating.

A preferred addition amount greatly depends on the addition method described above or species of the compound to be added. It is generally $1\times10^{-6}$ or more and 1 mol or less, preferably, $1\times10^{-5}$ or more and $5\times10^{-1}$ mol or less and, more preferably, $1\times10^{-4}$ or more and $1\times10^{-1}$ mol or less per one mol of the photosensitive silver halide.

The compound of Formula (I) in the invention may be added by being dissolved in water, a water soluble solvent such as methanol or ethanol or a mixed solvent thereof. In this case, pH may be controlled adequately with an acid or base, or a surfactant may be present together. Further, it may be added as an emulsified dispersion being dissolved in a high boiling organic solvent. Further, it may be added also as a solid dispersion.

11) Combined Use of Plural Silver Halides

The photosensitive silver halide emulsion in the photothermographic material used in the invention may be used alone, or two or more kinds of them (for example, those of different average grain sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The coating amount of the photosensitive silver halide, when expressed by the coating amount of silver per one $m^2$ of the photothermographic material, is preferably from 0.03 $g/m^2$ to 0.6 $g/m^2$, more preferably, 0.05 $g/m^2$ to 0.4 $g/m^2$ and, further preferably, 0,07 $g/m^2$ to 0.3 $g/m^2$. The photosensitive silver halide is used by 0.01 mol to 0.5 mol, preferably, 0.02 mol to 0.3 mol, and further preferably 0.03 mol to 0.2 mol per one mol of the organic silver salt.

13) Mixing of Photosensitive Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

14) Mixing of Silver Halide to Coating Solution

In the invention, the time of adding silver halide to the coating solution for the image-forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

(Binder)

Any type of polymer may be used as the binder of the layer containing organic silver salt in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly (vinyl alcohol), hydroxyethyl cellulose, cellulose acetate, cellulose acetate butyrate, poly (vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly (vinyl acetal)(e.g., poly(vinyl formal) and poly(vinyl butyral)), poly(ester), poly(urethane), phenoxy resin, poly (vinylidene chloride), poly(epoxide), poly(carbonate), poly (vinyl acetate), poly(olefin), cellulose esters, and poly(amide). A binder may be used with water, an organic solvent or emulsion to form a coating solution.

In the invention, the glass transition temperature (Tg) of the binder of the layer including organic silver salts is preferably from 0° C. to 80° C., more preferably, from 10° C. to 70° C., and further preferably, from 15° C. to 60° C.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder maybe of two or more kinds of polymers, if necessary. And, the polymers having Tg outside the range may be used in combination. In a case where two types or more of polymers differing in Tg may be blended for use, it is preferred that the weight-average Tg is in the range mentioned above.

In the invention, it is preferred that the layer containing organic silver salt is formed by first applying a coating solution containing 30% by mass or more of water in the solvent and by then drying.

In the case the layer containing organic silver salt is formed by first applying a coating solution containing 30% by mass or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by mass or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by mass or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under 25° C. and 60\%}RH=[(W1-W0)/W0]\times 100(\text{\% by mass})$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by mass or lower, but is more preferably, 0.01% by mass to 1.5% by mass, and is most preferably, 0.02% by mass to 1% by mass.

The binders used in the invention are, particularly preferably, polymers capable of being dispersed in aqueous solvent. Examples of dispersed states may include a latex, in which water-insoluble fine particles of hydrophobic polymer are dispersed, and such in which polymer molecules are dispersed in molecular states or by forming micelles, but preferred are latex-dispersed particles. The average particle size of the dispersed particles is in the range from 1 nm to 50,000 nm, preferably 5 nm to 1,000 nm, more preferably 10 nm to 500 nm, and further preferably 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image-forming layer, and those having too large molecular weight are also not preferred because the filming properties result poor. Further, crosslinking polymer latexes are particularly preferred for use.

(Specific Example of Latex)

Specific examples of preferred polymer latex are given below, which are expressed by the starting monomers with % by mass given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

NP-1: Latex of -MMA(70)-EA(27)-MAA(3)-(molecular weight 37000, Tg 61° C.)

NP-2: Latex of -MMA(70)-2EHA(20)-St(5)-AA(5)-(molecular weight 40000, Tg 59° C.)

NP-3: Latex of -St(50)-Bu(47)-MAA(3)-(crosslinking, Tg—17° C.)

NP-4: Latex of -St(68)-Bu(29)-AA(3)-(crosslinking, Tg 17° C.)

NP-5: Latex of -St(71)-Bu(26)-AA(3)-(crosslinking, Tg 24° C.)

NP-6: Latex of -St(70)-Bu(27)-IA(3)-(crosslinking),

NP-7: Latex of -St(75)-Bu(24)-AA(1)-(crosslinking, Tg 29° C.).

NP-8: Latex of -St(60)-Bu(35)-DVB(3)-MAA(2)-(crosslinking),

NP-9: Latex of -St(70)-Bu(25)-DVB(2)-AA (3)-(crosslinking),

NP-10: Latex of -VC(50)-MMA(20)-EA(20)-AN(5)-AA (5)-(molecular weight 80000),

NP-11: Latex of -VDC(85)-MMA(5)-EA(5)-MAA(5)-(molecular weight N67000),

NP-12: Latex of -ET(90)-MMA(10)-(molecular weight 12000),

NP-13: Latex of -St(70)-2EHA(27)-AA(3)-(molecular weight 130000, Tg 43° C.)

NP-14: Latex of MMA(63)-EA(35)-AA(2)-(molecular weight of 33000, Tg 47° C.),

NP-15: Latex of -St(70.5)-Bu(26.5)-AA(3)-(crosslinking, Tg 23° C.),

NP-16: Latex of -St(69.5)-Bu(27.5)-AA(3)-(crosslinking, Tg 20.5° C.)

NP-17: Latex of -St(61.3)-isoprene(35.5)-AA(3)-(crosslinking, Tg 17° C.)

NP-18: Latex of -St(67)isoprene(28)-Bu(2)-AA(3)-(crosslinking, Tg 27° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

(Preferred Latex)

Particularly preferable as the polymer latex for use in the invention is that of styrene-butadiene copolymer. The weight ratio of monomer unit for styrene to that of butadiene constituting the styrene-butadiene copolymer is preferably in the range from 40:60 to 95:5. Further, the monomer unit of styrene and that of butadiene preferably account for 60% by mass to 99% by mass with respect to the copolymer. Moreover, the polymer latex of the invention contains acrylic acid or methacrylic acid, preferably, in the range from 1% by mass to 6% by mass, and more preferably, from 2% by mass to 5% by mass, with respect to the total weight of the monomer unit of styrene and that of butadiene. The preferred range of the molecular weight is similar to that described above.

The latex of the styrene-butadiene copolymer preferably used in the invention includes, for example, P-3 to P-9, 15 described above, and LACSTAR-3307B, 7132C, and Nipol Lx416 as commercial products. Examples of the styrene-isoprene copolymer includes P-16, 17 described above.

In the layer containing organic silver salt of the photothermographic material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by mass or less, preferably 20% by mass or less, with respect to the total weight of the binder incorporated in the layer containing organic silver salt.

According to the invention, the layer containing organic silver salt (image-forming layer) is preferably formed by using polymer latex for the binder. According to the amount of the binder of the layer containing organic silver salt, the weight ratio for total binder to organic silver salt (total binder/organic silver salt) is preferably in the range of 1/10 to 10/1, more preferably 1/3 to 5/1, and further preferably 1/1 to 3/1.

The layer containing organic silver salt is, in general, a photosensitive layer (image-forming layer) containing a photosensitive silver halide, i.e., the photosensitive silver salt; in such a case, the weight ratio for total binder to silver halide (total binder/silver halide) is in the range from 400 to 5, more preferably, from 200 to 10.

The total amount of binder in the image-forming layer of the invention is preferably in the range from 0.2 $g/m^2$ to 30 $g/m^2$, more preferably from 1 $g/m^2$ to 15 $g/m^2$, and further preferably from 2 $g/m^2$ to 10 $g/m^2$. As for the image-forming layer of the invention, there may be added a crosslinking agent for crosslinking, or a surfactant and the like to improve coating properties.

(Solvent for Preferred Coating Solution)

A solvent for the image-forming layer coating solution of the photosensitive material in the invention (for the sake of simplicity, the solvent and the dispersant are collectively referred to as the solvent) is preferably an aqueous solvent containing 30% by mass or more of water. As the ingredient other than water, any water miscible organic solvent such as methyl alcohol, ethyl alcohol, isopropyl alcohol, methyl cellosolve, ethyl cellosolve, dimethyl formamide, and ethyl acetate may be used. The water content in the solvent for the coating solution is, preferably, 50% by mass or more and, more preferably, 70% by mass or more. Examples of the preferred solvent composition include, in addition to water, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5 (numerical value based on % by mass).

(Description for Heat Solvent)

In this invention, a heat solvent can be incorporated in the photothermographic material. The heat solvent is defined as a material capable of lowering the heat developing temperature by more than 1° C. for the heat solvent-containing photothermographic material compared with the photothermographic material not containing the heat solvent. More preferably, this is a material capable of lowering the heat developing temperature by more than 2° C. and, particularly, preferably, it is a solvent capable of lowering the temperature by more than 3° C. For example, when a photothermographic material not containing a heat solvent being removed from a photothermographic material A containing the heat solvent relative to the photothermographic material A is assumed as B, in a case where the heat developing temperature is 119° C. or lower for obtaining a density by exposing the photothermographic material B and putting it to a heat developing temperature of 120° C. for a heat developing time of 20 sec by the photothermographic material A with the identical exposure amount and heat developing time, the solvent is defined as the heat solvent.

By the addition of the heat solvent, since the developing speed is improved, the apparent sensitivity can be improved, whereas it is more liable to undergo the effects of the external circumstance (state of storage, etc.). However, with the layer constitution of the invention, it is less liable to undergo the effects of the external circumstance.

The heat solvent of the invention has a polar group as a substituent and is preferably represented by the Formula (1), but it is not limited thereto.

$$(Y)nZ \qquad \text{Formula (1)}$$

In the Formula (1), Y represents an alkyl group, alkenyl group, alkenyl group, alkinyl group, aryl group or heterocyclic group. Z represents a group selected from the group consisting of a hydroxyl group, carboxy group, amino group, amide group, sulfoneamide group, phosphoric amide group, cyano group, imide, ureido, sulfoxide, sulfone, phosphine, phosphineoxide or a nitrogen-containing heterocyclic group. n is an integer of from 1 to 3, which is 1 when Z represents a monovalent group, and is identical with the valency of Z when Z represents a bivalent or higher valent group. When n is 2 or greater, a plurality of Y may be identical or different with each other.

Y may further have a substituent, and may have a group represented by Z as a substituent.

Y is to be explained more specifically. In the Formula (1), Y represents a linear, branched or cyclic alkyl group (preferably of from 1 to 40 carbon atoms, more preferably, from 1 to 30 carbon atoms, particularly from 1 to 25 carbon atoms, including, for example, methyl, ethyl, n-propyl, iso-propyl, sec-butyl, t-butyl, t-octyl, n-amyl, t-amyl, n-dodecyl, n-tridecyl, octadecyl, icosyl, docosyl, cyclopentyl, cyclohexyl, etc.), alkenyl group (preferably from 2 to 40 carbon atoms, more preferably, from 2 to 30 carbon atoms, particularly preferably from 2 to 25 carbon atoms, and including, for example, vinyl, alkyl, 2-butenyl, 3-pentenyl, etc.), aryl group (preferably of from 6 to 40 carbon atoms, more preferably, from 6 to 30 carbon atoms, particularly, preferably, from 6 to 25 carbon atoms including, for example, phenyl, p-methylphenyl, naphthyl, etc), a heterocyclic group (preferably, from 2 to 20 carbon atoms, more preferably, from 2 to 16 carbon atoms, particularly, from 2 to 12 carbon atoms, including, for example, pyridyl, pirazyl, imidazoyl, pirrolidyl, etc.). Those substituents may further be substituted with other substituents. Further, those substituents may join with each other to from a ring.

Y may further have a substituent, and examples of the substituent include a halogen atom (fluorine atom, chlorine atom, bromine atom or iodine atom), an alkyl group (linear, branched, or cyclic alkyl group including a bicycloalkyl group and active methine), an alkenyl group, alkinyl group, aryl group, heterocyclic group (irrespective of the position for the substitution), acyl group, alkoxycarbonyl group, aryloxycarbonyl group, heterocyclic oxycarbonyl group, carbamoyl group, N-acylcarbamoyl group, N-sulfonyl carbamoyl group, N-carbmoylcarbamoyl group, thiocarbamoyl group-, N-sulfamoylcarbamoyl group, carbazoyl group, carboxy group or a salt thereof, oxalyl group, oxamoyl group, cyano group, carbonimidoyl group, formyl group, hydroxyl group, alkoxy group (including groups containing repetitive ethyleneoxy groups or propyleneoxy groups), aryloxy group, heterocyclicoxy group, acyloxy group, (alkoxy or aryloxy)carbonyloxy group, carbamoyloxy group, sulfonyloxy group, amino group, (alkyl, aryl or heterocyclic)amino group, acylamino group, sulfoneamide group, ureido group, thioureido group, imide group, (alkoxy or aryloxy)carbonylamino group, sulfamoylamino group, semicarbazido group, thiosemicarbazido group, ammonio group, oxamoylamino group, N-(alkyl or aryl)sulfonylureido group, N-acylureido group, N-acylsulfamoylamino group, nitro group, heterocyclic group having a quaternarized nitrogen atom (for example, piridinio group, imidazolio group, quinolinio group, isoquinolinio group), isocyano group, imino group, marcapto group, (alkyl, aryl or heterocyclic)thio group, (alkyl, aryl or heterocyclic)dithio group, (alkyl or aryl) sulfonyl group, (alkyl or aryl)sulfinyl group, sulfo group or a salt thereof, sulfamoyl group, N-acylsulfamoyl group, N-sulfonylsulfamoyl group or a salt thereof, phosphino group, phosphinyl group, phosphyinyloxy group, phosphynyl amino group, silyl group, etc. The active methine group herein means a methine group substituted with two electron attracting groups, where the electron attracting group means an acyl group, alkoxycarbonyl group, aryloxycarbonyl group, carbamoyl group, alkylsulfonyl group, arylsulfonyl group, sulfamoyl group, trifluoromethyl group, cyano group, nitro group, and carbonimidoyl group. The two electron attracting groups may join with each other to form a cyclic structure. The salt means cations such as of alkali metal, alkaline earth metal and heavy metal, and organic cations such as ammonium ion, phosphonium ion, etc. Such substituents may further be substituted with such substituents. Y may further have a group represented by Z as a substituent.

It is considered that the heat solvent develops the effect of the invention because the heat solvent is melted about at the developing temperature so that it becomes compatible with a material concerning the development, and this enables the reaction at a temperature lower than a case where the heat solvent is not added. Since the heat development is a reducing reaction concerning a carboxylic acid and a silver ion transportation body having a relatively high polarity, it is preferred to form a reaction site having an appropriate polarity formed by the heat solvent having a polar group.

While the melting point of the heat solvent according to the invention is 50° C. or higher and 200° C. or lower, it is preferably 60° C. or higher and 150° C. or lower. In particular, in a case of a photothermographic material attaching an importance on the stability relative to the external circumstance such as image storability, a heat solvent having a melting point of 100° C. or higher and 150° C. or lower is preferred.

Specific examples of the heat solvent of the invention are shown below, however, the content of the invention is not limited to them. Those contained in brackets show melting points.

N-methyl-N-nitroso-p-toluene sulfone amide (61° C.), 1,8-octanediol (62° C.), phenyl benzoate (67 to 71° C.), hydroquinone diethyl ether (67 to 73° C.), ϵ-captolactam (68 to 70° C.), diphenyl phosphate (68 to 70° C.), (±)-2-hydroxyoctanoic acid (68 to 71° C.), (±)-3-hydroxydodecanoic acid (68 to 71° C.), 5-chloro-2-methylbenzothiazole (68 to 71° C.), β-naphthyl acetate (68 to 71° C.), batylalchol (68 to 73° C.), (±)-2-hydroxydecanoic acid (69 to 72° C.), 2,2,2-trifluoroacetoamide (69 to 72° C.), pyrazol (69° C.), (±)-2-hydroxyundecanoic acid (70 to 73° C.), N,N-diphenylformamide (71 to 72° C.), dibenzyldisulfide (71 to 72° C.), (±)-3-hydroxyundecanoic acid (17 to 74° C.), 2,2'-dihydroxy-4-methoxybenzophenone (71° C.), 2,4-dinitrotoluene (71° C.), 2,4-dimethoxybenzaldehyde(71° C.), 2,6-di-t-butyl-4-methylphenol (71° C.), 2,6-dichlorobenzaldehyde (71° C.), diphenylsulfoxide (71° C.), stearic acid (71° C.), 2,5-dimethoxynitrobenzene (72 to 73° C.), 1,10-decanediol (72 to 74° C.), (R)-(−)-3-hydroxytetradecanoic acid (72 to 75° C.), 2-tetradecylhexadecanoic acid (72 to 75° C.), 2-methoxynaphthalene (72 to 85° C.), methyl 3-hydroxy-2-naphthoate (72 to 76° C.), tristearin (73.5° C.), dotriacontane (74 to 75° C.), flavanone (74 to 78° C.), 2,5-diphenyl oxazole (74° C.), 8-quinolinol (74° C.), o-chlorobenzyl alcohol (74° C.), oleic amide (75 to 76° C.), (±)-2-hydroxydodecanoic acid (75 to 78° C.), n-hexatriacontane (75 to 79° C.), iminodiacetonitrile (75 to 79° C.), p-chlorobenzyl alcohol (75° C.), diphenyl phthalate (75° C.), N-methylbenzamide (76 to 78° C.), (±)-2-hydroxy tridacanoic acid (76 to 79° C.), 1,3-diphenyl-1,3-propanedione (76 to 79° C.), N-methyl-p-toluene sulfoneamide (76 to 79° C.), 3'-nitroacetophenone (76 to 80° C.), 4-phenyl cyclohexanone (76 to 80° C.), eicosanoic acid (76° C.), 4-chlorobenzophenone (77 to 78° C.), (±)-3-hydroxytetradecanoic acid (77 to 80° C.), 2-hexadecyl octadecanoic acid (77 to 80° C.), p-nitrophenyl acetate (77 to 80° C.), 4'-nitroacetophenone (77 to 81° C.), 12-hydroxy stearic acid (77° C.), α,α'-dibromo-m-xylene (77° C.), 9-methyl anthracene (78 to 81° C.), 1,4-cyclohexaniedione (78° C.), m-diethylaminophenol (78° C.), m-methyl nitrobenzoate (78° C.), (±)-2-hydroxy tetradecanoic acid (79 to 82° C.), 1-(phenylsulfonyl)indole (79° C.), di-p-tolylmethane (79° C.), propioneamide (79° C.), (±)-3-hydroxytridecanoic acid (80 to 83° C.), guaiacol glycerin ether (80 to 85° C.), octanoyl-N-methyl glucamide (80 to 90° C.), o-fluoroacetoanilide (80° C.), aetoacetoanilide (80° C.), docosanoic acid (81 to 82° C.), p-bromobenzophenone (81° C.), triphenyl phosphine (81° C.), dibenzofuran (82.8° C.), (±)-2-hydroxy pentadecanoic acid (82 to 0.85° C.), 2-octadecyl eicosanoic acid (82 to 85° C.), 1,12-dodecanediol (82° C.), methyl 3,4,5-trimethoxy benzoate (83° C.), p-chloronitrobenzene (83° C.), (±)-3-hydroxyhexadecanoic acid (84 to 85° C.), o-hydroxybenzyl alcohol (84 to 86° C.), 1-triacontanol (84 to 88° C.), o-aminobenzyl alcohol (84° C.), 4-methoxybenzyl acetate (84° C.), (±)-2-hydroxyhexadecanoic acid (85 to 88° C.), m-dimethyl aminophenyl (85° C.), p-dibromobenzene (86 to 87° C.), methyl 2,5-dihydroxy benzoate (86 to 88° C.), (±)-3-hydroxypentadecanoic acid (86 to 89° C.), 4-benzyl biphenyl (86° C.), p-fluorophenyl acetic acid (86° C.), 1,14-tetradecanediol (87 to 89° C.), 2,5-dimethyl-2,5-hexanediol (87 to 90° C.), p-pentyl benzoic acid (87 to 91° C.), α-(trichloromethyl) benzyl acetate (88 to 89° C.), 4,4'-dimethylbenzoin (88° C.), diphenyl carbonate (88° C.), m-dinitrobenzene (89.57° C.), (3R, 5R)-(+)-2,6-dimethyl-3,5-heptanediol (90 to 93° C.), (3S, 5S)-(−)-2,6-dimethyl-3,5-heptnaediol (90 to 93° C.), cyclohexanoneoxime (90° C.), p-bromoiodo benzene (91 to 92° C.), 4,4'-dimethylbenzophenone (92 to 95° C.), triphenylmethane (92 to 95° C.), stearic anilide (92 to 95° C.), p-hydroxyphenyl ethanol (92° C.), monoethyl urea (92° C.), acenaphthylene (93.5 to 94.5° C.), m-hydroxyacetophenone (93 to 97° C.), xylitol (93 to 97° C.), p-iodophenol (93° C.), p- methyl nitrobenzoate (94 to 98° C.), p-nitrobenzyl alcohol (94° C.), 1,2,4-triacetoxybenzene (95 to 100° C.), 3-acetylbenzonitrile (95 to 103° C.), ethyl 2-cyano-3,3-diphenyl acrylate (95 to 97° C.), 16-hydroxyhexadecanoate (95 to 99° C.), D(−)-ribose (95° C.), o-benzoyl benzoic acid (95° C.), α,α-dibromo-o-xylene (95° C.), benzyl (95° C.), iodoacetoamide (95° C.), n-propyl p-hydroxy benzoate (96 to 97° C.), n-propyl p-hydroxy benzoate (96 to 97° C.), flavone (96 to 97° C.), 2-deoxy-D-ribose (96 to 98° C.), lauryl gallate (96 to 99° C.), 1-naphtol (96° C.), 2,7-dimethyl naphthalene (96° C.), 2-choroophenyl acetic acid (96° C.), acenaphthene (96° C.), dibenzyl terephthalate (96° C.), fumaronitrile (96° C.), 4'-amino-2'-5'-diethoxybenzanilide (97 to 100° C.), phenoxy acetic acid (97 to 100° C.), 2,5-dimethyl-3-hexyne-2,5-diol (97° C.), D-sorbitol (97° C.), m-aminobenzyl alcohol (97° C.), diethyl acetoamide malonate (97° C.), 1,10-phenanthroline monohydrate (98 to 100° C.), 2-hydroxy-4-methoxy-4'-methylbenzophenone (98 to 100° C.), 2-bromo-4'-chloroacetophenone (98° C.), methyl urea (98° C.), 4-phenoxyphthalonitrile (99 to 100° C.), o-methoxy benzoic acid (99 to 100° C.), p-butyl benzoic acid (99 to 100° C.), xanethene (99 to 100° C.), pentafluorobenzoic acid (99 to 101° C.), phenanthrene (99° C.), p-t-butylphenol (100.4° C.), 9-fluolenyl methanol (100 to 101° C.), 1,3-dimethyl urea (100 to 102° C.), 4-acetoxyindole (100 to 102° C.), 1,3-cyclohexanedione (100° C.), amidestearate (100° C.), tri-m-tolylphsphine (100° C.), 4-biphenylmethanol (101 to 102° C.), 1,4-cyclohexane diol (cis-, trans-mixture) (101° C.), α,α'-dichloro-p-xylene (101° C.), 2-t-butylanthraquinone (102° C.), dimethyl fumarate (102° C.), 3,3-dimethyl glutaric acid (103 to 104° C.), 2-hydroxy-3-methyl-2-cyclopentente-1-on (103° C.), 4-chloro-3-nitroaniline (103° C.), N,N-diphenyl acetoamide (103° C.), 3(2)-t-butyl-4-hydroxyanisole (104 to 105° C.), 4,4'-dimethylbenzyl (104 to 105° C.), 2,2-bis(hydroxymethyl)-2,2'-2"-nitrilotriethanol (104° C.), m-trifluoromethyl benzoic acid (104° C.), 3-pentanol (105 to 108° C.), 2-methyl-1,4-naphthoquinone (105° C.), α,α,α',α'-tetrabromo-m-xylene (105° C.), 4-chlorophenyl acetic acid (106° C.), 4,4'-difluorobenzophenone (107.5 to 108.5° C.), 2,4-dichloro-1-naphthol (107 to 108° C.), L-ascorbate palmitate ester (107 to 117° C.), 2,4-dimethoxy benzoae (108 to 109° C.), o-trifluoromethyl benzoic acid (108 to 109° C.), p-hydroxyacetophenone (109° C.), dimethyl sulfone (109° C.), 2,6-dimethylnaphthalene (110 to 111° C.), 2,3,5,6-tetramethyl-1,4-benzoquinone (110° C.), tridecane diacid (110° C.), triphenyl chloromethane (110° C.), fluoranthene (110° C.), laurineamide (110° C.), 1,4-benzoquione (111° C.), 3-benzylindole (111° C.), resolcinol (111° C.), 1-buromobutane (112.3° C.), 2,2-bis(bromomethyl)-1,3-propanediol (112 to 114° C.), p-ethyl benzoic acid (113.5° C.), 1,4-diacetoxy-2-methylnaphthalene (113° C.), 1-ethyl-2,3-piperazinedione (113° C.), 4-mehtyl-2-nitroaniline (113° C.), L-ascorbiate dipalmitate ester (113° C.), o-phenoxy benzoic acid (113° C.), p-nitrophenol (113° C.), methyl (diphenyl)phosphine=oxide (113° C.), cholesterol acetate (114 to 115° C.), 2,6-dimethyl benzoic acid (114 to 116° C.), 3-nitrobenzonitrile (114° C.), m-nitroaniline (114° C.), ethyl α-D-glucoside (114° C.), acetoanilide (115 to 116° C.), (±)-2-phenoxypropionic acid (115° C.), 4-chloro-1-naphthol (116 to 117° C.), p-nitrophenyl acetonitrile (116 to 117° C.), ethyl p-hydroxybenzoate (116° C.), p-isopropyl benzoic acid (117 to 118° C.), D(+)-gulactose (118 to 120° C.), o-dinitrobenzene (118° C.), benzyl p-benzyloxy benzoate (118° C.), 1,3,5-tribromobenzene (119° C.), 2,3-dimethoxybenzoic acid (120 to 122° C.), 4-chloro-2-methylphenoxy acetic acid (120° C.), meso-erythritol (121.5° C.), 9,10-dimethyl-1,2-benzanthracene (122 to 123° C.), 2-naphthol (122° C.), N-phenylglycin (122° C.), bis(4-hydroxy-3-methylphenyl) sulfide (122° C.), p-hydroxybenzyl alcohol (124.5 to 125.5° C.), 2', 4'-dihydroxy-3'-propylacetophenone (124 to 127° C.), 1,1-bis(4-hydroxyphenyl)ethane (124° C.), m-fluorobenzoic acid (124° C.), diphenylsulfone (124° C.), 2,2-dimethyl-3-hydroxypropionic acid (125° C.), 3,4,5-trimethoxy cinnamic acid (125° C.), o-fluorobenzoic acid (126.5° C.), isonitriloacetophenone (126 to 128° C.), 5-methyl-1,3-cyclohexanedione (126° C.), 4-benzoyl butyric acid (127° C.), methyl p-hydroxy benzoate (127° C.), p-bromonitrobenzene (127° C.), 3,4-dihydroxyphenyl acetic acid (128 to 130° C.), 5α-cholestane-3-one (128 to 130° C.), 6-bromo-2-naphthol (128° C.), isobutylamide (128° C.), 1-naphthyl acetic acid (129° C.), 2,2-dimethyl-1,3-propanediol (129° C.), p-diiodo benzene (129° C.), dodecane diacid (129° C.), 4,4'-dimethoxybenzyl (131 to 133° C.), dimethylol urea (132.5° C.), o-ethoxybenzamide (132 to 134° C.), sebacic acid (132° C.), p-toluene sulfone amide (134° C.), salicylic anilide (135° C.), β-sitosterol (136 to 137° C.), 1,2,4,5-tetrachlorobenzene (136° C.), 1,3-bis(1-hydroxy-1-methylethyl)benzene (137° C.), phthalonitrile (138° C.), 4-n-propyl benzoic acid (139° C.), 2,4-dichlorophenoxy acetic acid (140.5° C.), 2-naphthyl acetic acid (140° C.), methyl terephthalate (140° C.), 2,2-dimethyl succinic acid (141° C.), 2,6-dichlorobenzonitrile (142.5 to 143.5° C.), o-chlorobenzoic acid (142° C.), 1,2-bis(diphenyl phosphino)ethane (143 to 144° C.), α,α,α-tribromomethyl phenylsulfone (143° C.), D(+)-xylose (144 to 145° C.), phenyl urea (146° C.), n-propyl gallate (146° C.), 4,4'-dichlorobenzophenone (147 to 148° C.), 2',4'-dihydroxyacetophenone (147° C.), cholesterol (148.5° C.), 2-methyl-1-pentanol (148° C.), 4,4'-dichlorodiphenylsulfone (148° C.), diglycolic acid (148° C.), adipic acid (149 to 150° C.), 2-deoxy-D-glucose (149° C.), diphenyl acetic acid (149° C.) and o-bromo benzoic acid (150° C.).

The addition amount of the heat solvent in the invention is preferably 0.01 $g/m^2$ or more and 5.0 $g/m^2$ or less and, more preferably, 0.05 $g/m^2$ or more and 2.5 $g/m^2$ or less, further preferably, 0.1 $g/m^2$ or more and 1.5 $g/m^2$ or less. It is preferred that the heat solvent is contained in the image-forming layer.

Further, while the heat solvent may be used alone, however, two or more of them may be used in combination.

In the invention, the heat solvent may be contained in the coating solution and may be contained in a photosensitive material by any method in the form of a solution, emulsified dispersion, fine solid particle dispersion, etc.

A well known emulsification/dispersing method includes a method of mechanically forming an emulsified dispersion by dissolving the heat solvent using oils such as dibutyl phthalate, tricrezyl phosphate, glyceryl triacetate or diethyl phthalate or an auxiliary solvent such as ethyl acetate or cyclohexanone.

Further, a fine solid particle-dispersion method includes a method of dispersing a powder of the heat solvent in an appropriate solvent such as water, etc. by a ball mill, colloid mill, vibration ball mill, sand mill, jet mill, roller mill or by ultrasonic waves to form a solid dispersion. In this case, protection colloids (for example, polyvinyl alcohol), surfactants (for example, anionic surfactants such as sodium triisopropyl naphthalene sulfonate (a mixture in which the substitution positions of three isopropyl groups are different)) may be used. In the mills described above, beads such as of zirconia are usually used as a dispersion medium, and Zr, etc. leached from those beads are sometimes mixed in the dispersion. It is usually within a range of from 1 ppm to 1,000 ppm although it depends on the dispersion condition. It is practically allowable when the content of Zr in the sensitive material is 0.5 mg or less based on 1 g of silver.

It is preferred that an aqueous dispersion is incorporated with an antiseptic agent (for example, benzoisothiazolinone sodium salt). Further, the heat solvent is preferably used as a solid dispersion in the invention.

(Other Additives)

1) Mercapto, Disulfide and Thions

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by Formula (I) of JP-A No. 10-186572 and specific examples thereof shown in paragraph Nos. 0033 to 0052, in lines 36 to 56 in page 20 of EP No. 0803764A1. Among them, mercapto-substituted heterocyclic aromatic compound, which is described in JP-A Nos. 9-297367, 9-304875, 2001-100358, 2002-303954, 2002-303951 and the like, is particularly preferred.

2) Color Toning Agent

For the photothermographic material, addition of a color toning agent is preferred. As the color toning agent used in this invention, any color toning agent used so far for the photothermographic materials utilizing an organic silver salt can be used with no particular restriction. Further, the color toning agents may be a so-called precursor derived so as to have a function effectively only upon development. For example, those disclosed in JP-A Nos. 46-6077, 47-10282, 49-5019, 49-5020, 49-91215, 49-91215, 50-2524, 50-32927, 50-67132, 50-67641, 50-114217, 51-3223, 51-27923, 52-14788, 52-99813, 53-1020, 53-76020, 54-156524, 54-156525, 61-183642 and 4-56848, JP-B Nos. 49-10727 and 54-20333, U.S. Pat. Nos. 3,080,254, 3,446,648, 3,782,941, 4,123,282, and 4,510,236, BP No. 1,380,795 and Belgium Patent No.841,910 may be used appropriately.

Specific examples of the color toning agent can include phtalimide and N-hydroxyphthalimide; cyclic imides such as succineimide, pyrazolin-5-one and quinazolinone, 3-phenyl-2-pirazolin-5-one, 1-phenylurazole, quinazoline and 2,4-thiazolidine dione; naphthal imide (for example, N-hydroxy-1,8-naphthalimide); cobalt complex (for example, cobalt hexamine trifluoroacetate); mercaptane, for example, 3-mercapto-1,2,4-triazole, 2,4-dimercapto pyrimidine, 3-mercapto-4,5-diphenyl-1,2,4-triazole and 2,5-dimercapto-1,3,4-thiadiazole; N-aminomethyl)aryl dicarboxyimide (for example, (N,N-dimethylaminomethyl)phthalimide and N,N-dimethylaminomethyl)-naphthalene-2,3-dicarboxyimide); and blocked pyrazole, isothiuronium derivatives and a certain kind of light discoloring agents (for example, N,N'-hexamethylene bis(1-carbamoyl-3,5-dimethyl pyrazol), 1,8-(3,6-diazaoctane)bis(isothiuronium trifluoroacetate) and 2-tribromo methylsulfonyl)-(benzothiazole)); and 3-ethyl-5-[(3-ethyl-2-benzothiazolinidene)-1-methyl ethylidene]-2-thio-2,4-oxazolidine dion; phthaladinone, phthaladinone derivatives or metal salts, or derivatives such as 4-(1-naphthyl)phthaladinone, 6-chlorophthaladinone, 5,7-dimethoxyphthaladinone and 2,3-dihydro-1,4-phthalazine dione; combinations of phthaladinone with phthalic acid derivatives (for example, phthalic acid, 4-methyl phthalic acid, 4-nitrophthalic acid and tetrachloro phthalic acid anhydride); phthalazine, phthalazine derivatives (for example, derivatives of 4-(1-naphthyl)phthalazine, 6-chlorophthalazine, 5,7-dimethoxyphthalazine, 6-isobutyl phthaladine, 6-tert-butyl phthalazine, 5,7-dimethyl phthalazine and 2,3-dihydrophthalazine) or metal salts thereof; combinations of phthalazine and derivatives thereof with phthalic acid derivatives (for example, phthalic acid, 4-methyl phthalic acid, 4-nitrophthalic acid and tetrachlorophtalic acid anhydride); quinazoline dione, benzoxadine or naphthooxadine derivatives; rhodium complex which functions not only as a color toning agent but also as a source of halide ions for forming silver halides in site, for example, ammonium hexachloro rhodate (III), rhodium bromide, rhodium nitrate and potassium hexachloro rhodate (III); inorganic peroxide and persulfate, for example, peroxy ammonium disulfide and hydrogen peroxide; benzoxadine-2,4-diones such as 1,3-benzoxadine-2,4-dione, 8-methyl-1,3-benzoxadine-2,4-dione and 6-nitro-1,3-benzoxadine-2,4-dione; pyrimidine and asymmetric triazine (for example, 2,4-dihydroxypyrimidine, 2-hydroxy-4-aminopyrimidine, etc.), azauracil and tetra azapentalene derivatives (for example, 3,6-dimercapto-1,4-diphenyl-1H, 4H-2,3a,5,6a-tetra azapentalene and 1,4-di(o-chlorophenyl)-3,6-dimercapto-1H, 4H-2,3a,5,6a-tetra azapentalene).

In the invention, it is particularly preferred to use the phthalazine derivative represented by Formula (I) as the color toning agent. In Formula (I), R represents a substituent and m represents an integer of from 1 to 6. In a case where m≧2, plural Rs may be identical or different with each other.

Formula (I)

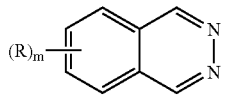

As the substituent represented by R, any substituent may be used so long as it gives no undesired effect on the photographic property. For example, the substituent includes a halogen atom (for example, fluorine atom, chlorine atom, bromine atom, iodine atom), a linear, branched or cyclic alkyl group (having preferably from 1 to 20, more preferably from 1 to 16, particularly preferably, from 1 to 12 carbon atoms including, for example, methyl, ethyl, isopropyl, tert-butyl, tert-octyl, tert-amyl, and cyclohexyl), alkenyl group (having preferably from 2 to 20, more preferably, from 2 to 16 and, particularly preferably, from 2 to 12 carbon atoms and can include, for example, vinyl group, allyl group, 2-butenyl group, and 3-pentenyl group), aryl group (having preferably, from 6 to 30, more preferably, from 6 to 20 and, particularly preferably, from 6 to 12 carbon atoms including, for example, phenyl, p-methylphenyl, and naphthyl), alkoxy group (having preferably from 1 to 20, more preferably, from 1 to 16 and, particularly preferably, from 1 to 12 carbon atoms and including, for example, methoxy group, ethoxy group, and butoxy group), aryloxy group (having preferably, from 6 to 30, more preferably, from 6 to 20 and, particularly preferably, from 6 to 12 carbon atoms including, for example, phenyloxy, and 2-naphthyloxy), acyloxy group (having preferably from 1 to 20, more preferably, from 2 to 16 and, particularly preferably, from 2 to 12 carbon atoms, including, for example, acetoxy, benzoyloxy), amino group (having preferably from 0 to 20, more preferably from 2 to 16 and, particularly preferably, 12 carbon atoms including, for example, dimethylamino group, doethylamino group and dibutylamino group), acylamino group (having preferably from 1 to 20, more preferably, from 2 to 16 and, particularly preferably, from 2 to 12 carbon atoms including, for example, acetylamino group and benzoylamino group), sulfonylamino group (having preferably, from 1 to 20, more preferably, from 1 to 16, particularly preferably, from 1 to 12 carbon atoms including, for example, methanesulfonylamino group, and benzenesulfonylamino group), ureido group (having preferably from 1 to 20, more preferably, from 1 to 16 and, particularly preferably, from 1 to 12 carbon atoms including, for example, ureido, methylureido, and phenylureido group), carbamate group (having preferably from 2 to 20, more preferably, from 2 to 16 and, particularly preferably, from 2 to 12 carbon atoms including, for example, methoxycarbonylamino, and phenyloxycarbonylamino), carboxyl group, carbamoyl group (having preferably, from 1 to 20 carbon atoms, more preferably, from 1 to 16, particularly preferably, from 1 to 12 carbon atoms including, for example, carbamoyl, N-N-diethylcarbamoyl, and N-phenylcarbamoyl group), alkoxycarbonyl group (having from 2 to 20, more preferably, from 2 to 16, and particularly preferably, from 2 to 12 carbon atoms including, for example, methoxycarbonyl, ethoxycarbonyl group), acyl group (having preferably from 2 to 20, more preferably, 2 to 16 and, particularly preferably, from 2 to 12 carbon atoms including, for example, acetyl, benzoyl, formyl and pivaroyl), sulfo group, sulfonyl group (having, preferably, from 1 to 20, more preferably, from 1 to 16 and, particularly preferably, from 1 to 12 carbon atoms including, for example, mesyl and tosyl), sulfamoyl group (having preferably from 0 to 20, more preferably, from 0 to 16, particularly preferably, from 0 to 12 carbon atoms including, for example, sulfamoyl, methyl sulfamoyl, dimethyl sulfamoyl, and phenyl sulfamoyl), cyano group, nitro group, hydroxyl group, mercapto group, alkylthio group (having preferably from 1 to 20, more preferably, from 1 to 16 and, particularly preferably, from 1 to 12 carbon atoms including, for example, methylthio group, and butylthio group), and heterocyclic group (having preferably, from 2 to 20, more preferably, from 2 to 16, particularly preferably, from 2 to 12 carbon atoms, including, for example, pyridyl, imidazolyl and pyrrolidyl).

The substituent represented by R is, preferably, a halogen atom, a linear, branched or cyclic alkyl group, aryl group, alkoxy group, aryloxy group, cyano group, nitro group, hydroxyl group, mercapto group, and alkythio group, more preferably, a linear, branched or cyclic alkyl group, alkoxy group and aryloxy group and, particularly preferably, a linear or branched alkyl group.

In a case where m is 2 or more, substituents represented by R may be identical or different with each other and the substituent may further be substituted with other substituent. Further, they may join to each other to form a cyclic structure.

The compound represented by the Formula (I) is preferably a compound having a melting point of 130° C. or lower and the compound also includes those which are liquid at normal temperature (temperature at about 15° C.).

Specific examples of the compound represented by the Formula (1), which is a compound having a melting point 130° C. or lower are described below, but the compound usable in the invention are not restricted to such specific examples.

B-1

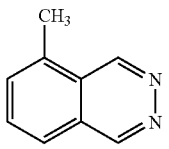

(melting point: 72-74° C.)

-continued

B-2

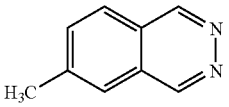

(melting point: 55° C.)

B-3

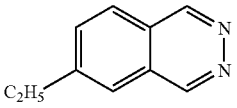

(melting point: 29-30° C.)

B-4

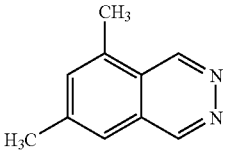

(melting point: 107-108° C.)

B-5

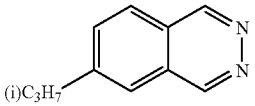

(melting point: 46-49° C.)

B-6

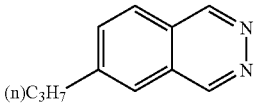

(liquid at normal temperature)

B-7

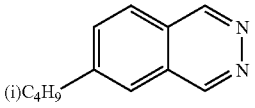

(melting point: 29-30° C.)

B-8

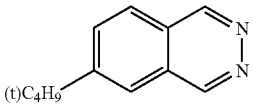

(melting point: 121-124° C.)

B-9

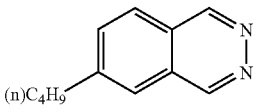

(liquid at normal temperature)

B-10

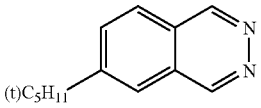

(melting point: 102-104° C.)

B-11

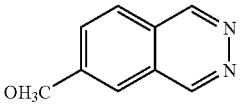

(liquid at normal temperature)

-continued

B-12

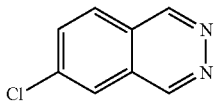

(liquid at normal temperature)

B-13

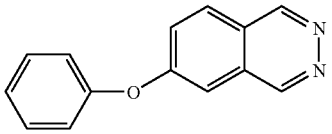

(liquid at normal temperature)

The color toning agent used in the photothermographic material according to the invention is used in an amount sufficient to improve the image performance to a desired level. Use of the color toning agent in the appropriate amount is advantageous in increasing the image density and forming black silver images. The color toning agent is contained on the side having the image-forming layer by preferably from 0.1% by mole or more and 50% by mole or less and, more preferably, by 0.5% by mole or more and 20% by mole or less.

The color toning agent may be added to any layer so long as it is the surface on the side having the image-forming layer and it is preferably added to the image-forming layer and/or layer adjacent therewith and, more preferably, added to the image-forming layer.

3) Color-tone-adjusting-agent

The heat development recording material of the invention preferably contains a color-tone-adjusting-agent for controlling the tone of the developed silver. The color-tone-adjusting-agent is an additive for controlling the tone of the developed silver to a desired tone and it is preferred to use a reducing compound that forms a yellow oxidation product in a case where the tone of the developed silver is blue-tinted color when pure black images are intended. Further, in a case of developed silver with a tone of yellow-brown system it is preferred to use a compound forming cyan system color as the color-tone-adjusting-agent. Further, the color-tone-adjusting-agent is preferably used by controlling the color depending on the tone formed from the developed silver and the color tone of aimed images tone.

i) Color Toning Agent Represented by Formula (P)

One of the color toning agents usable in the invention, a compound represented by Formula (P) is preferably contained.

Formula (P)

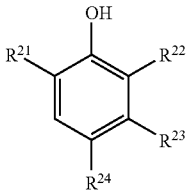

In the Formula, $R^{21}$ and $R^{22}$ each represents independently a hydrogen atom, an alkyl group, or acylamino group. However, $R^{21}$ and $R^{22}$ are not 2-hydroxyphenylmethyl and are not hydrogen atoms simultaneously. $R^{23}$ represents a hydrogen atom or an alkyl group. $R^{24}$ represents a substituent capable of substitution on the benzene ring.

In a case where $R^{21}$ is an alkyl group, an alkyl group of from 1 to 30 carbon atoms is preferred and an alkyl group of from 1 to 10 carbon atoms are more preferred.

The alkyl group may have a substituent. As not-substituted alkyl group, specifically, methyl, ethyl, butyl, octyl, isopropyl, t-butyl, t-octyl, t-amyl, sec-butyl, cyclohexyl, and 1-methyl-cyclohexyl are preferred and sterically larger group than the isopropyl group (for example, isopropyl group, isononyl group, t-butyl group, t-amyl group, t-octyl group, cyclohexyl group, 1-methyl-cyclohexyl group and adamantyl group) are more preferred and, among all, t-butyl, t-octyl and t-amyl group as the tertiary alkyl group are particularly preferred.

Further, the substituent in a case where the alkyl group has a substituent includes, for example, a halogen atom, aryl group, alkoxy group, amino group, acyl group, acylamino group, alkylthio group, arylthio group, sulfoneamide group, acyloxy group, oxycarbonyl group, carbamoyl group, sulfamoyl group, sulfonyl group, and phosphoryl group.

In a case where $R^{22}$ is the alkyl group, an alkyl group of from 1 to 30 carbon atoms is preferred and a not-substituted alkyl group of from 1 to 24 carbon atoms is further preferred.

The alkyl group may have a substituent. The not-substituted alkyl group preferably includes, specifically, methyl, ethyl, butyl, octyl, isopropyl, t-butyl, t-octyl, t-amyl, sec-butyl, cyclohexyl, 1-methyl-cyclohexyl group, etc.

Examples of the substituent are identical with those for $R^{21}$.

In a case where $R^{21}$ and $R^{23}$ each represents an acylamino group, an acylamino group of from 1 to 30 carbon atoms is preferred and an acylamino group of from 1 to 10 carbon atoms is more preferred.

The acylamino group may be a not-substituted or have a substituent. They include, specifically, an acetylamino group, alkoxy acetylamino group or aryloxy acetylamino group, etc.

$R^{21}$ is preferably an alkyl group among the hydrogen atom, alkyl group or acylamino group.

On the other hand, $R^{22}$ is preferably a hydrogen atom or a not-substituted alkyl group of from 1 to 24 carbon atoms among the hydrogen atom, alkyl group and acylamino group and, specifically, includes methyl group, isopropyl group and t-butyl group.

$R^{21}$, $R^{22}$ are not 2-hydroxyphenylmethyl group and not hydrogen atom simultaneously.

$R^{23}$ represents a hydrogen atom or alkyl group and, among them, a hydrogen atom or an alkyl group of from 1 to 30 carbon atoms is preferred and a hydrogen atom or a not-substituted alkyl group of from 1 to 24 carbon atoms is more preferred. Description for the alkyl group is identical with that for $R^{22}$. They include, specifically, methyl group, isopropyl group and t-butyl group.

It is preferred that one of $R^{22}$ and $R^{23}$ is a hydrogen atom.

$R^{24}$ represents a group capable of substitution on the benzene ring, which is the group identical with that described for $R^{12}$ and $R^{12'}$ for the compound of Formula (R). Preferred $R^{24}$ are substituted or not-substituted alkyl group of from 1 to 30 carbon atoms and oxycarbonyl group of from 2 to 30 carbon atoms, with the alkyl group of from 1 to 24 carbon atoms being more preferred. The substituent for the alkyl group includes aryl group, amino group, alkoxy group, oxycarbonyl group, acylamino group, acyloxy group, imide group, and ureido group, aryl group, amino group, oxycarbonyl group and alkoxy group being further preferred.

Further preferred structure for the compound of Formula (P) is represented by Formula (P-2).

Formula (P-2)

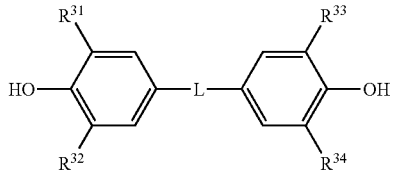

In the Formula, $R^{31}$, $R^{32}$, $R^{33}$, $R^{34}$ each represents independently a hydrogen atom, a substituted or not-substituted alkyl group of from 1 to 20 carbon atoms. $R^{31}$ and $R^{33}$, $R^{33}$ and $R^{34}$ are not simultaneously hydrogen atoms. $R^{31}$, $R^{32}$, $R^{33}$, $R^{34}$ each independently represents preferably an alkyl group of from 1 to 10 carbon atoms. The substituent for the alkyl group is not particularly limited and it can include, preferably, an aryl group, hydroxy group, alkoxy group, aryloxy group, alkylthio group, arylthio group, acylamino group, sulfoneamino group, sulfonyl group, phosphoryl group, acryl group, carbamoyl group, ester group, halogen atom, etc. Among them, it is preferred at least one of groups sterically larger than the isopropyl group (for example, isopropyl group, isononyl group, t-butyl group, t-amyl group, t-octyl group, cyclohexyl group, 1-methyl-cyclohexyl group, adamantyl group, etc.) is present and, more preferably, two or more of them are present. t-butyl, t-octyl, t-amyl, etc. which are tertiary alkyl groups sterically larger than the isopropyl group are particularly preferred.

L is preferably a —$CHR^{13}$— group.

$R^{13}$ preferably represents a hydrogen atom or an alkyl group of from 1 to 15 carbon atoms and a linear alkyl group, as well as cyclic alkyl group are also used preferably for the alkyl group. Further, those having C═C bond in the alkyl groups can also be used preferably. Preferred alkyl groups are, for example, methyl group, ethyl group, propyl group, isopropyl group, 2,4,4-trimethylpentyl group, cyclohexyl group, 2,4-dimethyl-3-cyclohexenyl group, and 3,5-dimethyl-3-cyclohexenyl group. Particularly preferred $R^{13}$ are a hydrogen atom, methyl group, ethyl group, propyl group, isopropyl group and 2,4-dimethyl-3-cyclohexenyl group.

In a case where $R^{11}$, $R^{11'}$ each represents a tertiary alkyl group and $R^{12}$, $R^{12'}$ each represents a methyl group, $R^{13}$ is preferably a primary or secondary alkyl group of from 1 to 8 carbon atoms (methyl group, ethyl group, propyl group, isopropyl group, 2,4-dimethyl-3-cyclohexenyl group, etc.).

In a case where $R^{11}$, $R^{11'}$ each represents a tertiary alkyl group and $R^{12}$, $R^{12'}$ each represents an alkyl group other than methyl group, $R^{13}$ is preferably a hydrogen atom.

In a case where $R^{11}$, $R^{11'}$ are not tertiary alkyl group, $R^{13}$ is preferably a hydrogen atom or a secondary alkyl group and, particularly preferably, a secondary alkyl group. A preferred group as the secondary alkyl group for $R^{13}$ is an isopropyl group or 2,4-dimethyl-3-cyclohexenyl group.

Specific examples of the compounds represented by Formula (P) and Formula (P-2) in the invention are shown but with no restriction to them.

P-1

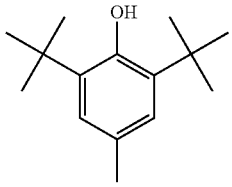

P-2

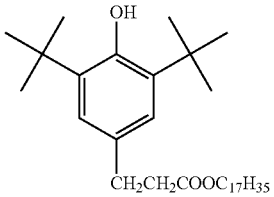

P-3

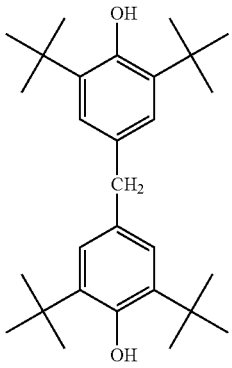

P-4

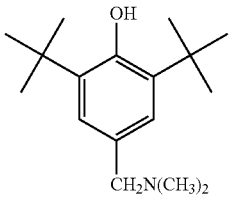

-continued
P-5
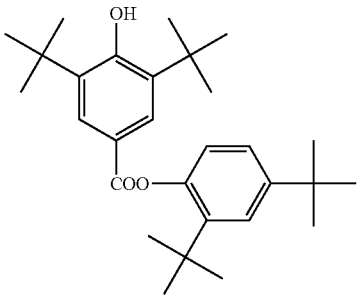
P-6
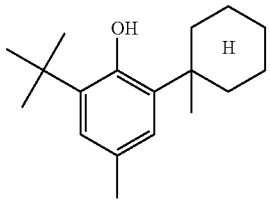
P-7
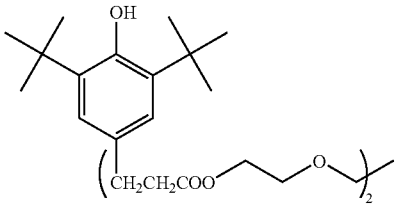
P-8
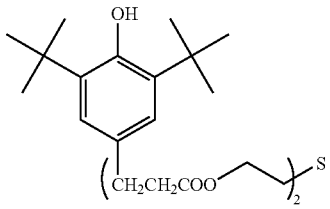
P-9
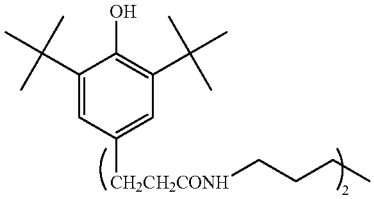
P-10
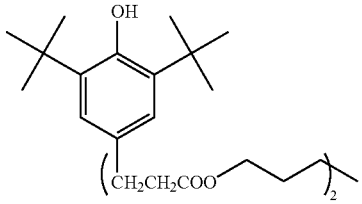
P-11
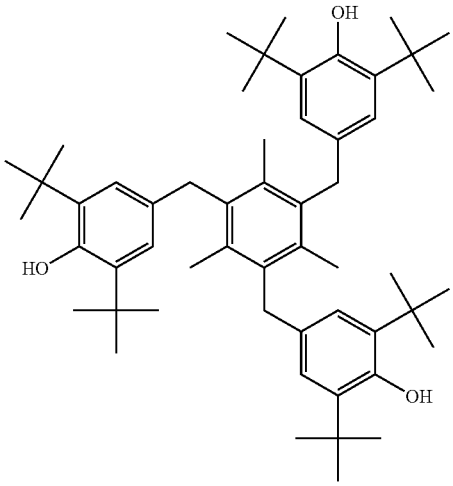
P-12
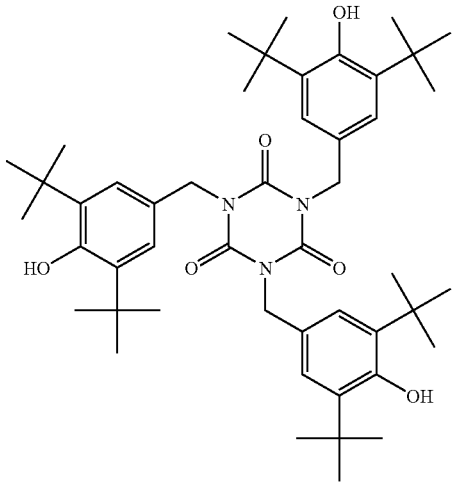
P-13
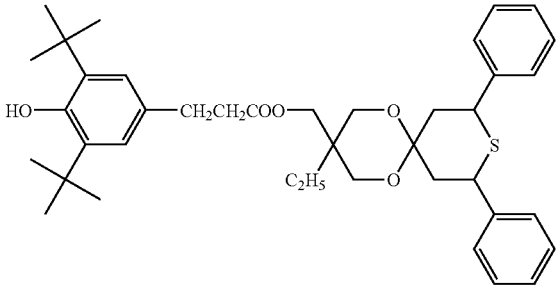

-continued
P-14
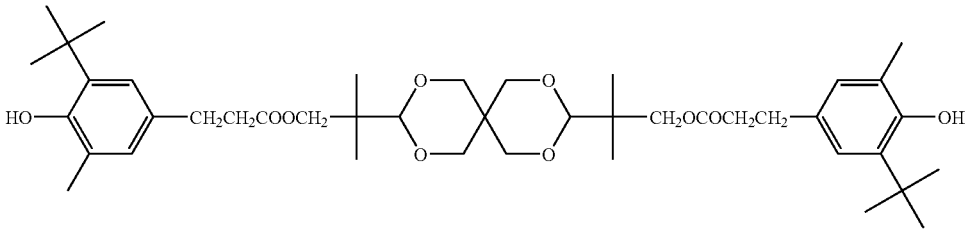
P-15
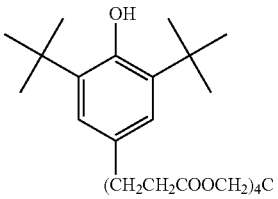
P-16
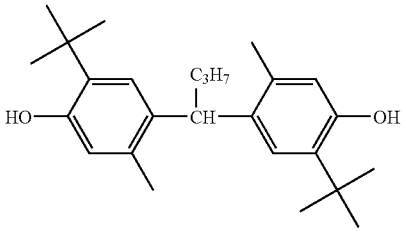
P-17
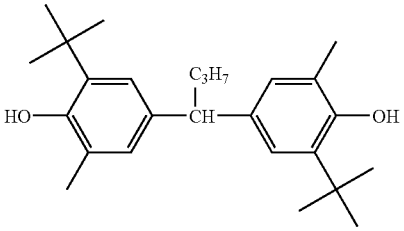
P-18
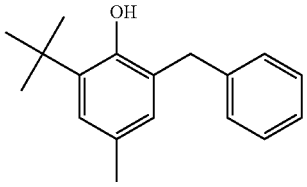
P-19
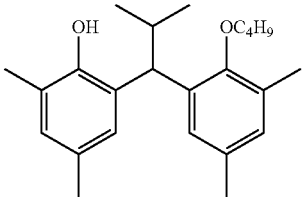
P-20
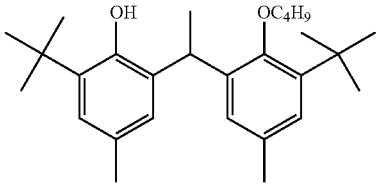
P-21
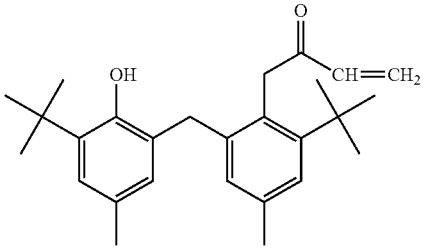
P-22
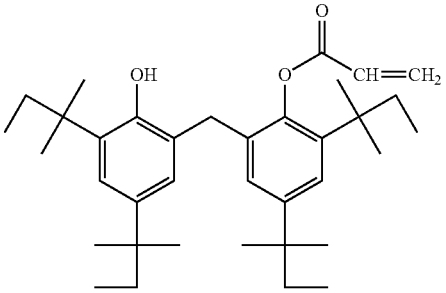
P-23
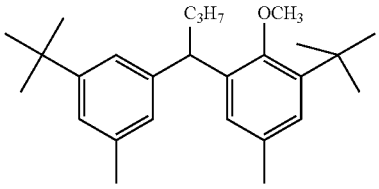
P-24
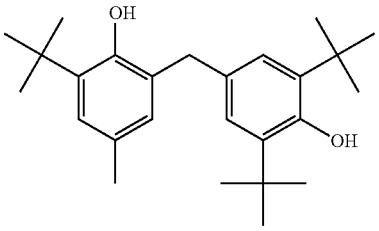

-continued
P-25
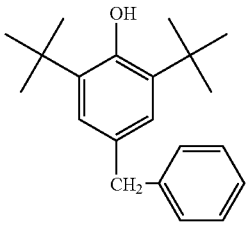
P-26
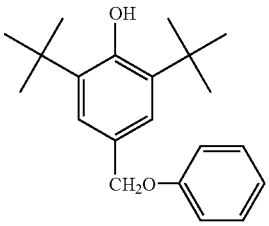
P-27
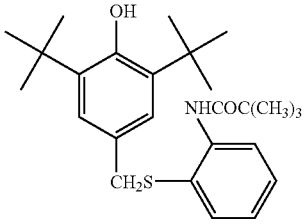
P-28
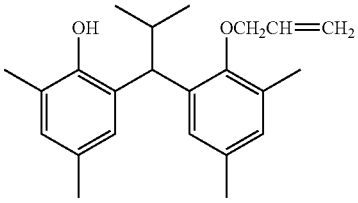
P-29
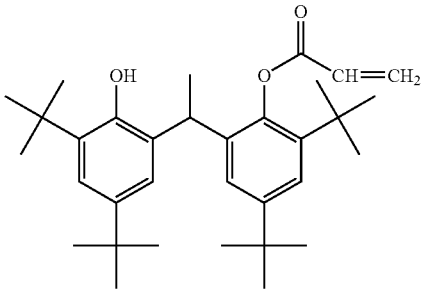
P-30
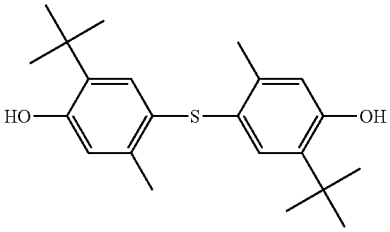
P-31
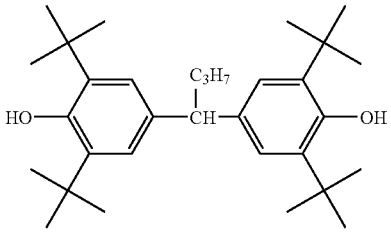
P-32
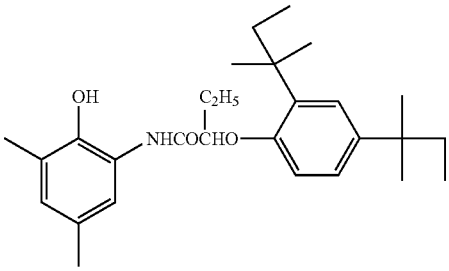
P-33
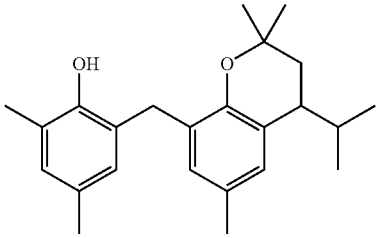
P-34
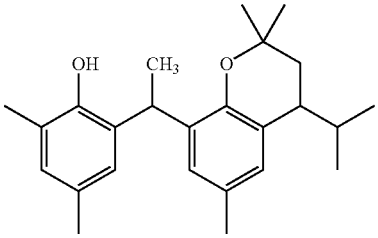
P-35
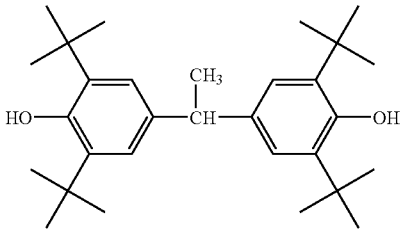
P-36
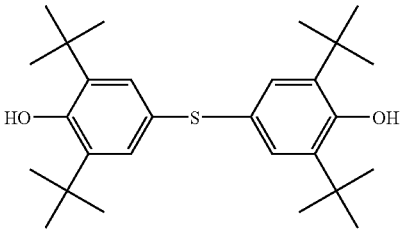

-continued

P-37

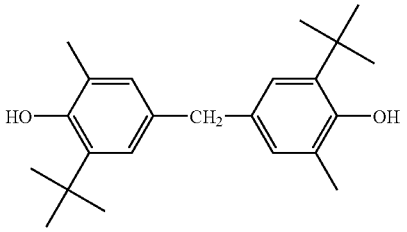

P-38

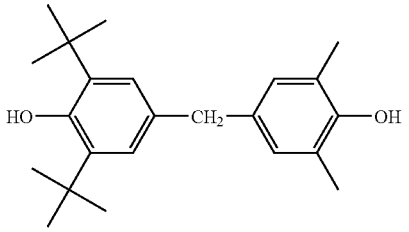

P-39

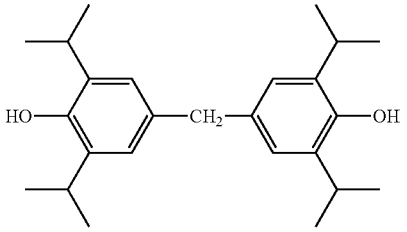

P-40

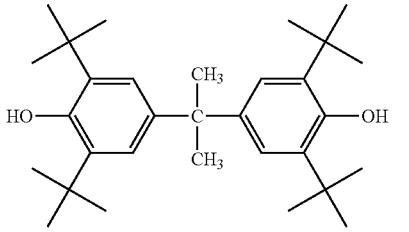

ii) Couplers

Another color toning agent is couplers that couple with oxidation products of the reducing agent for the heat development to form colors. The couplers are described in JP-A Nos. 2000-311533, 2002-328444, 2002-318432, 2002-221768, 2000-287296 and 2002-296731. Desired color formation can be obtained by the combination of the reducing agent and the coupler.

In the invention, color-tone-adjusting-agent may be incorporated into photothermographic material by being added into the coating solution, such as in the form of a solution, an emulsion dispersion, a solid fine particle dispersion, and the like.

As a emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid fine particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). Preferably, a preservative (for instance, sodium benzoisothiazolinone salt) is added in the water dispersion.

Color-tone-adjusting-agent is preferably contained in the image-forming layer containing the organic silver salt but one of them may be incorporated in the image-forming layer while the other of them may be incorporated in a non-image-forming layer adjacent therewith, or both of them may be incorporated in the non-image-forming layer. In a case where the image-forming layer comprises plural layers, they may be incorporated into separate layers respectively.

The addition amount ratio (molar ratio) of color-tone-adjusting-agent to the reducing agent represented by Formula (R) is preferably within a range from 0.001 to 0.2, more preferably, within a range from 0.005 to 0.1 and, further preferably, within a range from 0.008 to 0.05.

4) Plasticizer

In the invention, known platicizers can be used for improving the film property. For the plasticizer usable in the image-forming layer and the non-photosensitive layer, those compounds described, in JP-A No. 11-65021, in column No. 0117, JP-A No. 2000-5137, Japanese Patent Application Nos. 2003-8015, 2003-8071, and 2003-132815 are preferred.

5) Dye and Pigment

From the viewpoint of improving image tone, preventing the generation of interference fringes and preventing irradiation on laser exposure, various types of dyes and pigments (for instance, C.I. Pigment Blue 60, C.I. Pigment Blue 64, and C.I. Pigment Blue 15:6) may be used in the image-forming layer of the invention. Detailed description can be found in WO No. 98/36322, JP-A Nos. 10-268465 and 11-338098, and the like.

6) Ultra-high Contrast Promoting Agent

In order to form ultra-high contrast image suitable for use in graphic arts, it is preferred to add an ultra-high contrast promoting agent into the image-forming layer. Details on the ultra-high contrast promoting agents, method of their addition and addition amount can be found in paragraph No. 0118, paragraph Nos. 0136 to 0193 of JP-A No. 11-223898, as compounds expressed by Formulae (H), (1) to (3), (A), and (B) in JP-A No. 2000-284399; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image-forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coating amount per 1 $m^2$ of the photothermographic material) may be set as desired depending on sensitivity and fogging, but preferred is an amount of 0.1 $mg/m^2$ to 500 $mg/m^2$, and more preferably, of 0.5 $mg/m^2$ to 100 $mg/m^2$.

(Preparation of Coating Solution and Coating)

The temperature for preparing the coating solution for the image-forming layer of the invention is preferably from 30° C. to 65° C., more preferably, from 35° C. or more to less than 60° C., and further preferably, from 35° C. to 55° C. Furthermore, the temperature of the coating solution for the image-forming layer immediately after adding the polymer latex is preferably maintained in the temperature range from 30° C. to 65° C.

(7) Constitution for Other Layer and the Constituent Ingredient

1) Anti-halation Layer

In the photothermographic material of the invention, an anti-halation layer can be disposed to the photosensitive layer on the side remote from a light source.

Descriptions on the anti-halation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The anti-halation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for decolorization by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in the range from 0.15 to 2, and more preferably from 0.2 to 1. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two types or more of thermal bleaching dyes may be used in combination in a photothermographic material. Similarly, two types or more of base precursors may be used in combination.

In the case of thermal decolorization by the combined use of a bleaching dye and a base precursor, it is advantageous from the viewpoint of thermal decolorization efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

2) Back Layer

Back layers which can be used in the invention are described in paragraph Nos. 0128 to 0130 of JP-A No. 11-65021.

In the invention, coloring matters having maximum absorption in the wavelength range from 300 nm to 450 nm may be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

The photothermographic material in the invention is preferably a so-called one side photosensitive material having at least one layer of silver halide emulsion on one side of a support and having a back layer on the other side of the support.

3) Film Surface pH

The surface pH of the photothermographic material of the invention preferably yields a pH of 7.0 or lower, more preferably, 6.6 or lower, before thermal developing process. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

4) Hardener

A hardener can be used in each of the image-forming layer, the protective layer, the back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

5) Anti-static Agent

As the conductive high molecular compound, for example, polyvinyl benzene sulfonate salts, polyvinyl benzyl trimethyl ammonium chloride, quaternary salt polymers described in U.S. Pat. Nos. 4,108,802, 4,118,231, 4,126,467, 4,137,217, and polymer latexes described, for example, in U.S. Pat. No. 4,070189, OLS 2,830,767, JP-A Nos. 61-296352 and 61-62033, etc. can be used.

However, for the conductive layer of the invention, it is most preferred to contain a conductive metal oxide in that the resistance value on the lateral surface of the photosensitive material can be lowered sufficiently.

Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The addition amount of different types of atoms is preferably in the range from 0.01% by mole to 30% by mole, and particularly preferably, in the range from 0.1% by mole to 10% by mole. The shape of the metal oxides can include, for example, spherical, needle-like, or tabular shape. The needle-like particles, with the rate of (the major axis)/(the minor axis) is 2.0 or more, and more preferably, 3.0 to 50, is preferred viewed from the standpoint of the electric conductivity effect. The metal oxides is used preferably in the range from 1 $mg/m^2$ to 1000 $mg/m^2$, more preferably from 10 $mg/m^2$ to 500 $mg/m^2$, and further preferably from 20 $mg/m^2$ to 200 $mg/m^2$. The antistatic layer can be laid on either side of the image-forming layer side or the back layer side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

6) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal developing process. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and the like. The moisture content of the support is preferably 0.5% by mass or less when coating for image-forming layer and back layer is conducted on the support.

7) Other Additives

Furthermore, antioxidant, stabilizing agent, plasticizer, UV absorbent, or a film forming promoting agent may be added to the photothermographic material. Each of the additives is added to either of the image-forming layer (photosensitive layer) or the non-photosensitive layer. Reference can be made to WO No. 98/36322, EP-A No. 803764A1, JP-A Nos. 10-186567 and 10-18568, and the like.

8) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and most preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the image-forming layer in the invention is preferably a so-called thixotropic fluid. For the details of this technology, reference can be made to JP-A No. 11-52509. Viscosity of the coating solution for the layer containing organic silver salt in the invention at a shear velocity of $0.1S^{-1}$ is preferably in the range from 400 mPa·s to 100,000 mPa·s, and more preferably, from 500 mPa·s to 20,000 mPa·s. At a shear velocity of $1000S^{-1}$, the viscosity is preferably in the range from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image-forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and time period for heating is preferably in the range from 1 second to 60 seconds. More preferably, the temperature of the heat treatment is in the range 70° C. to 90° C. at the film surface and time period for heating is 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to produce the photothermographic material of the invention stably and continuously.

The photothermographic material is preferably of mono-sheet type (i.e., a type which can form image on the photothermographic material without using other sheets such as an image-receiving material).

9) Packaging Material

The photosensitive material of the invention is preferably packaged by a packaging material with a low oxygen permeation rate and/or low moisture permeation rate in order to suppress fluctuation of photographic performance during unprocessed storage, or in order to improve curling or crimping nature. The oxygen permeation rate at 25° C. is, preferably, 50 ml/atm·$m^2$·day or less and, more preferably, 10 nm/atm·$m^2$·day or less and, further preferably, 1.0 ml/atm·$m^2$·day or less. The moisture permeability is, preferably, 10 g/atm·$m^2$·day or less, more preferably, 5 g/atm·$m^2$·day and, further preferably, 1 g/atm·$m^2$·day or less.

Specific examples of the packaging material with low oxygen permeability and/or moisture permeability are those materials described, for example, in the specifications of JP-A Nos. 8-254793 and 2000-206653.

In the invention, the cutting step of cutting a sheet-like recording material into a predetermined size and a packaging step of packaging a cut sheet-like recording material in a packaging material are preferably conducted under a circumstance at a cleanliness of class 10,000 or lower according to US Federal Standards 209d. Further, when the packaging material was cleaned before the packaging step, more effect can be provided.

The cleanliness in the cutting step by the measuring method according to the US Federal Standards 209d is preferably class 7,000 or less, preferably, 4,000 or less, further preferably, 1,000 or less and, particularly preferably 500 or less. The cleanliness in the packaging step by the measuring method according to US Federal Standards 209d is, preferably, class 7,000 or less, more preferably, 4,000 or less, further preferably 1,000 or less and, particularly preferably, 500 or less.

When the cutting step and/or cleaning step are conducted in accordance with the invention at the cleanliness according to the US Federal Standards 209d of class 10,000 or less, a risk of causing image defects when conducting image recording to the sheet-like recording material can be suppressed remarkably. Specifically, when image recording is conducted to a sheet-like recording material, occurrence of blanking or scratches can be suppressed as much as possible.

In the invention, the packaging material used for packaging the sheet-like recording material is preferably selected from those causing less powdery dusts. Particularly, in a case where the circumstance can no more be maintained for the cleanliness of class 10,000 or less according to the US Federal Standards 209d due to the powdery dusts of the packaging material, it is preferred not to select such packaging material.

10) Other Utilizable Technique

The techniques that can be used for the photothermographic material of the invention can also include EP No. 803764A1, EP No. 883022A1, WO 98/36322, JP-A Nos. 56-62648, 58-62644, 9-43766, 9-281637, 9-297367, 9-304869, 9-311405, 9-329865, 10-10669, 10-62899, 10-69023, 10-186568, 1090823, 10-171063, 10-186565, 10-186567, 10-186569~10-186572, 10-197974, 10-197982, 10-197983, 10-197985~10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536~11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298.

In a case of a multi-color photosensitive photothermographic material, the image-forming layers are generally kept and separated from each other by using a functional or not-functional barrier layer between each of the photosensitive layers as described in U.S. Pat. No. 4,460,681.

A multi-colored photosensitive photothermographic material may comprises the combination of two layers on every color, or may contain all ingredients in one single layer as described in U.S. Pat. No. 4,708,928.

3. Image Forming Method

1) Image-Exposure

As laser beam according to the invention, He—Ne laser of red through infrared emission, red laser diode, or $Ar^+$, He—Ne, He—Cd laser of blue through green emission, blue laser diode are used. Preferred laser is red to infrared laser diode and the peak wavelength of the laser beam is 600 nm to 900 nm, amd more preferably 620 nm to 850 nm. In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future. The peak wavelength of blue laser beam is preferably 300 nm to 500 nm, and particularly preferably 400 nm to 500 nm.

Laser beam which oscillates in a longitudinal multiple modulation by a method such as high frequency superposition is also preferably employed.

2) Heat Development

Although the development of the photothermographic material of the invention is usually performed by elevating the temperature of the photothermographic material exposed imagewise, any method may be used for this thermal development process. The temperature for the development is preferably 80° C. to 250° C., more preferably 100° C. to 140° C., and further preferably 110° C. to 130° C. Time period for the development is preferably 1 second to 60 seconds, more preferably 3 seconds to 30 seconds, further preferably 5 seconds to 25 seconds, and particularly preferably 7 seconds to 16 seconds. For the photothermographic material of the invention, development is possible even at a high transportation speed of 23 mm/sec or higher during heat development. In a case of using a composition of such a sensitive material for rapid processing, the storability is favorable by the provision of the layer constitution according to the invention. Further, development is possible even at 27 mm/sec or higher.

In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing apparatus in which a visible image is obtained by bringing a photothermographic material with a formed latent image into contact with a heating means at a thermal developing portion, wherein the heating means comprises a plate heater, and plurality of retainer rollers are oppositely provided along one surface of the plate heater, the thermal developing apparatus is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferable that the heater is more stably controlled. Preferable imagers which enable a rapid process according to the invention are described in, for example, JP-A Nos. 2002-289804 and 2002-287668. When such imagers are used, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, to use the photothermographic materials of the invention in combination, which are highly sensitive and less susceptible to the environmental temperature, is preferred.

In a case where the distance between the exposure portion and the development portion is shortened, a series of processing time for exposure and development is extremely shortened. Further, the shorter distance is more preferred since a compact structure is intended for the heat developing machine. When the photothermographic material according to the invention is used, images with no unevenness can be obtained even when the distance between the exposure portion and the development portion is 0 cm or more and 50 cm or less, and the storability of the obtained images is also favorable. Further, the effect of the invention can be obtained even when the distance is 3 cm or more and 40 cm or less.

The exposure portion is a position at which the light from the exposure light source is irradiated to the photothermographic material and the developed portion is a position heated at which the photothermographic material is at first heated for conducting heat development.

Figure 2:
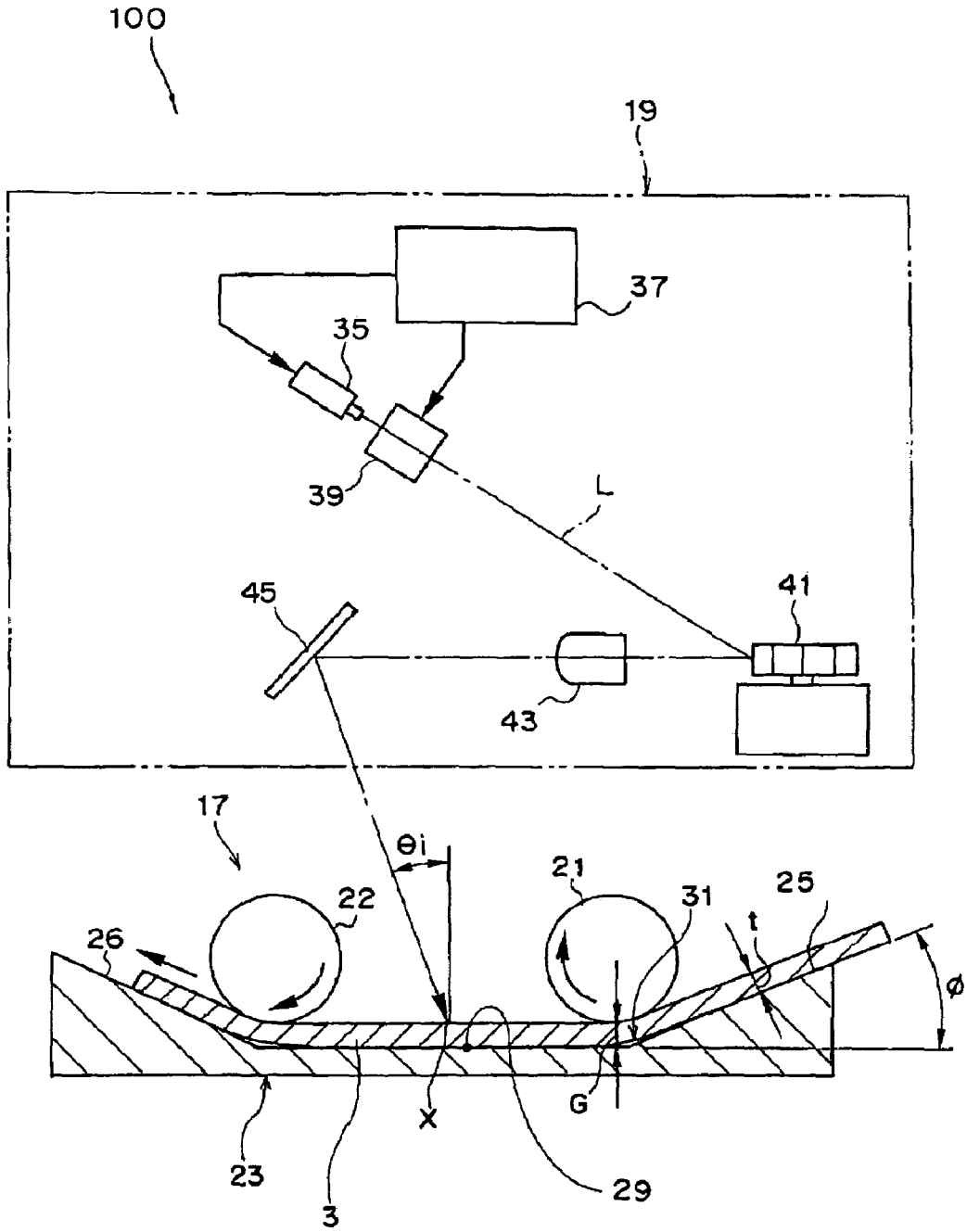
FIG. 2 is a constitutional view showing a schematic constitution of a transportation portion for transporting a sheet-like photothermographic material and a scanning exposure portion in the laser-recording device.

Referring to FIG. 1 and FIG. 2, the exposure portion and the developing portion are to be explained. X in FIG. 1 and FIG. 2 is an exposure portion and Y at which the sensitive material transported from 53 in FIG. 1 is in contact at first with a plate 51*a* is a developing portion. Also in a developing machine in which the distance is 50 cm or less, the effect of the invention can be obtained by using the photothermographic material according to the invention. In FIG. 1, are depicted, a heat developing recording apparatus 150, a heat developing recording material 3, photosensitive materials tray 10*a*, 10*b*, 10*c*, sheet transportation rollers 13*a*, 13*b*, 13*c*, photosensitive materials 15*a*, 15*b*, 15*c*, an upper light screen cover 16, a sub-scanning transportation portion (sub-scanning means) 17, a scanning exposure portion (laser irradiation means) 19, heat developing plates 51*a*, 51*b*, 51*c*, a driving roller 52, a speed reduction gear 53, a counter transportation roller 55, a cooling rotor 57, a cooling rotor 59, a cooling plate 61, a discharge roller 63, a heat developing recording material supply portion A, an image exposure portion B, a heat developing portion C, a cooling portion D, a power supply/control section E, and an optical beam L. Further in FIG. 2, are depicted a laser recording apparatus 100 in the image exposure portion B in FIG. 1, driving rollers 21, 22, a guide plate 23, slope portions 25, 26, an abutting portion 29, a guide plate 31, a semiconductor laser 35, a driving circuit 37, an intensity modifier 39, a polygonal mirror 41, a condensing lens 43, a mirror 45, and a laser light L.

Even in a case where development has already been started for a portion of an already exposed sheet during exposure for a portion of the sheet sensitive material, the problem that the exposed area is contaminated by the volatile material can be solved by using the photothermographic material of the invention. In addition, this method can further shorten the processing time.

In a case where the power supply for the heat developing apparatus was turned off for one night, the temperature for the heat developing portion is identical with the room temperature. Just after the turn on of the power supply, it is difficult to obtain stable output images because it has not yet reached a preferred development temperature or hunting range for the temperature is large. Accordingly, for attaining the preferred developing conditions described above, it is necessary to elevate the temperature for the heat developing portion and, further, it also needs a time for stabilization.

Since the photothermographic material according to the invention less undergoes the effect of the external circumstance and the image output is stable, stable images can be obtained even under severe development conditions of starting development a short time after turning-on of the power supply.

For example, even in a case where the time after the turning-on of the heat developing apparatus till the arrival of the top end of the photothermographic material to the heat developing portion is within 15 min, the storage stability of the obtained images is favorable. In this case "top end of the photothermographic material" means a portion of the sensitive material in a case where the sensitive material comprising the photothermographic material is transported after exposure and reaches at first the warmed portion of the heat developing machine, and "heat developing portion" means such a warmed portion of the heat developing machine.

3. System

Examples of a medical laser imager equipped with an exposing portion and a thermal developing portion include Fuji Medical Dry Laser Imager FM-DP L and DRYPIX 7000. In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

4. Application Use of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is to be described specifically by way of examples but the invention is not restricted to them.

Example 1

Preparation of PET Support

1) Film Preparation

Using terephthalic acid and ethylene glycol, PET at an intrinsic viscosity: IV=0.66 (measured in phenol/tetrachloroethane=6/4 (mass ratio) at 25° C.) was obtained in accordance with an ordinary method. After pelleting the same, it was dried at 130° C. for 4 hours, melted at 300° C. and then extruded from a T-die after melting, and quenched to prepare a not-stretched film.

It was stretched longitudinally by 3.3 times using rolls of different circumferential speeds and then stretched laterally by 4.5 times by a tenter. The temperature in this process was 110° C. and 130° C., respectively. Then, after heat setting at 240° C. for 20 sec, it was relaxed by 4% in the lateral direction. Then, after slitting the chuck portion of the tenter, both ends were applied with knurling, and taken up at 4 kg/cm$^2$ to obtain a roll of 175 μm thickness.

2) Surface Corona Treatment

The film was treated by using a solid state corona discharging treating machine model 6 KVA manufactured by PILLAR Co., at 20 m/min while putting both surfaces of a support under a room temperature. Based on the read values for current and voltage, it was found that treatment at 0.375 kV·A·min/m$^2$ was applied to the support. In this process, the treating frequency was 9.6 kHz and a gap clearance between the electrode and the dielectric roll was 1.6 mm.

3) Undercoat

| | |
|---|---|
| Formulation (1) (for undercoat layer on the side of image-forming layer) | |
| PESRESIN A-520 (30% by mass solution) manufactured by Takamatsu Yushi. Co. | 46.8 g |
| BAIRONAL MD-1200 manufactured by Toyo Boseki Co. | 10.4 g |
| Polyethylene glycol monononylphenyl ether (average ethylene oxide number = 8.5) 1% by mass solution | 11.0 g |
| MP-1000 (fine PMMA polymer particles, average particle size 0.4 μm) manufactured by Soken Chemical Co. | 0.91 g |
| Distilled water | 931 ml |
| Formulation (2) (First layer on back surface) | |
| Styrene-butadiene copolymer latex (solid content 40% by mass, styrene/butadiene weight ratio = 68/32) | 130.8 g |
| Sodium salt of 2,4-dichloro-4-hydroxy-S-triazine 8% by mass aqueous solution | 5.2 g |
| Sodium lauryl benzene sulfonate 1% by mass aqueous solution | 10 ml |
| Polystyrene particle dispersant (average particle size 2 μm, 20% by mass) | 0.5 g |
| Distilled water | 854 ml |
| Formulation (3) (Second layer on the side of back surface) | |
| $SnO_2$/SbO (9/1 mass ratio, average particle size 0.5 μm, 17% by mass dispersion) | 84 g |
| Gelatin | 7.9 g |
| METROSE TC-5 (2% by mass aqueous solution) manufactured by Shinetsu Chemical Co. | 10 g |
| Sodium dodecylbenzene sulfonate 1% by mass aqueous solution | 10 ml |
| NaOH (1% by mass) | 7 g |
| Proxel (manufactured by Abicia Co.) | 0.5 g |
| Distilled water | 881 ml |

After applying the corona discharging treatment to both surfaces of the biaxially stretched polyethylene terephthalate support of 175 μm thickness described above, the undercoating solution Formulation (1) described above was coated on one surface (surface of image-forming layer) by a wire bar in a wet coating amount of 6.6 ml/m$^2$ (per one surface), and then dried at 180° C. for 5 min. Then, the undercoating solution Formulation (2) described above was coated to the rear face (back surface) thereof by a wire bar in a wet coating amount of 5.7 ml/m$^2$ and dried at 180° C. for 5 min. Further, the undercoating solution Formulation (3) described above was coated on the rear face (back surface) by a wire bar in a wet coating amount of 8.4 ml/m$^2$ and dried at 180° C. for 6 min to prepare an undercoated support.

Back Layer

1) Preparation of Back Layer Coating Solution

Preparation of Fine Solid Particle Liquid Dispersion (a) of Basic Precursor 2.5 kg of a basic precursor compound 1, 300 g of a surfactant (DEMOL N; trade name of products manufactured by Kao Co), 800 g of diphenylsulfone, 1.0 g of sodium benzothiazolinone and distilled water were added and mixed so as to make up the total amount to 8.0 kg, and a liquid mixture was put to beads dispersion by a horizontal sand mill (UVM-2; manufactured by Aimex Co.). As the dispersion method, the liquid mixture was fed by a diaphragm pump to UVM-2 filled with zirconia beads of an average diameter of 0.5 mm and dispersed till a desired average particle size was obtained in a state of an internal pressure at 50 hPa or higher.

The dispersion was dispersed till the ratio between absorption at 450 nm and absorption at 650 nm (D450/650) in the spectral absorption of the dispersion reached 3.0 as a result of spectral absorptiometry. The obtained dispersion was diluted with distilled water such that the concentration of the basic precursor was 25% by mass, filtered for removing dusts (through polypropylene filter with an average pore size of 3 μm) and served for practical use.

2) Preparation of Fine Solid Dye Particle Liquid Dispersion 6.0 kg of a cyanine dye compound-1, 3.0 kg of sodium p-dodecylbenzene sulfonate, 0.6 kg of a surfactant DEMOL SNB (manufactured by Kao Co.) and 0.15 kg of a defoamer (SURFINOL 104E, trade name of products manufactured by Nisshin Kagaku Co.) were mixed with distilled water to make up the total liquid amount to 60 kg. The liquid mixture was dispersed with zirconia beads of 0.5 mm by using a horizontal sand mill (UVM-2: manufactured by Aimex Co.).

The dispersion was dispersed till the ratio between absorption at 650 nm and absorption at 750 nm (D650/750) in the spectral absorption of the dispersion reached 5.0 or more as a result of spectral absorptiometry. The obtained dispersion was diluted with distilled water such that the concentration of the cyanine dye was 6% by mass and filtered for removing dusts through a filter (average pore size: 1 μm) for practical use.

(3) Preparation of Anti-halation Layer Coating Solution

A vessel was kept at 40° C., in which 40 g of gelatin, 0.1 g of benzoisothiazolinone, and 490 ml of water were added to dissolve gelatin. Further, 2.3 ml of an aqueous solution of 1 mol/L sodium hydroxide, 40 g of the fine solid dye particle liquid dispersion, 90 g of fine solid particle liquid dispersion of the basic precursor (a), 12 ml of a 3% aqueous solution of sodium polystyrene sulfonate, and 180 g of a 10% by mass SBR latex solution were mixed. 80 ml of a 4% aqueous solution of N,N-ethylene bis(vinylsulfone acetoamide) was mixed just before coating to prepare an anti-halation coating solution.

4) Preparation of Back Surface Coating Solution

Preparation of Back Surface Coating Solution-1

A vessel was warmed and kept at 40° C., in which 40 g of gelatin, 35 mg of benzoisothiazolinone and 840 ml of water were added to dissolve gelatin. Further, 5.8 ml of an aqueous solution of 1 mol/L sodium hydroxide, 5 g of a 10% by mass emulsion of liquid paraffin, a 10% by mass emulsion of triisostearic acid trimethylol propane, 10 ml of a 5% by mass aqueous solution of sodium di(2-ethylhexyl)sulfo succinate, 20 ml of a 3% by mass aqueous solution of sodium polystyrene sulfonate, 2.4 ml of a 2% by mass solution of fluoric surfactant (FF-1), 2.4 ml of a 2% by mass solution of fluoric surfactant (FF-2), and 32 g of a 19% by mass solution of methyl methacrylate/styrene/butylacrylate/hydroxyethyl methacrylate/acrylic acid copolymer (copolymer weight ratio: 57/8/28/5/2) latex were mixed. Just before coating, 25 ml of a 4% by mass aqueous solution of N,N-ethylene bis(vinylsulfone acetamide) was mixed to prepare a coating solution for protecting layer of the back surface.

5) Coating of Back Layer

On the back surface of the undercoated support, were coated an anti-halation layer coating solution such that the gelatin coating amount was 0.52 g/m$^2$ and a coating solution for protective layer on the back surface such that the gelatin coating amount was 1.7 g/m$^2$, simultaneously, by stacked layer coating and dried to prepare a back layer. Image-forming layer, intermediate layer and surface protective layer 1) Preparation of Coating Material (1) Silver Halide Emulsion Preparation of Silver Halide Emulsion 1

A solution formed by adding 3.1 ml of a 1% by mass potassium iodide solution to 1421 ml of distilled water and further adding 3.5 ml of sulfuric acid at 0.5 mol/l concentration and 31.7 g of gelatin phthalide was kept in a stainless steel reaction pot at a liquid temperature of 30° C. while stirring. Then, a solution A formed by adding distilled water to 22.22 g of silver nitrate to be diluted to 95.4 ml and a solution B formed by adding distilled water to 15.3 g of potassium bromide and 0.8 g of potassium iodide to be diluted to 97.4 ml volume were added entirely at a constant flow rate for 45 sec. Then, 10 ml of an aqueous 3.5% by mass solution of hydrogen peroxide was added and, further, 10.8 ml of an aqueous 10% by mass solution of benzoimidazole was added. Further, a solution C formed by adding distilled water to 51.86 g of silver nitrate to be diluted to 317.5 ml and a solution D formed by diluting 44.2 g of potassium bromide and 2.2 g of potassium iodide with distilled water to be diluted to 400 ml were added by adding the solution C by an entire amount at a constant flow rate for 20 min while adding the solution D by a controlled dubble jet method while keeping pAg at 8.1. Potassium hexachloro iridate (III) was added by the entire amount so as to be $1\times10^{-4}$ per one mol of silver 10 min after the start of addition of the solution C and the solution D. Further, an aqueous solution of potassium hexacyano ferrate (II) was added by the entire amount by $3\times10^{-4}$ mol per one mol of silver 5 sec after the completion of addition of the solution C. pH was adjusted to 3.8 using sulfuric acid at 0.5 mol/L concentration, stirring was stopped and a settling/desalting/water washing step was conducted. pH was adjusted to 5.9 using sodium hydroxide at 1 mol/L concentration to prepare a silver halide dispersion at pAg of 8.0.

The silver halide dispersion described above was kept at 38° C. while stirring, 5 ml of a 0.34% by mass methanol solution of 1,2-benzoisothiazoline-3-one was added and, 40 min after, temperature was elevated to 47° C. 20 min after the temperature elevation, sodium benzenethiosulfonate in a methanol solution was added by $7.6\times10^{-5}$ mol to one mol of silver and, further 5 min after, a tellurium sensitizer C in a methanol solution was added by $2.9\times10^{-4}$ mol per one mol of silver and aged for 91 min. Then, a methanol solution of a spectral sensitizing dye A and a sensitizing dye B at a molar ratio of 3:1 was added by $1.2\times10^{-3}$ mol as a total for the sensitizing dyes A and B per one mol of silver. One min after, 1.3 ml of a 0.8% by mass methanol solution of N,N'-dihydroxy-N"-diethylmelamine was added. Further 4 min after, 5-methyl-2-mercaptobenzoimidazole in a methanol solution was added by $4.8\times10^{-3}$ mol per one mol of silver and 1-phenyl-2-heptyl-5-mercapto-1,3,4-triazole in a methanol solution was added by $5.4\times10^{-3}$ mol based on one mol of silver and 1-(3-methylureido-5-mercapto-tetrazole in an aqueous solution was added by $8.5\times10^{-3}$ mol per one mol of silver to prepare a silver halide emulsion 1.

The particles in the silver halide emulsion thus prepared were silver bromoiodide particles homogeneously containing 3.5% by mole of iodide with an average sphere equivalent diameter of 0.042 μm and a fluctuation coefficient of sphere equivalent diameter of 20%. The particle size and the like were determined from the average for the particles by the number of 1000 using an electron microscope. The {100} face ratio of the particles was determined as 80% by using the Kubelka-Munk method.

Preparation of Silver Halide Emulsion 2

A silver halide emulsion 2 was prepared in the same manner as in the preparation of the silver halide emulsion 1 except for changing the liquid temperature upon particle formation from 30° C. to 47° C., changing dilution for the solution B to that for 15.9 g of potassium bromide with distilled water to 97.4 ml volume, changing dilution for the solution D to that for 45.8 g of potassium bromide with distilled water to 400 ml volume, changing the addition time of the solution C to 30 min and removing potassium hexacyano ferrate (II), and conducting precipitation/desalting/water washing/dispersion in the same manner as for the silver halide emulsion 1. Spectral sensitization, chemical sensitization, and addition of 5-methyl-2-mercaptobenzoimidazole and 1-phenyl-2-heptyl-5-mercapto-1,3,4-triazole were conducted in the same manner as in the emulsion 1 except for changing the addition amount of the tellurium sensitizer C to $1.1\times10^{-4}$ mol per one mol of silver, the addition amount of the methanol solution of the spectral sensitizing dye A and the spectral sensitizing dye B at a 3:1 molar ratio to $7.0\times10^{-4}$ mol as the sum for the sensitizing dye A and the sensitizing B per one mol of silver, and changing the addition amount of 1-phenyl-2-ceptyl-5-mercapto-1,3,4-triazole to $3.3\times10^{-3}$ mol per one mol of silver and 1-(3-methylureido)-5-mercaptotetrazole to $4.7\times10^{-3}$ mol per one mol of silver, to obtain a silver halide emulsion 2. The emulsion particles of the silver halide emulsion 2 were pure silver bromide cuboidal particles with an average sphere equivalent diameter of 0.080 μm and a fluctuation coefficient of the sphere-equivalent diameter of 20%.

Preparation of Silver Halide Emulsion 3

A silver halide emulsion 3 was obtained in the same manner as in the preparation of the silver halide emulsion 1 except for changing the liquid temperature upon particle formation from 30° C. to 27° C. and conducting precipitation/desalting/water washing/dispersion in the same manner as for the preparation of the silver halide emulsion 1. A silver halide emulsion 3 was obtained in the same manner as in the emulsion 1 except for changing the addition amount of the spectral sensitizing dye A and the spectral sensitizing dye B at a molar ratio of 1:1 as a solid dispersion (aqueous gelatin solution) to $6\times10^{-3}$ mol for the sum of the sensitizing dye A and sensitizing dye B per one mol of silver, changing the addition amount of the tellurium sensitizing agent C to $5.2\times10^{-4}$ mol per one mol of silver and adding $5\times10^{-4}$ mol of bromoauric acid per one mol of silver and $2\times10^{-3}$ mol of potassium thiocyanate per one mol of silver 3 min after the addition of the tellurium sensitizing agent. The emulsion particles of the silver halide emulsion 3 were silver bromoiodide particles containing 3.5% by mole of iodide homogeneously with an average sphere equivalent diameter of 0.034 μm and with a fluctuation coefficient of sphere equivalent diameter of 20%.

Preparation of Mixed Emulsion A for Coating Solution

70% by mass of the silver halide emulsion 1, 15% by mass of the silver halide emulsion 2 and 15% by mass of the silver halide emulsion 3 were dissolved, to which benzothiazolium iodide in a 1% by mass aqueous solution was added by $7\times10^{-3}$ mol per one mol of silver.

Further, compounds 1, 2 and 3 capable of releasing one electron or more electrons from 1-electron oxidant formed by 1-electron oxidation were added each in an amount of $2\times10^{-3}$ mol per one mol of silver halide.

Adsorptive redox compounds 1, 2 each having an adsorptive group and a reducing group were added each in an amount of $5\times10^{-3}$ mol per one mol of the silver halide.

Further, water was added such that the content of the silver halide per 1 kg of the mixed emulsion for coating solution was 38.2 g as silver. 1-(3-methylureido)-5-mercaptotetarzole was added so as to be 0.34 g per 1 kg of the mixed emulsion for coating solution.

2) Preparation of Organic Silver Salt Dispersion

Purification of Recrystallized Behenic Acid A 100 kg of behenic acid manufactured by Henkel Co. (trade name of product; Edenor C 22-85R) was mixed in 1200 kg of isopropyl alcohol, dissolved at 50° C., filtered through a 10 μm filter, and then cooled to 30° C. to conduct recrystallization. The cooling rate upon recrystallization was controlled to 3° C./hr. The resultant crystals were centrifugally filtered, scrubbed with 100 kg of isopropyl alcohol and then the crystallization was further conducted twice repetitively. Then, precipitates in the initial stage of recrystallization were filtered to remove lignoceric acid and dried. When the obtained crystals were esterified and measured by GC-FID, the behenic acid content was 96%. The content of erucic acid was 0.000001% or less.

Preparation of Recrystallized Stearic Acid 100 kg of stearic acid manufactured by Tokyo Kasei Co. was mixed in 1200 kg of isopropyl alcohol, dissolved at 50° C., filtered through a 10 μm filter, and then cooled to 20° C. to conduct recrystallization. The cooling rate upon recrystallization was controlled to 3° C./hr. The resultant crystals were centrifugally filtered, scrubbed with 100 kg of isopropyl alcohol and then the crystallization was further conducted twice repetitively. Then, precipitates in the initial stage of recrystallization were filtered to remove carboxylic acids having longer chain length than stearic acid and dried. When the obtained crystals were esterified and measured by GC-FID, the stearic acid content was 99.99% by mole. The content of erucic acid was 0.000001% or less.

Preparation of Organic Silver Salt Dispersion A 40 g of recrystallized behenic acid A, 7.3 g of recrystallized stearic acid, and 500 ml of water were stirred at a temperature of 90° C. for 15 min, 187 ml of 1N NaOH was added for 15 min, 61 ml of aqueous 1N nitric acid solution was added and the temperature was lowered to 50° C. Then, 124 ml of an aqueous solution of 1N silver nitrate was added for 2 min and stirred as it was for 30 min. Then, solid contents were separated by filtration under suction and the solids were water-washed such that the conductivity of the filtered water was 30 μS/cm. The thus obtained solids were stored as wet cakes without drying.

The obtained crystals contained 82% by mole of behenic acid and 18% by mole of stearic acid.

19.3 kg of polyvinyl alcohol (trade name of products: PVA-217) and water were added to wet cakes corresponding to 260 kg of dry solids to make the entire amount to 1,000 kg, which were then slurrified by dissolver blades and, further, preliminarily dispersed by a pipeline mixer (Model PM-10, manufactured by Mizuho Industry Co.).

Then, a stock solution after the preliminary dispersion was treated for three times while controlling the pressure of a dispersing machine (trade name of product; Micro Fluidizer M-610, manufactured by MicroFluidex International Corp., using Z-type interaction chamber) to 1150 kg/cm$^2$, to obtain a silver behenate dispersion. For the cooling operation, bellows type heat exchangers were mounted before and after the interaction chamber, respectively, and the dispersion temperature was set at 18° C. by controlling the temperature of a coolant.

According to electron microscopic observation, preparation of the organic silver salt dispersion A as needle particles having an average miner diameter of 0.04 μm, an average major diameter of 0.8 μm and fluctuation coefficient of projection area of 30% was completed.

3) Preparation of Reducing Agent Dispersion

Preparation of Reducing Agent-1 Dispersion 10 kg of water was added to 10 kg of a reducing agent-1 (6,6'-di-t-butyl-4,4'-dimethyl-2,2'-butylidene diphenol) and 16 kg of an aqueous 10% by mass solution of modified polyvinyl alcohol (Poval MP203, manufactured by Kuraray Co.) and mixed thoroughly to form a slurry. The slurry was fed by a diaphragm pump, dispersed for 3 hrs and 30 min by a horizontal sand mil (UVM-2; manufactured by Aimex Co.) filled with zirconia beads of an average diameter of 0.5 mm, then 0.2 g of a sodium salt of benzoisothiazolinone and water were added to control such that the concentration of the reducing agent was 25% by mass. The liquid dispersion was heated at 40° C. for one hour and successively applied with a heat treatment at 80° C. for one hour to obtain a reducing agent-10 dispersion. The reducing agent particles contained in the thus obtained reducing agent dispersion had a median diameter of 0.50 μm and a maximum grain size of 1.6 μm or less. The thus obtained reducing agent dispersion was filtered through a polypropylene filter of 3.0 μm pore size to remove obstacles such as dusts and then stored.

4) Preparation of Hydrogen Bonding Compound-1 Dispersion 10 kg of water was added to 10 kg of a hydrogen bonding compound-1 (tri(4-t-butylphenyl)phosphine oxide) and 16 kg of an aqueous 10% by mass solution of a modified polyvinyl alcohol (Poval MP203, manufactured by Kuraray Co.) and mixed thoroughly to prepare a slurry. The slurry was fed by a diaphragm pump and, after dispersion by a horizontal type sand mill filled with zirconia beads with an average diameter of 0.5 mm (UVM-2: manufactured by Aimex Co.) for 4 hours, 0.2 g of a sodium salt of benzoisothiazolinone and water were added to prepare such that the concentration of the hydrogen bonding compound was 25% by mass. The liquid dispersion was heated at 40° C. for one hour and then successively heated at 80° C. for one hour, to obtain a hydrogen bonding compound-1 dispersion. The thus obtained hydrogen bonding compound particles contained in the hydrogen bonding compound dispersion had a median diameter of 0.45 μm and a maximum particle diameter of 1.3 μm or less. The obtained hydrogen bonding compound dispersion was filtered through a polypropylene filter having a pore size of 3.0 μm to remove obstacles such as dusts and stored.

5) Preparation of Development Accelerator-1 Dispersion 10 kg of water was added to 10 kg of a development accelerator-1 and 20 kg of an aqueous 10% by mass solution of a modified polyvinyl alcohol (Poval MP203, manufactured by Kuraray Co.) and mixed thoroughly to prepare a slurry. The slurry was fed by a diaphragm pump and, after dispersion by a horizontal type sand mill filled with zirconia beads with an average diameter of 0.5 mm (UVM-2: manufactured by Aimex Co.) for 3 hours and 30 min, 0.2 g of a sodium salt of benzoisothiazolinone and water were added to prepare such that the concentration of the development accelerator was 20% by mass, to obtain a development accelerator-1 dispersion. The thus obtained development accelerator particles in the development accelerator dispersion had a median size of 0.48 μm and a maximum particle size of 1.4 μm or less. The obtained development accelerator dispersion was filtered through a polypropylene filter having a pore size of 3.0 μm to remove obstacles such as dusts and stored.

6) Preparation of Development Accelerator-2 and Color-tone-adjusting-agent-1 Dispersion Solid dispersions of the development accelerator-2 and color-tone-adjusting-agent-1 were also dispersed by the same method as in the development accelerator-1, to obtain 20% by mass and 15% by mass liquid dispersions, respectively.

7) Preparation of Polyhalogen Compound Dispersion

Preparation of Organic Polyhalogen Compound-1 Dispersion 10 kg of an organic polyhalogen compound-1 (tribromo methanesulfonyl benzene), 10 kg of an aqueous 20% by mass solution of modified polyvinyl alcohol (Poval MP203, manufactured by Kuraray Co.), 0.4 kg of an aqueous 20% by mass solution of sodium triisopropyl naphthalene sulfonate and 14 kg of water were added and mixed thoroughly to form a slurry. The slurry was fed by a diaphragm pump and dispersed in a horizontal type sand mill filled with zirconia beads of an average diameter of 0.5 mm (UVM-2: manufactured by Aimex Co.) for 5 hours and then 0.2 g of a sodium salt of benzoisothiazolinone and water were added to prepare such that the concentration of the organic polyhalogen compound was 26% by mass, to obtain an organic polyhalogen compound-1 dispersion. The thus obtained organic polyhalogen compound particles contained in the polyhalogen compound dispersion had a median diameter of 0.41 μm and a maximum particle size of 2.0 μm or less. The obtained organic polyhalogen compound dispersion was filtered through a polypropylene filter having a pore size of 10.0 μm to remove obstacles such as dusts and stored.

Preparation of Organic Polyhalogen Compound-2 Dispersion 10 kg of an organic polyhalogen compound-2 (N-butyl-3-tribromo methane sulfonuyl benzoamide), 20 kg of an aqueous 10% by mass solution of modified polyvinyl alcohol (Poval MP203, manufactured by Kuraray Co.) and 0.4 kg of an aqueous 20% by mass solution of sodium triisopropyl naphthalene sulfonate were added and mixed thoroughly to form a slurry. The slurry was fed by a diaphragm pump and dispersed in a horizontal type sand mill filled with zirconia beads of an average diameter of 0.5 mm (UVM-2: manufactured by Aimex Co.) for 5 hours and then 0.2 g of a sodium salt of benzoisothiazolinone and water were added to prepare such that the concentration of the organic polyhalogen compound was 30% by mass. The dispersion was heated at 40° C. for 5 hours to obtain an organic polyhalogen compound-2 dispersion. The thus obtained organic polyhalogen compound particles contained in the polyhalogen compound dispersion had a median diameter of 0.40 μm and a maximum particle size of 1.3 μm or less. The obtained organic polyhalogen compound dispersion was filtered through a polypropylene filter having a pore size of 3.0 μm to remove obstacles such as dusts and stored.

8) Preparation of Phthalazine Compound-1 Solution 8 kg of modified polyvinyl alcohol MP 203 manufactured by Kuraray Co. was dissolved in 174.57 kg of water and then 3.15 kg of an aqueous 20% by mass solution of sodium triisopropyl naphthalene sulfonate and 14.28 kg of an aqueous 70% by mass solution of phthalazine compound-1 (6-isopropyl phthalazine) were added to prepare a 5% by mass solution of phthalazine compound-1.

9) Preparation of Mercapto Compound

Preparation of Aqueous Mercapto Compound-1 solution 7 g of a mercapto compound-1 (1-(3-sulfophenyl)-5-mercaptotetrazole sodium salt) was dissolved in 993 g of water to form an aqueous 0.7% by mass solution.

Preparation of Aqueous Mercapto Compound-2 Solution 20 g of a mercapto compound-2 (1-(3-methylureido phenyl)-5mercaptotetrazole) was dissolved in 980 g of water to form an aqueous 2.0% by mass solution.

10) Preparation of Pigment-1 Dispersion 250 g of water was added to 64 g of C.I. Pigment Blue 60 and 6.4 g of DEMOL N manufactured by Kao Corp. and mixed thoroughly to form a slurry. 800 g of zirconia beads with an average diameter of 0.5 mm were provided, charged together with the slurry into a vessel and dispersed in a dispersing device (1/4 G sand grinder mill, manufactured by Aimex Co.) for 25 hours. Water was added to prepare such that the pigment concentration was 5% by mass to obtain a pigment-1 dispersion. The average particle size of the pigment particles contained in the obtained pigment dispersion was 0.21 μm.

11) Preparation of SBR Latex Liquid

SBR latex was prepared as described below.

287 g of distilled water, 7.73 g of a surfactant (Pionin A43-S (manufactured by Takemoto Yushi Co.): solid content, 48.5% by mass), 14.06 ml of 1 mol/L NaOH, 0.15 g of tetrasodium ethylenediamine tetraacetate, 255 g of styrene, 11.25 g of acrylic acid, and 3.0 g of tert-dodecylmercaptane were charged in a polymerization vessel of a gas monomer reaction apparatus (model TAS-2J, manufactured by Taiatsu Glass Industry Co.), the reaction vessel was tightly closed and they were stirred at a stirring speed of 200 rpm. After evacuating by a vacuum pump and repeating nitrogen gas substitution for several times, 108.75 g of 1,3-butadiene was charged under pressure and the temperature was elevated to an internal temperature of 60° C. A solution containing 1.875 g of ammonium persulfate dissolved in 50 ml of water was added and stirred for 5 hours as it was. Further, stirring was conducted for three hours under temperature elevation to 90° C. and, after the completion of the reaction and after lowering the internal temperature to a room temperature, NaOH and $NH_4OH$ at 1 mol/L were used and added such that $Na^+$ ion:$NH_4^+$ ion=1:5.3 (molar ratio) to adjust the pH to 8.4. Then, filtration was conducted by a polypropylene filter with a pore size of 1.0 μm to remove obstacles such as dusts and stored to obtain 774.7 g of an SBR latex. When halogen ions were measured by ion chromatography, the chloride ion concentration was 3 ppm. As a result of measuring the concentration of a chelating agent by high speed liquid chromatography, it was 145 ppm.

The latex had an average particle size of 90 nm, Tg=17° C., a solid concentration of 44% by mass, an equilibrium water content of 0.6% by mass at 25° C. and 60% RH, and an ionic conductivity of 4.80 mS/cm (ionic conductivity was measured by using a conductivity meter CM-30S manufactured by Toa Denpa Industry Co. for latex stock solution (44% by mass) at 25° C.).

2. Preparation of Coating Solution

1) Preparation of Image-forming Layer Coating Solution-1

1,000 g of the fatty acid silver salt dispersion A obtained as described above, 135 ml of water, 36 g of pigment-1 dispersion, 25 g of organic polyhalogen compound-1 dispersion, 39 g of organic polyhalogen compound-2 dispersion, 171 g of phthalazine compound-1 solution, 1060 g of SBR latex solution (Tg: 17° C.), 153 g of reducing agent-1 dispersion, 55 g of hydrogen bonding compound-1 dispersion, 4.8 g of development accelerator-1 dispersion, 5.2 g of development accelerator-2 dispersion, 2.1 g of color toning agent-1 dispersion, and 8 ml of an aqueous solution of mercapto compound-2 were added successively, and 140 g of silver halide emulsion mixture A was added just before coating and mixed thoroughly to form an image-forming layer coating solution, which was fed as it was to a coating dye and coated.

The viscosity of the image-forming layer coating solution was 40 [mPa·s] at 40° C. when measured by a B-type viscometer of Tokyo Keiki (No. 1 rotor 60 rpm).

The viscosity of the coating solution at 38° C. by using Rheo Stress RS150 manufactured by Haake Co. was 30, 43, 41, 28, and 20 (mPa·s) at the shearing rate of 0.1, 1, 10, 100, and 1000 (1/sec) respectively.

The amount of zirconium in the coating solution was 0.30 mg per one g of silver.

2) Preparation of Intermediate Layer A Coating Solution

Preparation of Intermediate Layer A Coating Solution-1

27 ml of an aqueous 5% by mass solution of aerosol OT (manufactured by American Cyanamid Co.) and 135 ml of an aqueous 20% by mass solution of diammonium phthalate were added to 1000 g of polyvinyl alcohol PVA-205 (manufactured by Kuraray Co.), 163 g of pigment-1 dispersion, 33 g of a 18.5% by mass aqueous solution of a blue dye compound-1 solution (KAYAFECT TURQUISE RN LIQUID 150: manufactured by Nippon Kayaku Co.), 27 ml of a 5% by mass aqueous solution of sodium di(2-ethylhexyl) sulfosuccinate, and 4200 ml of a 19% by mass solution of methylmethacrylate/styrene/butyl acrylate/hydroxyethyl methacrylate/acrylic acid copolymer (copolymerization mass ratio 57/8/28/5/2), and water was added to make up the total amount to 10000 g, which was controlled to pH 7.5 with NaOH to form an intermediate layer coating solution, which was fed to a coating die at 8.9 ml/$m^2$.

The viscosity of the coating solution was 58 [mPa·s] when measured at 40° C. by a B-type viscometer (No. 1 rotor, 60 rpm).

Preparation of Intermediate Layer A Coating Solutions 2 to 5

Intermediate layer A coating solutions-2 to 5 were prepared by changing polyvinyl alcohol PVA-205 and methyl methacrylate/styrene/butyl acrylate/hydroxylethyl methacrylate/acrylic acid copolymer used in the preparation of the intermediate layer A coating solution-1 to the binder shown in Table 2.

3) Preparation of Intermediate Layer B Coating Solution

Preparation of Intermediate Layer B Coating Solution-1

100 g of inert gelatin and 10 mg of benzoisothiazolinone were dissolved in 840 ml of water, and 180 g of a 19% by mass solution of methyl methacrylate/styrene/butyl acrylate/hydroxyethyl methacrylate/acrylic acid copolymer (copolymerization weight ratio 57/8/28/5/2) latex, 46 ml of a 15% by mass methanol solution of phthalic acid, and 5.4 ml of an aqueous 5% by mass solution of sodium di(2-ethylhexyl) sulfosuccinate were added and mixed, and 40 ml of 4% by mass chrome alum was mixed just before coating by a static mixer, which was fed to a coating die at a coating solution amount of 26.1 ml/$m^2$.

The viscosity of the coating solution was 20 [mPa·s] when measured by a B-type viscometer at 40° C. (No. 1 rotor, 60 rpm).

Preparation of Intermediate Layer B Coating Solutions 2 to 5

Intermediate layer B coating solutions-2 to 5 were prepared by changing the inert gelatin and the methyl methacrylate/styrene/butyl acrylate/hydroxylethyl methacrylate/ acrylic acid copolymer used in the preparation of the intermediate layer B coating solution-1 to the binder shown in Table 2.

4) Preparation of Outermost Layer Coating Solution

Preparation of Outermost Layer Coating Solution-1

100 g of inert gelatin and 10 mg of benzoisothiazolinone were dissolved in 800 ml of water, 40 g of a 10% by mass emulsion of liquid paraffin, 40 g of a 10% by mass emulsion of dipentaerythrityl hexaisostearate, 180 g of a 19% by mass solution of methyl methacrylate/styrene/butyl acrylate/hydroxyethyl methacrylate/acrylic acid copolymer (copolymerization weight ratio 57/8/28/5/2) latex, 40 ml of a 15% by mass solution of phthalic acid, 5.5 ml of a 1% by mass solution of a fluoro surfactant (FF-1), 5.5 ml of a 1% by mass solution of a fluoro surfactant (FF-2), 28 ml of an aqueous 5% by mass solution of sodium di(2-ethylhexyl)sulfosuccinate, 4 g of fine polymethyl methacrylate particles (average particle size of 0.7 μm, distribution of average volume addition of 30%), and 21 g of fine polymethyl methacrylate particles (average particle size of 3.6 μm, distribution of average volume addition of 60%) were mixed to form a surface protective layer coating solution, which was fed to a coating die such that the amount was 8.3 ml/m$^2$.

The viscosity of the coating solution was 19 [mPa·s] when measured by a B-type viscometer at 40° C. (No. 1 rotor, 60 rpm).

Preparation of Outermost Layer Coating Solutions 2 to 5

Outermost layer coating solutions-2 to 5 were prepared by changing the inert gelatin and the methyl methacrylate/styrene/butyl acrylate/hydroxylethyl methacrylate/acrylic acid copolymer used in the preparation of the outermost coating solution-1 to the binder shown in Table 2.

3. Preparation of Photothermographic Material

1) Preparation of Photothermographic Material-1

An image-forming layer coating solution-1, an intermediate layer A coating solution-1, and an intermediate B coating solution-1, an outermost coating solution were coated in this order on an undercoat layer on the surface opposite to the back surface simultaneously by stacked coating by a slide bead coating method to prepare a specimen of a photothermographic material. The temperature was controlled at 31° C. for the image-forming layer coating solution and the intermediate layer coating solution, at 36° C. for the surface protective first layer coating solution and at 37° C. for the surface protective second layer coating solution.

The coating amount (g/m$^2$) for each of the compounds in the image-forming layer is as described below.

| | |
|---|---|
| Organic silver salt | 4.878 |
| Pigment (C. I. Pigment Blue 60) | 0.0324 |
| Polyhalogen compound-1 | 0.108 |
| Polyhalogen compound-2 | 0.225 |
| Phthalazine compound-1 | 0.161 |
| SBR latex | 8.73 |
| Reducing agent-1 | 0.77 |
| Hydrogen bonding compound-1 | 0.522 |
| Development accelerator-1 | 0.018 |
| Mercapto compound-1 | 0.0018 |
| Mercapto compound-2 | 0.0108 |
| Silver halide (as Ag) | 0.09 |

The entire coating amount of silver in the photothermographic material was 1.18 g/m$^2$.

Coating and drying conditions are as shown below.

Coating was conducted at a speed of 160 m/min, the gap between the coating die top end and the support was set to 0.10 to 0.30 mm, and the pressure in a reduced pressure chamber was set lower by 196 to 882 Pa than the atmospheric pressure. The support was charge-eliminated by an ionic blow before coating.

In a succeeding chilling zone, the coating solution was cooled by a blow at a dry bulb temperature of 10 to 20° C. and then it was conveyed in a contactless manner, and dried in a helical contactless drying apparatus by a drying blow at a dry bulb temperature of 23 to 45° C. and at a wet bulb temperature of 15 to 21° C.

After drying and controlling the humidity to 40 to 60% RH at 25° C., the film surface was heated to 70 to 90° C. After heating, the film surface was cooled to 25° C.

2) Preparation of Photothermographic Materials-2 to 15

Photothermographic materials-2 to 5 were prepared in the same manner as for the Photothermographic material-1 except for coating the image-forming layer coating solution, intermediate layer A coating solution, intermediate layer B coating solution, and the outermost layer coating solution by the combination shown in Table 2. Further, Photothermographic materials 6 to 15 were prepared while dividing the intermediate layer B of each of the phototheromographic materials 6 to 15 into two layers and changing the binder compositions of the two layers to the compositions shown in table 2. The coating amount for each compound in the image-forming layer (g/m$^2$) is identical with that in the photothermographic material-1.

Chemical structures of the compounds used in the example of the invention are shown below.

Spectral sensitizing dye A

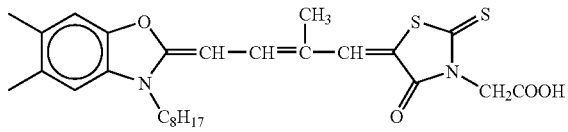

Spectral sensitizing dye B

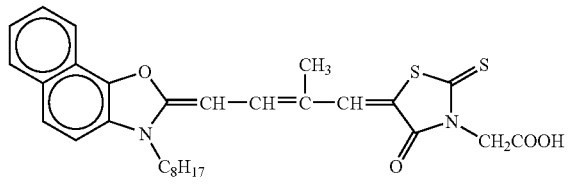

Tellurium sensitizing dye C

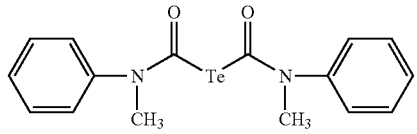

Compound 1 in which one-electron oxidant formed by one-electron oxidation can release one electron or more electrons

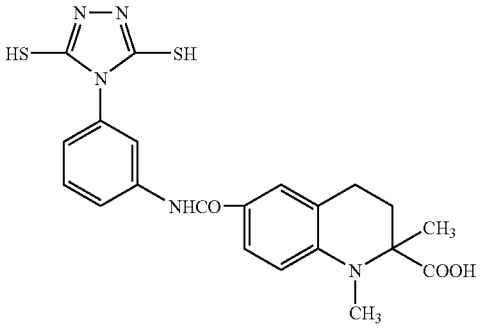

Compound 2 in which one-electron oxidant formed by one-electron oxidation can release one electron or more electrons

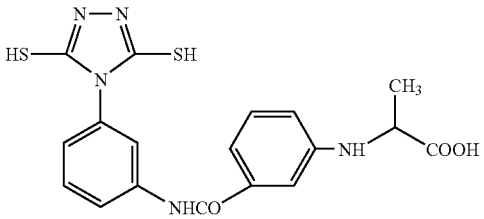

Compound 3 in which one-electron oxidant formed by one-electron oxidation can release one electron or more electrons

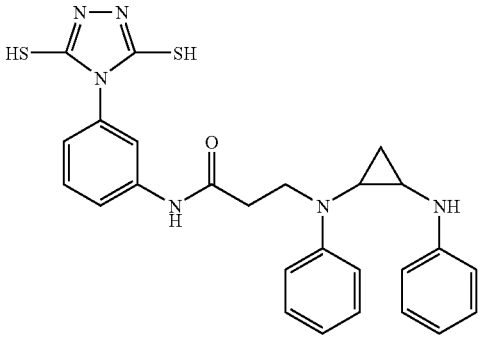

Absorptive redox compound 1 having absorptive group and reducing group

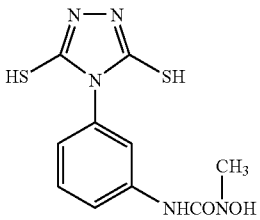

Absorptive redox compound 2 having absorptive group and reducing group

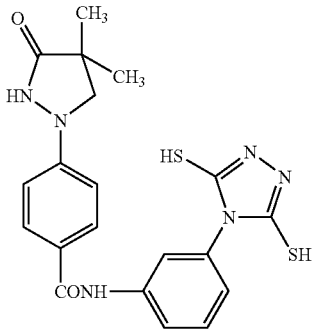

Base precursor compound 1

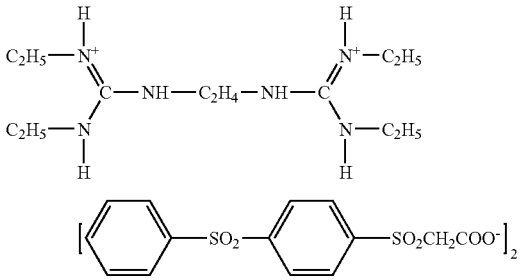

Cyanine dye compound-1

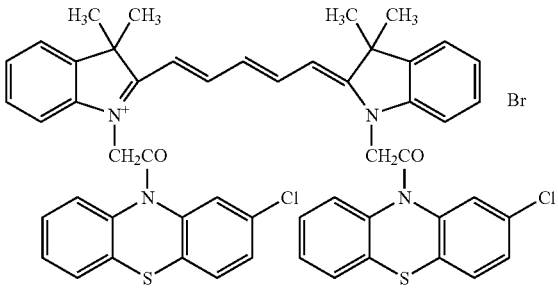

Blue dye compound-1

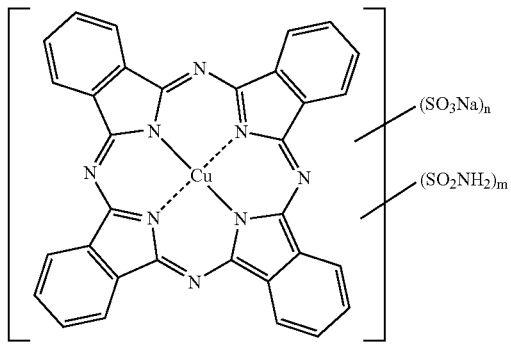

n = 0.5~2.0
m = 0.5~2.5

(Reducing agent-1)

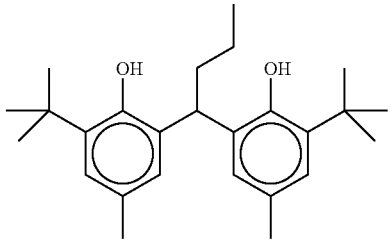

-continued (Hydrogen bonding compound-1)

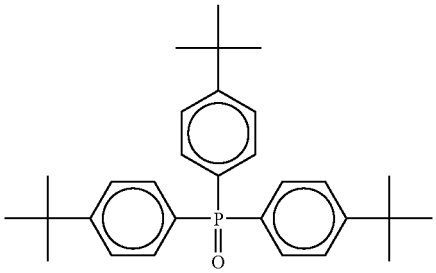

(Polyhalogen compound-1)

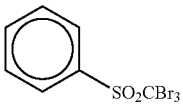

(Polyhalogen compound-2)

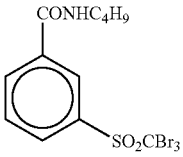

(Mercapto compound-1)

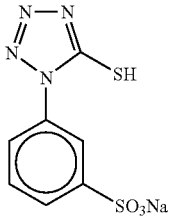

(Mercapto compound-2)

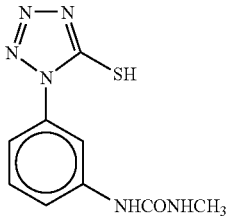

(Phthalazine compound-1)

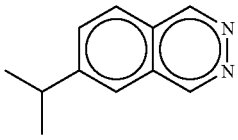

(Development accelerator-1)

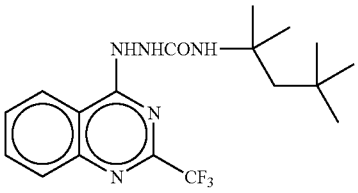

-continued (Development accelerator-2)

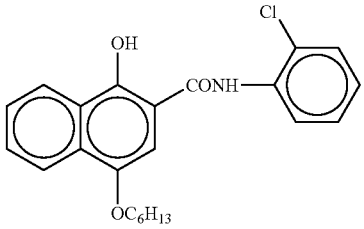

(Color toning agent-1)

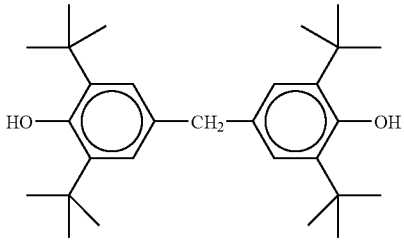

(FF-1)

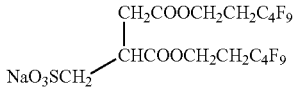

(FF-2)

Mixture of

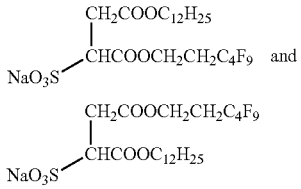

4. Evaluation for Photographic Performance

1) Preparation

The obtained specimen were cut each into a one-half size (43 cm length×35 cm width), packed in the following packaging material under a circumstance at 25° C., 50% RH and the following evaluations were conducted after storage for 2 weeks at a normal temperature.

2) Packaging Material

50 μm polyethylene containing PET 10 μm/PE 12 μm/aluminum foil 9 μm/Ny 15 μm/carbon 3% by mass, oxygen permeability: 0.02 ml/atm·$m^2$·25° C.·day, moisture, permeability: 0.10 g/atm·$m^2$·25° C.·day.

3) Exposure and Development of Photosensitive Material

The photothermographic materials 1 to 15 were exposed and thermally developed by using a Fuji medical dry laser imager-DRYPIX7000 (mounting 660 nm semiconductor laser at a maximum power of 50 mW (IIIB)) (for 14 sec in total by three panel heaters set to 107° C.–121° C.—121° C.), and obtained images were evaluated by a densitometer. The conveying speed of the sensitive material in the heat development was 28 mm/sec.

4) Evaluation for Photographic Performance

Evaluation Unprocessed Stock Storability

After storing each of the specimens under the conditions at 25° C.–40% RH and 40° C.–70% RH or 50° C.–70% RH for further 7 days, exposure and development were conducted in a circumstance at 25° C.–55% RH by the method described above to obtain images. The conditions for 40° C.–70% RH and 50° C.–70% RH are compulsory conditions for evaluating the storage storability till subjection to exposure and development after the manufacture of the photothermographic material. Table 2 shows the case when measured after storage at 40° C.–70% RH as (A) and a case when measured after storage at 50° C.–70% RH as (B).

For the evaluation of the unprocessed stock storability, change of the minimum density (Dmin) was measured. Table 2 shows the increment (%) of Dmin for the specimen stored at 40° C.–70% RH (ΔDmin (A)) relative to Dmin for the specimen stored at 25° C.–40% RH and the increment (%) for the specimen (ΔDmin (B)) for the specimen stored at 50° C.–70% RH.

Evaluation for Image Storability

After applying light sufficiently to the photothermographic material subjected to exposure and heat development and humidity control at 25° C.–70% RH for 3 hours, the materials were sealed in a bag capable of shielding light and left in a circumstance at 60° C. for 24 hours. The rate of change of the minimum density was evaluated according to the minimum density increment (%) (ΔDmin) relative to a specimen left in a circumstance at 25° C. to 40% RH for 24 hours. Those with smaller ΔDmin were more excellent in the image storability.

Results of evaluation are shown in Table 2.

TABLE 2

| Photo-thermograpic material | Outermost layer Binder | Intermediate layer B Binder | | Intermediate layer A Binder | Unprocessed stock storability Condition A | Unprocessed stock storability Condition B | Image storability | Remarks |
|---|---|---|---|---|---|---|---|---|
| 1 | Gelatin/latex = 100/34.2 | Gelatin/latex = 100/34.2 | | PVA/latex = 10/8 | 15% | 20% | 15% | Comp. Example |
| 2 | Gelatin/latex = 100/34.2 | PVA/latex = 100/80 | | Formula (M) P-8 | 7% | 11% | 8% | Invention |
| 3 | Latex LP-6 = 100 | Gelatin/latex = 100/34.2 | | Formula (M) P-8 | 7% | 10% | 7% | Invention |
| 4 | PVA/latex = 100/34.2 | PVA/latex 100/20 | PVA/latex = 100/40 | Formula (M) P-8 | 16% | 20% | 14% | Comp. Example |
| 5 | Gelatin/latex = 100/34.2 | Gelatin/latex = 100/342 | | Formula (M) P-8 | 7% | 9% | 8% | Invention |
| 6 | Gelatin/latex = 100/34.2 | Gelatin/latex = 100/34.2 | PVA/latex = 100/34.2 | Formula (M) P-8 | 6% | 9% | 7% | Invention |
| 7 | Gelatin/latex = 100/34.2 | Gelatin/latex = 100/34.2 | PVA/latex = 100/34.2 | Formula (M) P-7 | 6% | 8% | 7% | Invention |
| 8 | Gelatin/latex = 100/34.2 | Gelatin/latex = 100/34.2 | PVA/latex = 100/80 | Formula (M) P-8 | 5% | 8% | 6% | Invention |
| 9 | Gelatin/latex = 100/34.2 | Gelatin/latex = 100/40 | PVA/latex = 100/80 | Formula (M) P-4 | 5% | 9% | 7% | Invention |
| 10 | Gelatin/latex = 100/34.2 | Gelatin/latex = 100/40 | PVA/latex = 100/80 | Formula (M) P-7 | 5% | 8% | 6% | Invention |
| 11 | Latex LP-6 = 100 | Gelatin/latex = 100/40 | PVA/latex = 100/80 | Formula (M) P-8 | 5% | 9% | 7% | Invention |
| 12 | LatexLP6/ gelatin = 100/10 | Gelatin/latex = 100/40 | PVA/latex = 100/80 | Formula (M) P-8 | 6% | 9% | 6% | Invention |
| 13 | Latex LP6/ gelatin = 100/10 | Gelatin/latex = 100/40 | PVA/latex = 100/80 | Formula (M) P-4 | 6% | 9% | 5% | Invention |
| 14 | Latex LP6/ gelatin = 100/10 | Gelatin/latex = 100/40 | PVA/latex = 100/80 | Formula (M) P-7 | 5% | 9% | 6% | Invention |
| 15 | LatexLP6/ gelatin = 100/10 | Gelatin/latex = 100/40 | PVA/latex = 100/80 | Formula (M) P-10 | 6% | 9% | 6% | Invention |

or more of a latex of a polymer formed by copolymerizing the monomer represented by Formula (M), and at least one layer of the binder of the outermost layer and the non-photosensitive intermediate layer B contains 50% by mass or more of a hydrophilic polymer derived from animal protein.

Particularly, in a case where the latex is incorporated to the outermost layer, photothermographic materials were excellent in storage stability without causing stickiness or denaturation of picture quality due to finger prints.

Example 2

Preparation of Organic Silver Salt Dispersions B to C

Organic silver salt dispersions B to C of different silver behenate contents were prepared in the same manner as in the preparation for the organic silver salt dispersion A in Example 1 except for changing the ratio of recrystallized behenic acid A and recrystallized stearic acid.

Preparation of Image Forming Coating Solutions-2 to 4

Image-forming layer coating solutions-2 to 4 were prepared in the same manner as in the preparation of the image-forming layer coating solution-1 in Example 1 except for changing the organic silver salt dispersion, the reducing agent, the organic polyhalogen compound, the hydrogen bonding compound, color-tone-adjusting-agent and the development accelerator as shown in Table 3.

Manufacture of Photothermographic Materials-201 to 203

Photothermographic materials-201 to 203 were manufactured in the same manner as in the manufacture of the photothermographic material-6 in Example 1 except for changing the image-forming layer coating solution-1 to any one of the image-forming layer containing solutions-2 to 4. The coating amount for each compound ($g/m^2$) in the image-forming layer is identical with that for the photothermographic material-6.

The obtained photothermographic materials-201 to 203 were exposed and developed and evaluated in the same manner as in Example 1. The results are shown in Table 3.

TABLE 3

| Photo- | Image-forming layer | | | | | | Unprocessed storability | | Image | |
|---|---|---|---|---|---|---|---|---|---|---|
| thermo-graphic material | Behenic acid content (% by mole) | Reducing agent (type) | Hydrogen bonding compound | Polyhalogen compound | Development accelerator | Color toning agent | Condition A | Condition B | storability | Remarks |
| 6 | 82 | 1 | (presence) | (two type) | (presence) | 6-isopropyl phthalazine | 6% | 9% | 7% | Invention |
| 201 | 96 | 2 | (presence) | (two type) | (presence) | 6-isopropyl phthalazine | 4% | 8% | 5% | Invention |
| 202 | 96 | 1 | (presence) | (two type) | (presence) | 6-isopropyl phthalazine | 4% | 9% | 5% | Invention |
| 203 | 96 | 2 | (presence) | (one type) only 1 used | (presence) | 6-isopropyl phthalazine | 5% | 8% | 6% | Invention |

Preparation of Reducing Agent-2 Dispersion 4 g hydroxyl propyl cellulose and 86 g of water were added to 10 g of the reducing agent-2 and stirred sufficiently to form a slurry which was left for 10 hours. Then, 168 g of zirconia beads of an average diameter of 0.5 mm were provided and charged together with the slurry in a vessel and dispersed by the same dispersing machine as used for the preparation of the fine crystal dispersion of the organic silver salt for 10 hours to obtain a solid fine particle liquid dispersion. The average grain size for 70% by mass was 1.0 μm or less.

(Reducing agent-2)

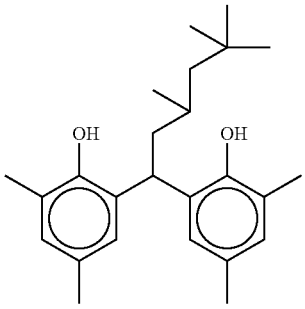

Also the photothermographic material suitable to rapid processing as in Example 2, unprocessed stock storability and the image storability were excellent so long as they were photosensitive material in which the non-photosensitive intermediate layer A and the non-photosensitive intermediate layer B were provided between the image-forming layer and the outermost layer, the binder of the non-photosensitive intermediate layer A provided in adjacent with the image-forming layer contains 80% by mass or more of a latex of a polymer formed by copolymerizing the monomer represented by Formula (M), and at least one layer of the binder of the outermost layer and the non-photosensitive intermediate layer B contains 50% by mass or more of a hydrophilic polymer derived from animal protein.

Example 3

An intermediate layer A coating solution-6 was prepared by further adding 100 g of a crosslinking agent-1 shown in Table 4 (EPOCROS K-2020E (Nippon Shokubai Co.)) in the intermediate layer A coating solution-2 in Example 1. A photothermographic material 301 was manufactured by the same method as that for the photothermographic material-2 in Example 1 except for using this intermediate layer coating solution. Further, evaluation was conducted by the same method as for Example 1. The results are shown in Table 4.

TABLE 4

| Photothermographic material | Outermost layer Binder | Intermediate A Binder | Crosslinking agent | Intermediate B Binder | Unprocessed stock storability Condition A | Condition B | Image storability | Remarks |
|---|---|---|---|---|---|---|---|---|
| 2 | Gelatin/ latex = 100/34.2 | PVA/latex = 100/80 | none | Formula (M) P-8 | 7% | 11% | 8% | Invention |
| 301 | Gelatin/ latex = 100/34.2 | PVA/latex = 100/80 | Crosslinking agent-1 | Formula (M) P-8 | 6% | 9% | 6% | Invention |

The unprocessed stock storability and image storability were further improved by the addition of the crosslinking agent.

What is claimed is:

1. A photothermographic material comprising at least an image-forming layer on at least one surface of a support, the iamge-forming layer containing a photosensitive silver halide, a non-photosensitive organic silver salt, a reducing agent, and a binder, further comprising:

an outermost layer containing a binder as a layer furthest from the support on the side of the support where the image-forming layer is provided;

a non-photosensitive intermediate layer A containing a binder and provided adjacent to the image-forming layer and between the image-forming layer and the outermost layer, wherein the binder of the non-photosensitive intermediate layer A contains 80% by mass or more of a polymer formed by copolymerizing a monomer represented by following Formula (M), a non-photosensitive intermediate layer B containing a binder and provided between the non-photosensitive intermediate layer A and the outermost layer, and at least one binder of the binder of the outermost layer and the binder of the non-photosensitive intermediate layer B contains 50% by mass or more of a hydrophilic polymer derived from animal protein:

$$CH_2{=}CR^{01}{-}CR^{02}{=}CH_2 \qquad \text{Formula (M)}$$

wherein $R^{01}$ and $R^{02}$ represent each independently a hydrogen atom, an alkyl group of from 1 to 6 carbon atoms, a halogen atom or a cyano group.

2. A photothermographic material according to claim 1, wherein the polymer formed by copolymerizing the monomer represented by Formula (M) is a polymer formed by copolymerizing 10% by mass or more and 70% or less of the monomer represented by Formula (M).

3. A photothermographic material according to claim 1, wherein the polymer formed by copolymerizing the monomer represented by Formula (M) is a polymer formed by copolymerizing 20% by mass or more and 40% or less of the monomer represented by Formula (M).

4. A photothermographic material according to claim 1, wherein the binder of the non-photosensitive intermediate layer B contains 50% by mass or more of a hydrophilic polymer derived from animal protein and the binder of the outermost layer contains a hydrophobic polymer latex.

5. A photothermographic material according to claim 1, wherein the non-photosensitive intermediate layer B comprises two or more layers, the layer of the non-photosensitive intermediate layer B on the side near the non-photosensitive intermediate layer A contains a binder containing 50% by mass or more of a hydrophilic polymer not derived from animal protein, and the layer of the non-photosensitive intermediate layer B on the side near the outermost layer contains a binder containing 50% or more by mass of a hydrophilic polymer derived from animal protein.

6. A photothermographic material according to claim 5, wherein the binder of the outermost layer contains a hydrophilic polymer derived from animal protein.

7. A photothermographic material according to claim 5, wherein the binder of the outermost layer contains a latex of a hydrophobic polymer.

8. A photothermographic material according to claim 5, wherein the binder of the outermost layer contains a hydrophilic polymer derived from animal protein and a latex of a hydrophobic polymer.

9. A photothermographic material according to claim 1, wherein the reducing agent is a compound represented by Formula (R1):

Formula (R1)

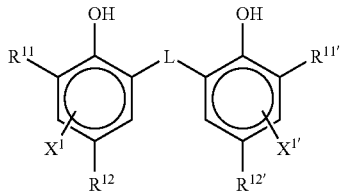

wherein $R^{11}$ and $R^{11'}$ each represents independently a secondary or a tertiary alkyl group of from 1 to 15 carbon atoms, $R^{12}$ and $R^{12'}$ each represents independently a hydrogen atom or a substituent capable of substitution on a benzene ring, L represents a —S— group, or —$CHR^{13}$— group, $R^{13}$ represents a hydrogen atom or an alkyl group of from 1 to 20 carbon atoms, and $X^1$ and $X^{1'}$ each represents independently a hydrogen atom or a group capable of substitution on a benzene ring.

10. A photothermographic material according to claim 9, wherein the image-forming layer further contains a compound represented by Formula (D):

Formula (D)

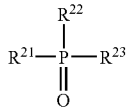

wherein $R^{21}$ to $R^{23}$ each represents independently an alkyl group, an aryl group, an alkoxy group, an aryloxy group, an amino group, or a heterocyclic group.

11. A photothermographic material according to claim 1, wherein the image-forming layer further contains a development accelerator.

12. A photothermographic material according to claim 11, wherein the image-forming layer further contains a compound represented by Formula (D):

Formula (D)

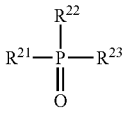

wherein $R^{21}$ to $R^{23}$ each represents independently an alkyl group, an aryl group, an alkoxy group, an aryloxy group, an amino group, or a heterocyclic group.

13. A photothermographic material according to claim 1, wherein the image-forming layer further contains a compound represented by Formula (H)

$$Q\text{-}(Y)_n\text{—}C(Z_1)(Z_2)X \qquad \text{Formula (H)}$$

wherein Q represents an alkyl group, an aryl group, or a heteycyclic group, Y represents a bivalent linking group, n represents 0 to 1, $Z_1$ and $Z_2$ each represents independently a halogen atom, and X represents a hydrogen atom or an electron attracting group.

14. A photothermographic material according to claim 13, wherein the image-forming layer contains two or more kinds of compounds represented by Formula (H).

15. A photothermographic material according to claim 1, wherein the image-forming layer further contains a compound represented by Formula (I):

Formula (I)

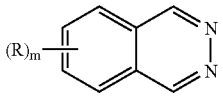

wherein, R represents a substituent and m represents an integer of 1 to 6.

16. A photothermographic material according to claim 15, wherein the image-forming layer further contains a color toning agent.

17. A photothermographic material according to claim 1, wherein the non-photosensitive organic silver salt contains 90% by mole or more and 100% by mole or less of silver behenate.

18. A photothermographic material according to claim 1, wherein the coating amount of silver is 1.3 $g/m^2$ or less.

19. A photothermographic material according to claim 1, wherein one or more the layers provided on the side of the support where the image-forming layer is provided contain a crosslinking agent.

20. A method of forming images with A photothermographic material comprising iamge-exposing and heat developing, wherein the photothermographic material according to claim 1 is heated for 7 sec or more and 16 sec or less in the heat developing.

21. A method of forming images with a photothermographic material according to claim 20, wherein the photothermographic material according to claim 1 is conveyed at a rate of 23 mm/sec or more in the heat developing.

22. A method of forming images with a photothermographic material comprising iamge-exposing and heat developing, wherein the photothermographic material according to claim 1 is conveyed at a speed of 23 mm/sec or more in the heat developing.

* * * * *